United States Patent [19]

Tanioka et al.

[11] Patent Number: 4,711,558

[45] Date of Patent: Dec. 8, 1987

[54] COPYING APPARATUS WITH VARIABLE IMAGE MAGNIFICATION

[75] Inventors: Hiroshi Tanioka; Toshio Honma, both of Tokyo, Japan

[73] Assignee: Canon Kabushiki Kaisha, Tokyo, Japan

[21] Appl. No.: 811,308

[22] Filed: Dec. 16, 1985

Related U.S. Application Data

[63] Continuation of Ser. No. 434,496, Oct. 15, 1982, abandoned.

[30] Foreign Application Priority Data

Oct. 19, 1981 [JP] Japan ..... 56-166649
Oct. 19, 1981 [JP] Japan ..... 56-166650
Oct. 19, 1981 [JP] Japan ..... 56-166652

[51] Int. Cl.[4] ..... G03G 15/04; G03G 21/00

[52] U.S. Cl. ..... 355/14 R; 355/14 E; 355/55

[58] Field of Search ..... 355/8, 14 R, 14 C, 14 E, 355/55, 56

[56] References Cited

U.S. PATENT DOCUMENTS

| | | | |
|---|---|---|---|
| 4,007,986 | 2/1977 | Komori et al. | 355/8 X |
| 4,046,467 | 9/1977 | Laskowski et al. | 355/3 R X |
| 4,076,417 | 2/1978 | Hayashi et al. | 355/8 X |
| 4,084,897 | 4/1978 | Queener | 355/8 |
| 4,211,482 | 7/1980 | Arai et al. | 355/8 |
| 4,372,676 | 2/1983 | Miyata et al. | 355/14 R X |

*Primary Examiner*—Fred L. Braun

*Attorney, Agent, or Firm*—Fitzpatrick, Cella, Harper & Scinto

[57] ABSTRACT

A copying apparatus with variable image magnification having a light source for exposure scanning of an original, a photosensitive member for forming an electrostatic latent image in response to the light from the original, a mirror and lens, and a control unit for controlling movement of the mirror and the lens independently of each other to allow individual movement thereof for effecting a desired image magnification. A charge eliminator is provided and is operated for a time selected in accordance with the selected magnification. There are also provided first and second computers, the second computer receiving data entered into the first computer and controlling the image formation in accordance therewith.

15 Claims, 70 Drawing Figures

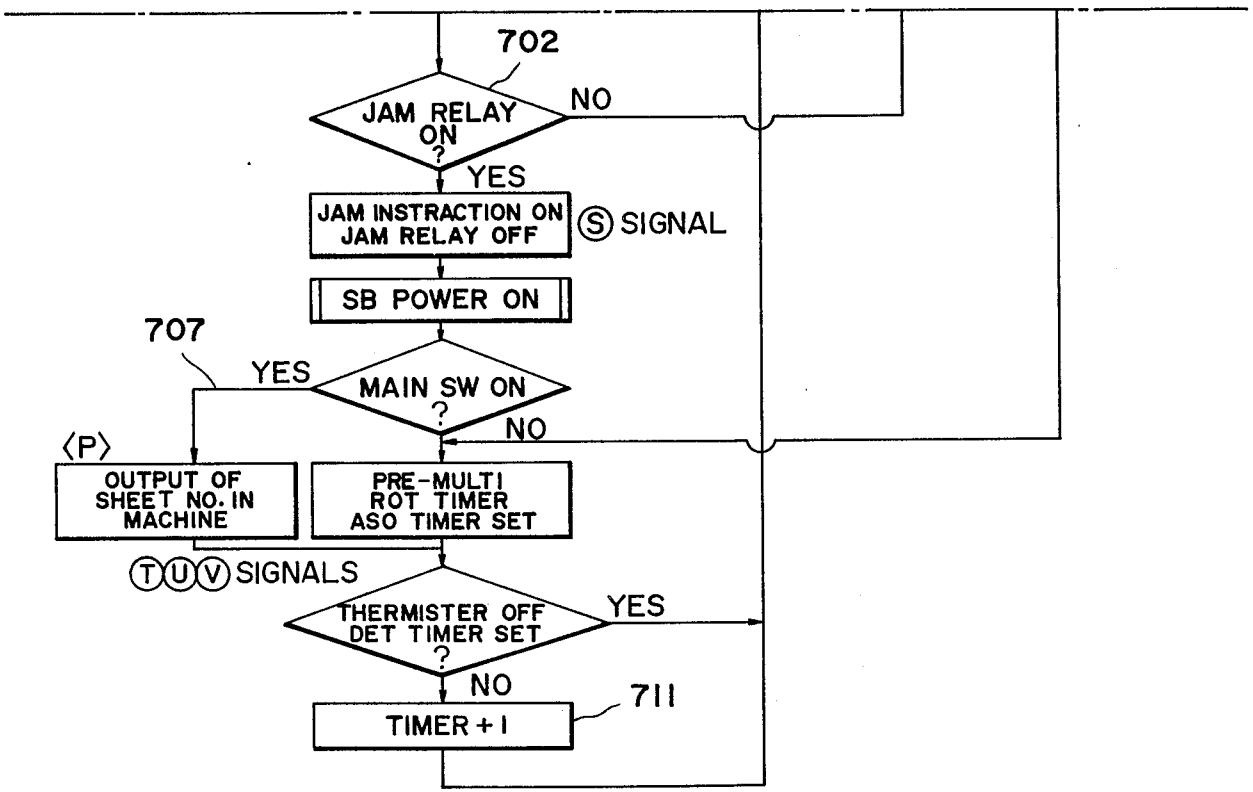
FIG. 5-ID

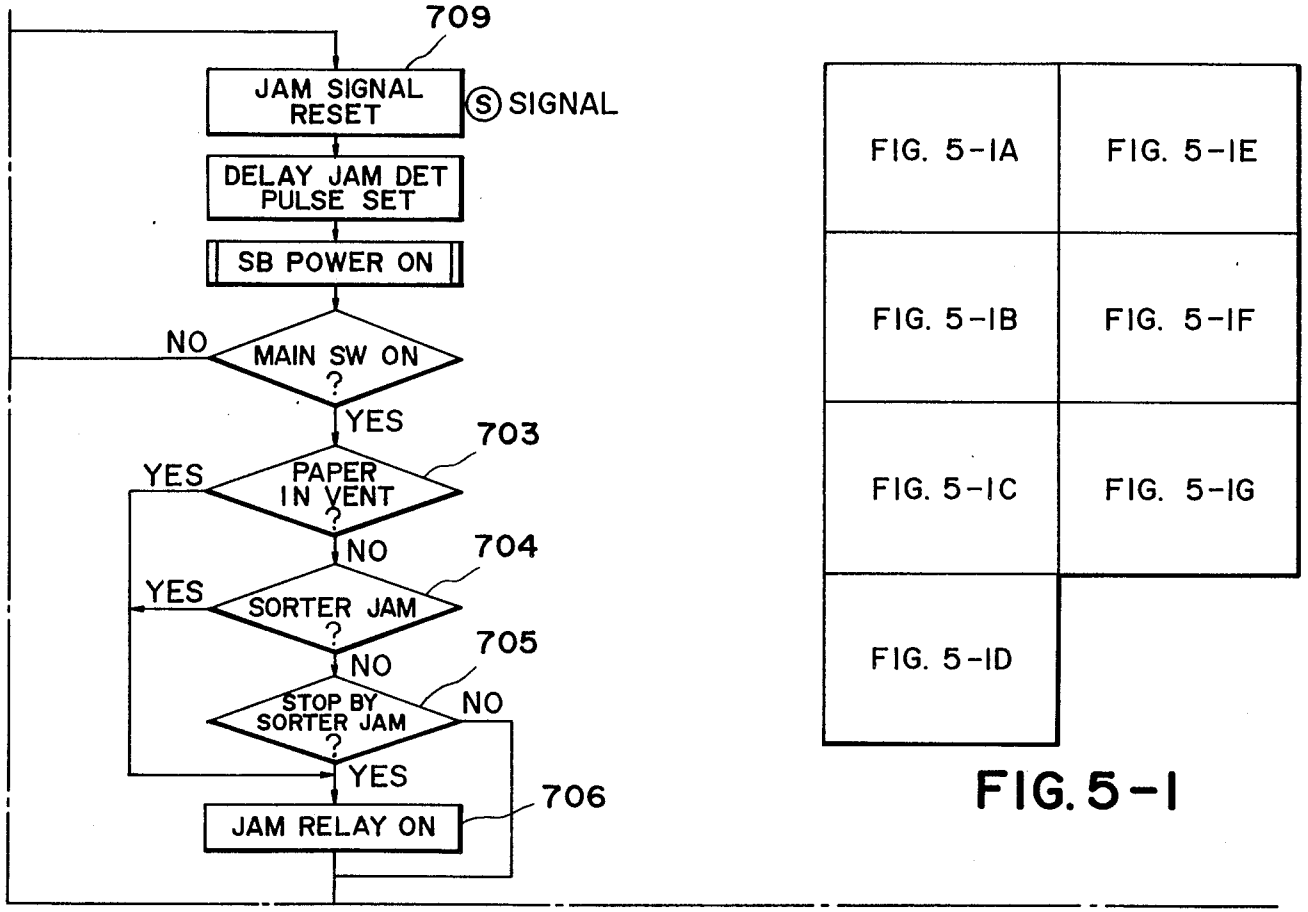
FIG. 5-IE
| | | | |
|---|---|---|---|
| FIG. 5-IE | FIG. 5-IF | FIG. 5-IG | |
| FIG. 5-IA | FIG. 5-IB | FIG. 5-IC | FIG. 5-ID |
FIG. 5-I

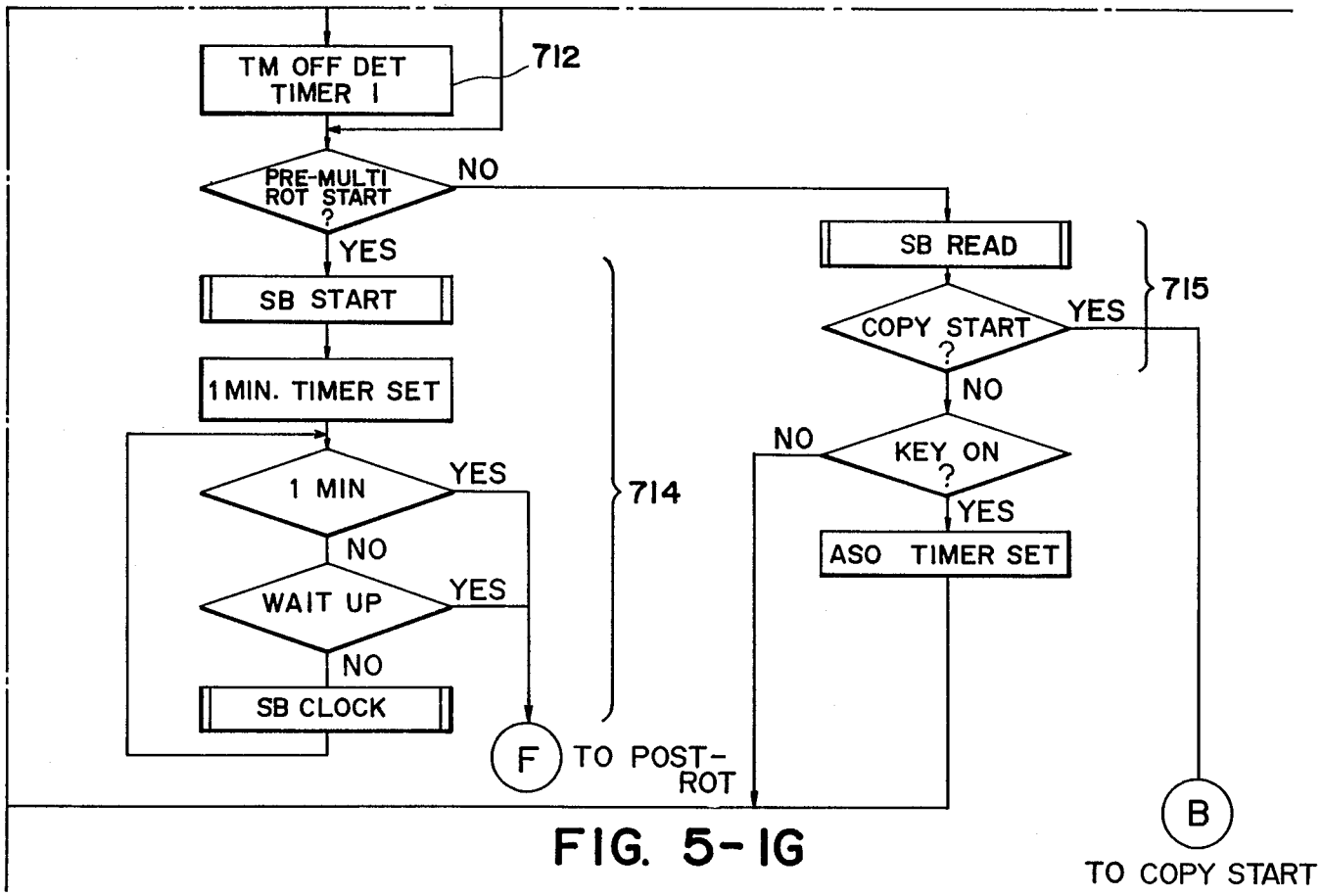
FIG. 5-IG

| | | | | |
|---|---|---|---|---|
| FIG. 5-3A | FIG. 5-3C | FIG. 5-3E | FIG. 5-3G | FIG. 5-3I |
| FIG. 5-3B | FIG. 5-3D | FIG. 5-3F | FIG. 5-3H | FIG. 5-3J |

| CASSETTE SIZE / MAG | A3 | B4 | A4R | B5R | A4 | B5 |
|---|---|---|---|---|---|---|
| EQUAL | A3 | B4 | B4 | B4 | A4 | A4 |
| $M_1$ | A3 | A3 | A3 | B4 | B4 | B4 |
| $M_2$ | A3 | A3 | B4 | B4 | B4 | A4 |

FIG. 13

COPYING APPARATUS WITH VARIABLE IMAGE MAGNIFICATION

This application is a continuation of application Ser. No. 434,496 filed Oct. 15, 1982 now abandoned.

BACKGROUND OF THE INVENTION

1. Field of the Invention

The present invention relates to a copying apparatus with variable image magnification.

2. Description of the Prior Art

Recent progress in copier technology has provided multi-function copiers capable of copying in enlarged and/or reduced size in addition to the equal-size copying.

In such copiers, the image reduction or enlargement is conventionally achieved by displacing a lens and a mirror constituting the imaging system to predetermined positions according to a desired image magnification, thereby changing the dimension of the image projected on the photosensitive member.

Such lens and mirror are generally connected to each other through a mechanical link so that either one follows the movement of the other with a determined positional relationship therebetween.

In recent small copiers, however, the use of a drive mechanism involving such mechanical link between the lens and mirror is becoming spatially difficult. Also the moving spaces of the lens and mirror have to cross each other in certain cases and the conventional drive mechanism cannot cope with such requirement.

Such conventional copying apparatus is also provided with a light source, called blank exposure lamp, which is positioned close to the surface of the photosensitive drum and lighted while said drum is rotated but not exposed to the original image, thereby eliminating the charge in the non-copying area of the drum surface in order to avoid deposition of unnecessary toner on the drum.

This light source has to be turned off immediately before the scanning of the original document reaches the front end thereof, and is therefore controlled by time measurement from the start of said scanning. Stated differently said light source is turned on for a period corresponding to so-called pre-scanning distance from the start of original scanning motion.

In a copier with variable image magnification, in which the original scanning speed is generally variable, the measured time mentioned above should vary according to the scanning speed. In practice, however, said measured time is maintained constant for the purpose of simplifying the control program, and a white board is provided in a position to be illuminated by the pre-running of the optical system to dissipate the charge on the drum surface by the light of the original exposure lamp, thereby compensating for the aberration in the timing of blank exposure resulting from the difference in the image magnification.

However such compensation may not be effective enough since the light reflected from the white board can be weakened by the density adjust lever to be manipulated by the operator.

In high-speed copiers producing a large quantity of copies, the unnecessary loss of toner resulting from the above-mentioned incomplete charge elimination in the pre-scanning part of the optical system becomes large and cannot therefore be overlooked.

On the other hand, in copiers with variable image magnification, the copying in equal size and in varied size is achieved by varying the speed of the scanning system and the position of the optical system, and the scanning distance of the scanning system is limited to the necessary minimum in order to shorten the copy cycle time according to the selected image magnification. For this purpose switching elements such as microswitches are provided along the moving path of the scanning system, and one of said elements, selected according to the image magnification and copy size, is actuated by the scanning element to reverse the movement thereof. Also said switches are selected for controlling the scanning motion according to the sheet size in order to form the image within the size of the copying sheet.

There are however required a number of switches along the moving path as the number of image magnifications and of sheet sizes increases. Also in case the data for controlling the scanning distance are transmitted to and received from a microcomputer, the data lines of a limited number are almost occupied for this purpose.

SUMMARY OF THE INVENTION

In consideration of the foregoing, the object of the present invention is to provide a copying apparatus in which the lens and mirror are independently moved in order to attain a desired image magnification.

Another object of the present invention is to provide a compact copying apparatus with variable image magnification.

Still another object of the present invention is to provide a copying apparatus allowing safe movements of lens and mirror.

Still another object of the present invention is to provide a copying apparatus with a simplified mechanism for varying image magnification.

Still another object of the present invention is to provide a copying apparatus capable of providing a clear image.

Still another object of the present invention is to provide an economic copying apparatus.

Still another object of the present invention is to provide a copying apparatus capable of complete charge elimination regardless of the image magnification.

Still another object of the present invention is to provide a copying apparatus capable of controlling the scanning system with a simple structure regardless of the image magnification.

Still another object of the present invention is to provide a copying apparatus capable of controlling the scanning motion with minimum data.

BRIEF DESCRIPTION OF THE DRAWINGS

FIG. 5-1 composed of FIGS. 5-1A, 5-1B, 5-1C, 5-1D, 5-1E, 5-1F and 5-1G is a flow chart showing the control sequence of the copying apparatus embodying the present invention;

FIG. 5-2 composed of FIGS. 5-2A, 5-2B, 5-2C and 5-2D is a flow chart showing the control sequence of the copying apparatus embodying the present invention;

FIG. 5-3 composed of FIGS. 5-3A, 5-3B, 5-3C, 5-3D, 5-3E, 5-3F, 5-3G, 5-3H, 5-3I and 5-3J is a flow chart showing the control sequence of the copying apparatus embodying the present invention;

FIG. 5-4 composed of FIGS. 5-4A, 5-4B, 5-4C, 5-4D and 5-4E is a flow chart showing the control sequence of the copying apparatus embodying the present invention;

FIG. 5-5 composed of FIGS. 5-5A, 5-5B, 5-5C, 5-5D, 5-5E, 5-5F, 5-5G and 5-5H is a flow chart showing the control sequence of the copying apparatus embodying the present invention;

FIG. 5-6 composed of FIGS. 5-6A, 5-6B, 5-6C, 5-6D, 5-6E, 5-6F, 5-6G and 5-6H is a flow chart showing the control sequence of the copying apparatus embodying the present invention;

FIG. 5-7 composed of FIGS. 5-7A, 5-7B and 5-7C is a flow chart showing the control sequence of the copying apparatus embodying the present invention;

FIGS. 6-1 to 6-2 are time charts showing the sequence of control procedures;

FIG. 7 is a cross-sectional view of a copying apparatus representing another embodiment;

FIG. 13 is a chart showing the scanning distances determined by the cassette size and the image magnification.

DETAILED DESCRIPTION OF THE PREFERRED EMBODIMENTS

Now the present invention will be clarified in detail by the following description, which is to be taken in conjunction with the attached drawings.

Figure 1:
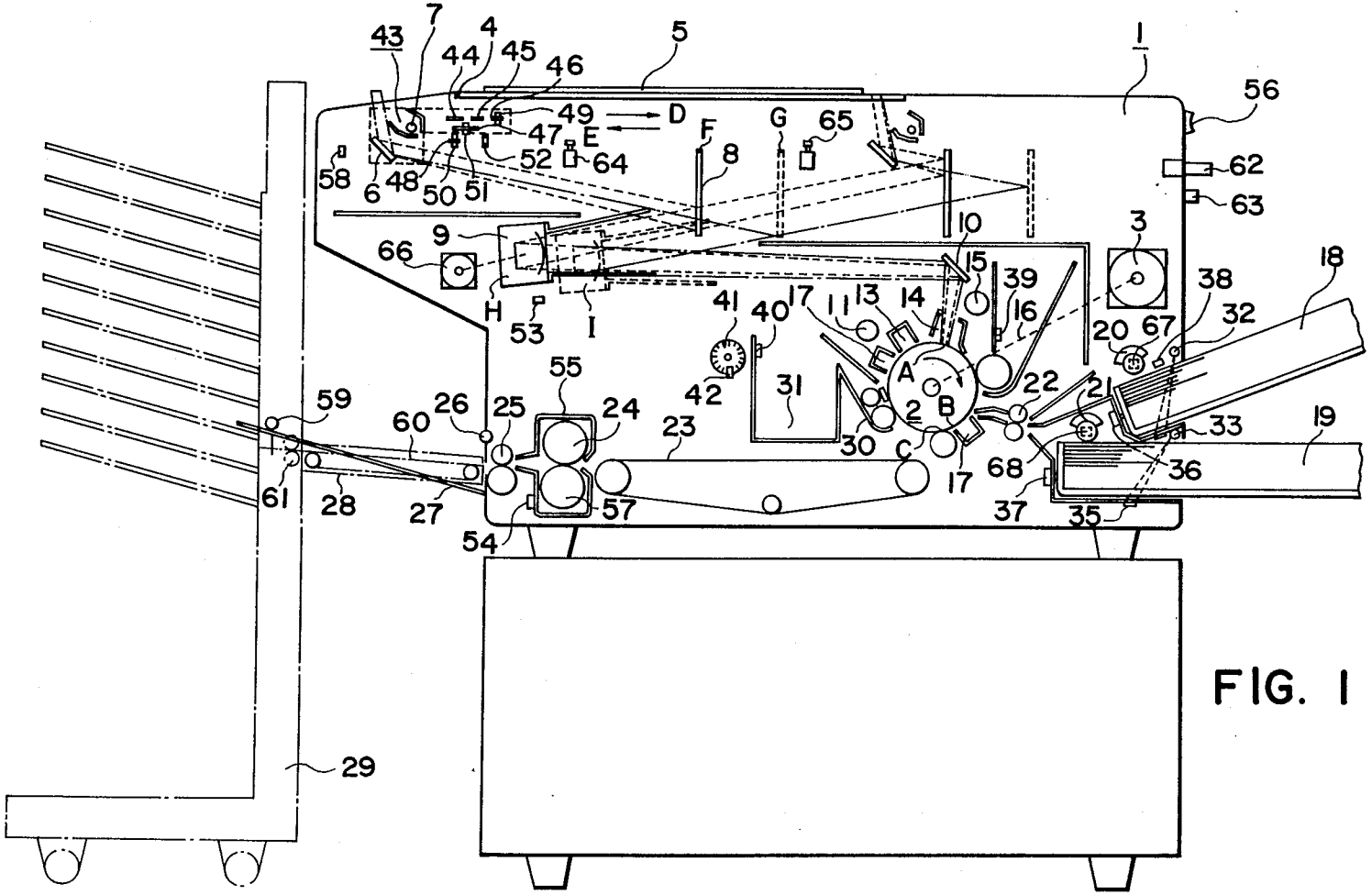
FIG. 1 is a cross-sectional view of a copying apparatus embodying the present invention.

FIG. 1 is a cross-sectional view of a copying apparatus 1 embodying the present invention, wherein a drum 2, provided on the periphery thereof with a three-layered photosensitive member utilizing CdS photoconductor, is rotatably supported by a shaft and is rotated in a direction of arrow by a main motor 3 energized in response to the actuation of a copy start key.

When the drum 2 completes a determined prerotation step, an original document 5 placed on an original carriage glass 4 is illuminated by a lamp 7 integral with a first scanning mirror 6, and the reflected light is introduced through said first scanning mirror 6 and a second scanning mirror 8 into an in-mirror lens 9. Said first mirror 6 and second mirror 8 are driven with a speed ratio of 1:½, whereby the optical path length in front of the in-mirror lens 9 is maintained constant during the original scanning.

Said reflected light is further guided through said in-mirror lens 9 and a third mirror 10 and focuses an image on the drum 2 in an exposure station A.

Prior to the exposure to said image forming light, the drum 2 is subjected to a charge elimination by a pre-exposure lamp 11 and a charge pre-eliminator 12, and is then corona charged, for example positively, by a primary charger 13. Thereafter the drum is slit exposed, in said exposure station A, to the light image reflected from the original 5, simultaneously with a charge elimination, with an AC corona discharge or a DC corona discharge of a polarity opposite to that of the primary charging, for example a negative corona discharge, by a secondary charger 14, and is subsequently exposed uniformly to the light from a exposure lamp 15, thereby forming an electrostatic latent image of an elevated contrast on the drum 2.

Said latent image on the photosensitive drum 2 is developed by a developing roller in a developing unit 16 into a visible toner image, which is then transferred in an image transfer station B by a transfer charger 17 onto a recording sheet supplied at a determined timing. The recording sheet is stored in an upper cassette 18 or a lower cassette 19, supplied into the apparatus by the rotation of a semi-circular feed roller 20 or 21 and advanced by a registering roller 22 to said image transfer station B with such a timing that the leading end of said recording sheet coincides with the front end of said latent image on the photosensitive drum 2.

After the image transfer the recording sheet is separated from the photosensitive drum 2 at a separating station C and is transported by a conveyor belt 23 to a fixing roller 24 for image fixation with pressure and heat. Thereafter the sheet is transported through discharge rollers 25 and a sheet sensor 26 to a tray 27, or to a sorter 29 through a path 28.

Also after the image transfer the photosensitive drum 2 continues to rotate and is cleaned by a cleaning unit 30 composed of a cleaning roller and an elastic blade in preparation for the succeeding imaging cycle. The recovered toner is collected in a used toner container 31.

In the following explained are various sensors employed in the present apparatus.

Lamps 32, 33 are so positioned as to respectively illuminate CdS sensors 34, 35 for detecting the absence of recording sheets respectively in the upper and lower cassettes through the known change of resistance in said CdS photosensors.

In the present embodiment the lamp 32 or 33 is respectively turned on only when the upper or lower cassette is inserted into the copying apparatus 1.

Switches 36, 37 for detecting the size of the upper and lower cassettes are composed of groups of four switches, which are selectively actuated by a size identifying cam provided on each cassette, thereby identifying the size of the mounted cassette as well as the presence or absence of the cassette.

Also the apparatus of the present embodiment is capable of single copying on a manually inserted recording sheet, which is to be manually inserted along the cover of the upper cassette 18 into the apparatus 1 and is transported by the aforementioned feed roller 20 and registering roller 22 A switch 38 generates a signal when a manual insertion guide is mounted.

There are also shown a switch 39 for detecting the presence of toner in the hopper of the developing unit, a switch 40 for detecting the toner overflow from the used toner container, and a pulse generator for generating drum clock pulses through the combination of a disk rotated in synchronization with the main motor 3 and a photointerruptor 42. Said drum clock pulses are used as reference for the sequence control of the copying apparatus.

In the present embodiment the speed of the photosensitive drum is always constant.

A first scanning mirror carriage 43, supporting the lamp 7 and the first scanning mirror 6, performs reciprocating motion in directions D and E for optical scanning along unrepresented rails. On said carriage 43 provided are photointerrupter shield plates 45, 44 for respectively determining the timings of sheet feeding and registering, and photointerrupter shield plates 46, 47 for determining the stop positions of said first scanning mirror carriage 43.

The second scanning mirror 8 is provided with a photointerrupter shield plate 48 for detecting the position of said mirror 8 at the equal-size copying and at the reduction copying. Said second scanning mirror 8 is mounted on an unrepresented carriage and is driven, as explained before, at a speed equal to a half of that the first scanning mirror 6. The first scanning mirror support 43 can be disconnected from said unrepresented support for the second scanning mirror 8 by an unlocking solenoid 64 or 65.

A photointerrupter 49, composed of a light-emitting-diode and an opposed phototransistor, is provided for detecting the passage of shield plates 44, 45, 46. A similar photointerrupter 51 is provided for detecting the position of shield plate 47. Similar photointerrupters 50, 52 are provided for detecting the position of shield plate 48, and generate signals upon said detection respectively indicating that the second scanning mirror 8 is at a position F for equal-size copying or a position G for reduction copying.

H and I respectively indicate a lens position for equal-size copying or for reduction copying.

A switch 53 detects that the lens 9 is at said position H for equal-size copying.

A thermal switch 54 detects the temperature of the fixing unit 55 and turns on a circuit therefor when the temperature is low. In the present embodiment the thermal switch 54 detects the temperature at a determined period after a main switch 56 is turned on, and, if a low temperature is detected in this state, the fixing roller is rotated for a determined period in order to heat a pressure roller 57.

A switch 58 is provided for detecting if a front cover of the copying apparatus is closed.

A switch 59, positioned at the entrance of the sorter 29, is provided for detecting the passage of recording sheets.

A conveyor belt 60 is provided in the path 28 for guiding recording sheets into the sorter 29, and feed rollers 61 are provided at the entrance of said sorter 29 for advancing the recording sheets.

The main switch 56 can be turned off electrically by a signal to a trip coil, in addition to the manual on-off operation.

A key counter 62, for indicating the total copy count for each operator, is provided with a short-circuit bar for detecting the insertion of said counter into the corresponding socket.

There are also shown a total copy counter 63, unlocking solenoids 64, 65, and a lens driving motor 66.

Figure 2:
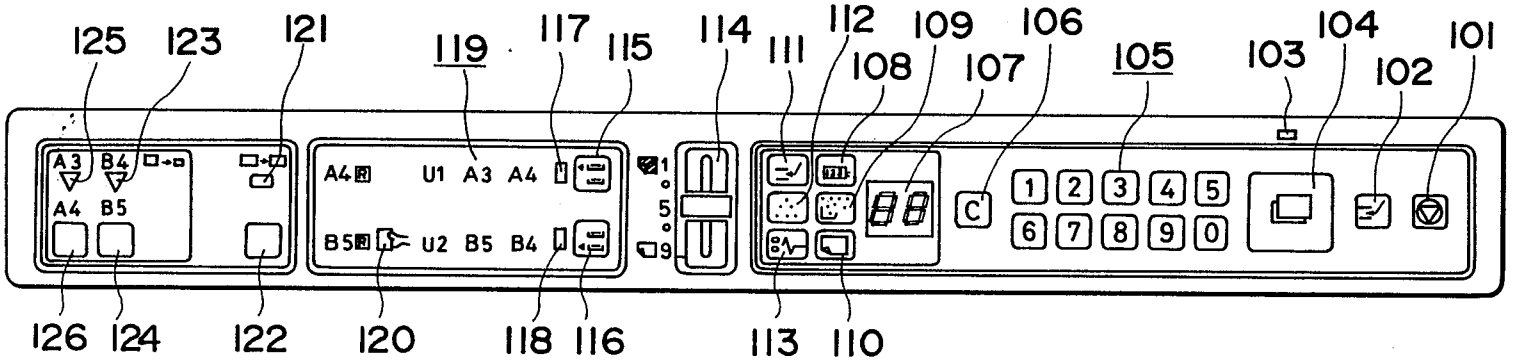
FIGS. 2 and 3 are detailed plan views of the control panel of the copying apparatus shown in FIG. 1.

Now reference is made to FIG. 2 showing the control panel of the present embodiment.

Figure 4A:
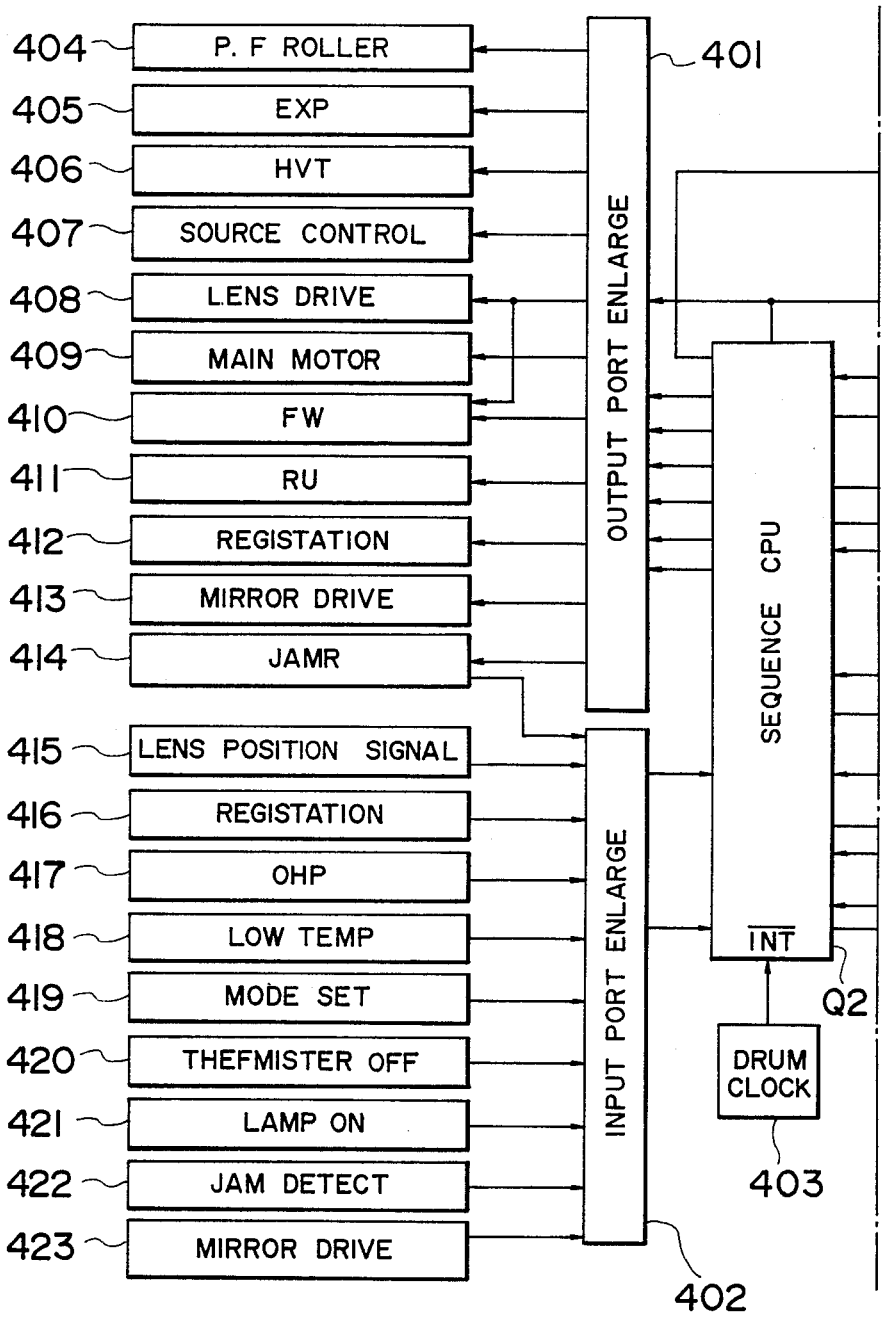
FIG. 4 composed of FIGS. 4A, 4B and 4C a block diagram of the control circuit for the copying apparatus shown in FIG. 1.
Figure 4B:
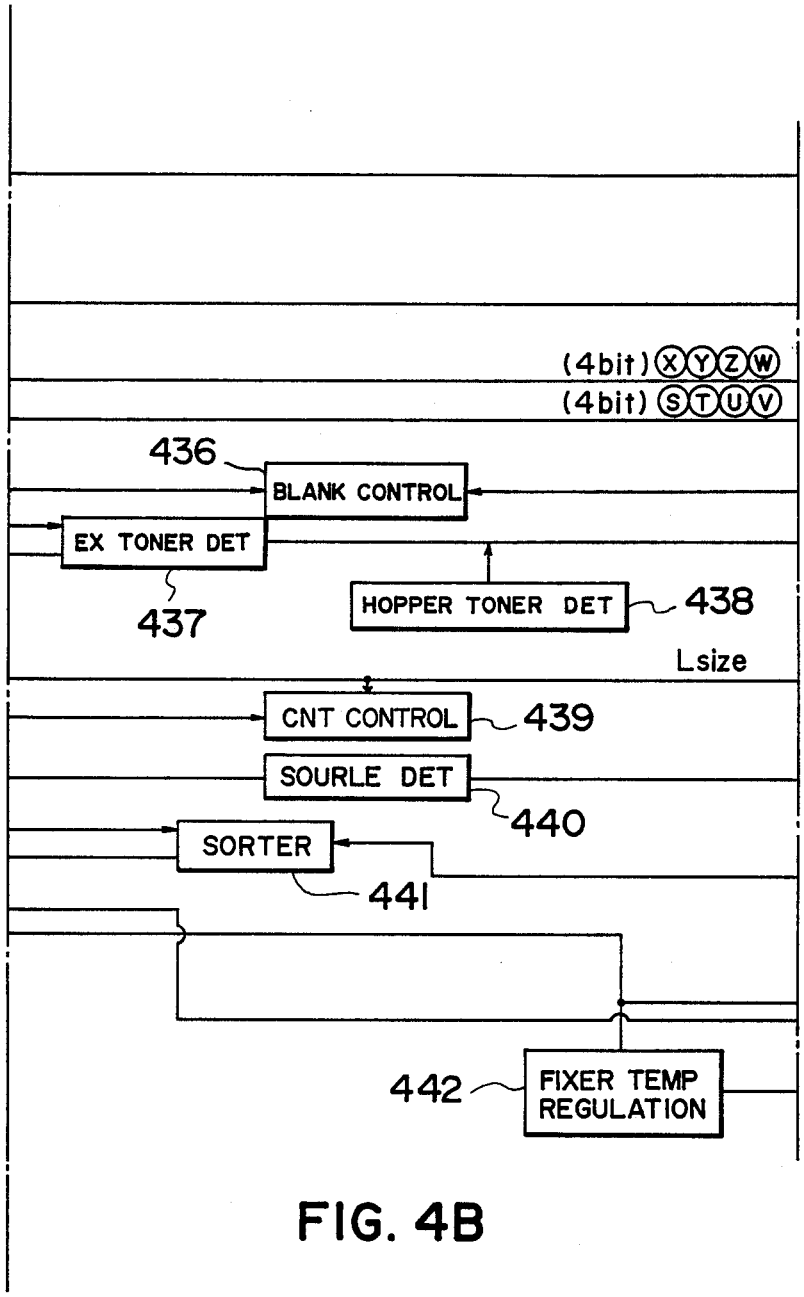
Figure 4C:
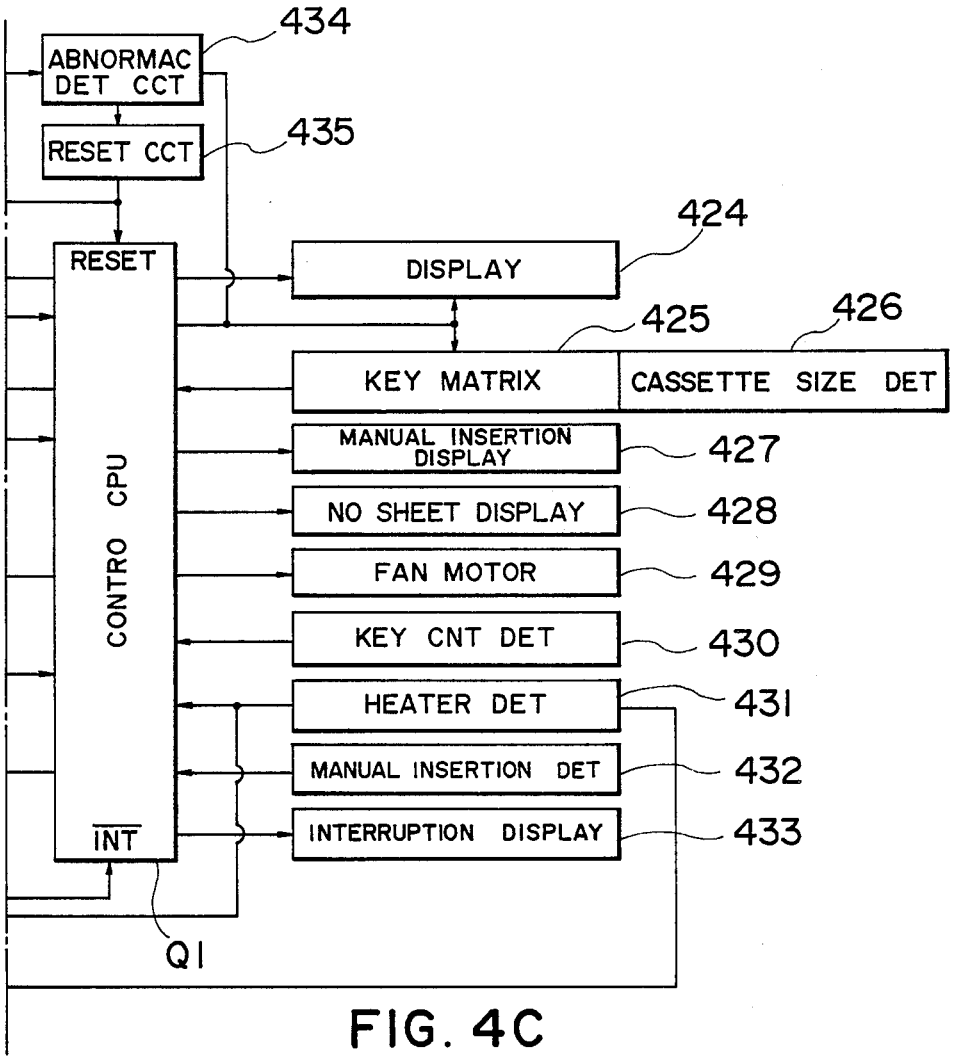
Figure 4:
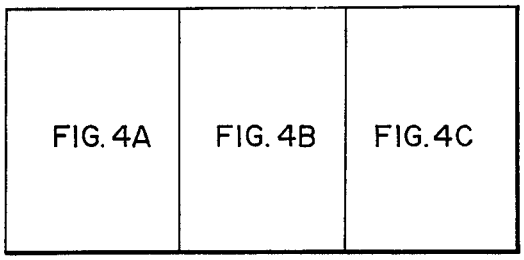

Although the present embodiment has only one image reduction rate in order to realize a simple structure for image reduction, the control circuit shown in FIG. 4 can also control plural image reduction rates by the use of suitable selected input signals.

FIG. 2 shows the control panel of the embodiment with an image reduction rate of 0.67, for example from A3 size to A4 size. In FIG. 2 there are shown keys 115, 116 for respectively selecting the upper or cassette; a sliding lever 114 for selecting the copy density in which a position "5" indicates a standard density; numeral keys 105 for setting the desired copy number; a clear key 106 for cancelling said set number; an interruption key 102 for executing another series of copying before the completion of copying operation set by said keys 105; a copy start key 104 for initiating the copying operation; and a stop key 101 for interrupting the continuous copying operation for the set number. Said stop key 101 is used also for cancelling the interruption copying mode selected by the interruption key 102. There are also provided a key 122 for selecting the equal-size copying; an indicator 121 to be lighted during the equal-size copying; keys 124, 126 respectively for selecting the reduction copying modes from B4 size to B5 or A3 size to A4, both with a reduction rate of 0.67 as explained before; indicators 123, 125 to be respectively lighted during the copying mode selected by the key 124 or 126; indicators 117, 118 for indicating the cassette selected by the key 115 or 116; and an indicator 119 for indicating the size of cassette thus selected. Said indicator 119 also indicates a suitable cassette by blinking, in the reduction copying mode selected by the key 124 or 126, if the size of the cassette selected by the cassette selecting key 115 or 116 is not suitable for such reduction copying. During said blinking indication, the size of the selected cassette is also indicated by continous lighting.

There are further provided an interruption mode indicator 111 to be lighted when the interruption key 102 is actuated and turned off when the interruption copying is completed or cancelled by the stop key 101; a key counter indicator 108 to be lighted when the key counter is not inserted into the socket; a manual insertion indicator 120 to be lighted when a guide for manual insertion is mounted; a used toner indicator 109 to be lighted when the sensor 40 detects that the used toner container 31 shown in FIG. 1 is filled with the toner and turned off when said toner is discharged; a paper/cassette indicator 110 to be lighted in case the selected cassette support has no cassette or in case the cassette in the selected cassette support has no recording paper; a toner indicator 112 to be lighted when the developer in the developing unit 16 becomes less than a determined amount; and a paper feed indicator 113 to be lighted in case of sheet jamming in the copying apparatus or in the attached sorter 29.

A waiting indicator 103 blinks while the temperature of the fixing heater is lower than a specified value after the main switch 56 is turned on, and is turned off when the temperature reaches said specified value and the waiting step is completed.

A copy count indicator 107, composed of two digits of 7-segment display elements for indicating numbers from "1" to "99", displays the copy number set by the numeral keys 105. Said indicator 107 automatically displays a number "1" (hereinafter called automatic clearing function) immediate after the main switch 56 is turned on, or at the completion of a copying operation, or at the lapse of a determined period after a last key actuation, or in response to the actuation of the clear key. Also in response to the actuation of the interruption key 102, said indicator displays "1" instead of the copy number displayed before, then displays a set copy number selected by the numeral keys for the interruption copying mode, and again displays the set copy number in the preceding copying mode when said interruption copying mode is completed or cancelled.

Figure 3:
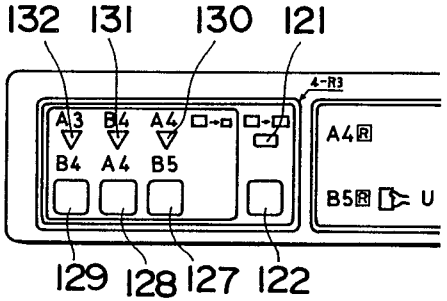

FIG. 3 shows a part of the control panel for selecting the reduction copying modes in a copying apparatus capable of also providing a reduction rate of 0.78, wherein the key 121 and indicator 122 are same as those in FIG. 2. There are further provided reduction mode selecting keys 127, 128, 129 respectively for image reductions from A4 size to B5, B4 to A4 and A3 to B4; and indicators 130, 131, 132 to be respectively lighted during the copying modes selected by the keys 127, 128, 129.

FIG. 4 is a block diagram of the control circuit for the copying apparatus of the present embodiment, in which two known one-chip microcomputers CPU are respectively used for the sequence control of the copying processes and for the real-time control of input signals from the keys and of segment displays, thereby avoiding the errors in control often encountered in the control with a single microcomputer.

In FIG. 4, a microcomputer Q1 is used for the real-time control and is hereinafter referred to as the control CPU, while another microcomputer Q2 is used for the sequence control and is hereinafter referred to as the sequence CPU. Said microcomputer Q1, Q2 perform various controls according to the programs stored in the built-in read-only memories ROM.

In the present embodiment said control CPU or sequence CPU may be composed for example of a device μPD546 manufactured by Nippon Electric Co.

In FIG. 4 there are shown an output port enlarging adaptor 401 for expanding the output ports of the sequence CPU Q2, and an input port enlarging adaptor 402 for expanding the input ports of the sequence CPU Q2.

Said adaptor 401 is connected to a paper feed driver 404; an exposure lamp driver 405; a charger driver 406; a trip coil control circuit 407 for the main switch 56; a lens driver 408; a main motor driver 409; a forward clutch driver 410; a reverse clutch driver 411; a registering roller driver 412; a mirror driver 413; and a jam relay 414, which are controlled by the output signals of the sequence CPU Q2 supplied through said adaptor 401.

Also said adaptor 402 receives the signal from the jam relay 414; a lens position signal 415 from the lens position detecting switch 53; a registering roller signal 416 for determining the start of rotation of the registering roller; a home position signal 417 from the photointerruptor 51 for detecting the home position of the first mirror carriage 43; a low-temperature signal 418 from the thermal switch of the fixing unit 55; a mode set signal 419 for indicating the equal-size copying mode or the reduction copying mode; a thermistor failure signal 420; a lamp-on signal 421 indicating that the exposure lamp 7 is lighted; a jamming detection signal 422; and a mirror position signal 423 from the photointerrupters 50, 52 for detecting the position of the second scanning mirror 8, which are transmitted to the sequence CPU Q2.

Said sequence CPU Q2 also receives the drum clock pulses 403 from a drum clock pulse generator 41 through a port INT.

In FIG. 4 there are also shown a blank exposure lamp driver 436; a switch 437 for detecting the overflow of the used toner; a switch 438 for detecting the toner in the developing hopper; a driver 439 for controlling the counter 63 and the key counter 62; a detector 440 for the turning on of the power source; a control CPU 441 provided in the sorter 29; a heater control circuit 442 for the fixing unit 55; an abnormality detecting circuit 434; and a resetting circuit 435 for initializing the control circuit, which are connected to the sequence CPU Q2 and the control CPU Q1.

The control CPU Q1 receives a size cassette size detection signals 426 from the corresponding switches; signals 425 from a key matrix for detecting the key entries from the control panel; a key counter detection signal 430 indicating whether the key counter 62 is mounted; a heater detection signal 431 from the fixing unit 55; a signal 432 from the manual insertion switch 38 etc., and supplies various drive signals to a driver 424 for indicators of the control panel; a manual insertion indicator driver 427; a driver 428 for the paper/cassette indicator; a driver 429 for an exhaust fan motor and a driver 433 for the interruption indicator in response to various input signals.

Figures 1A, 5:
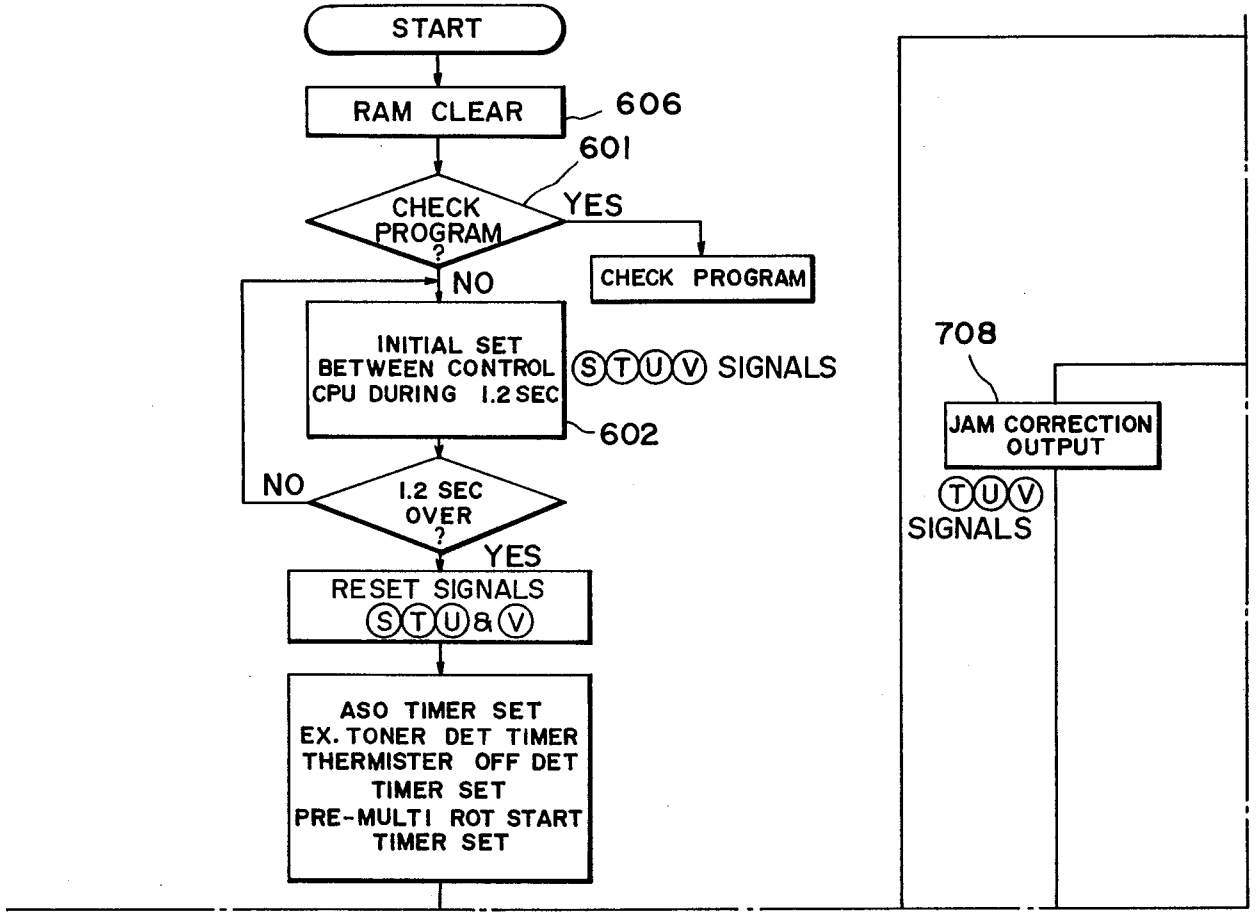
Figures 1B, 5:
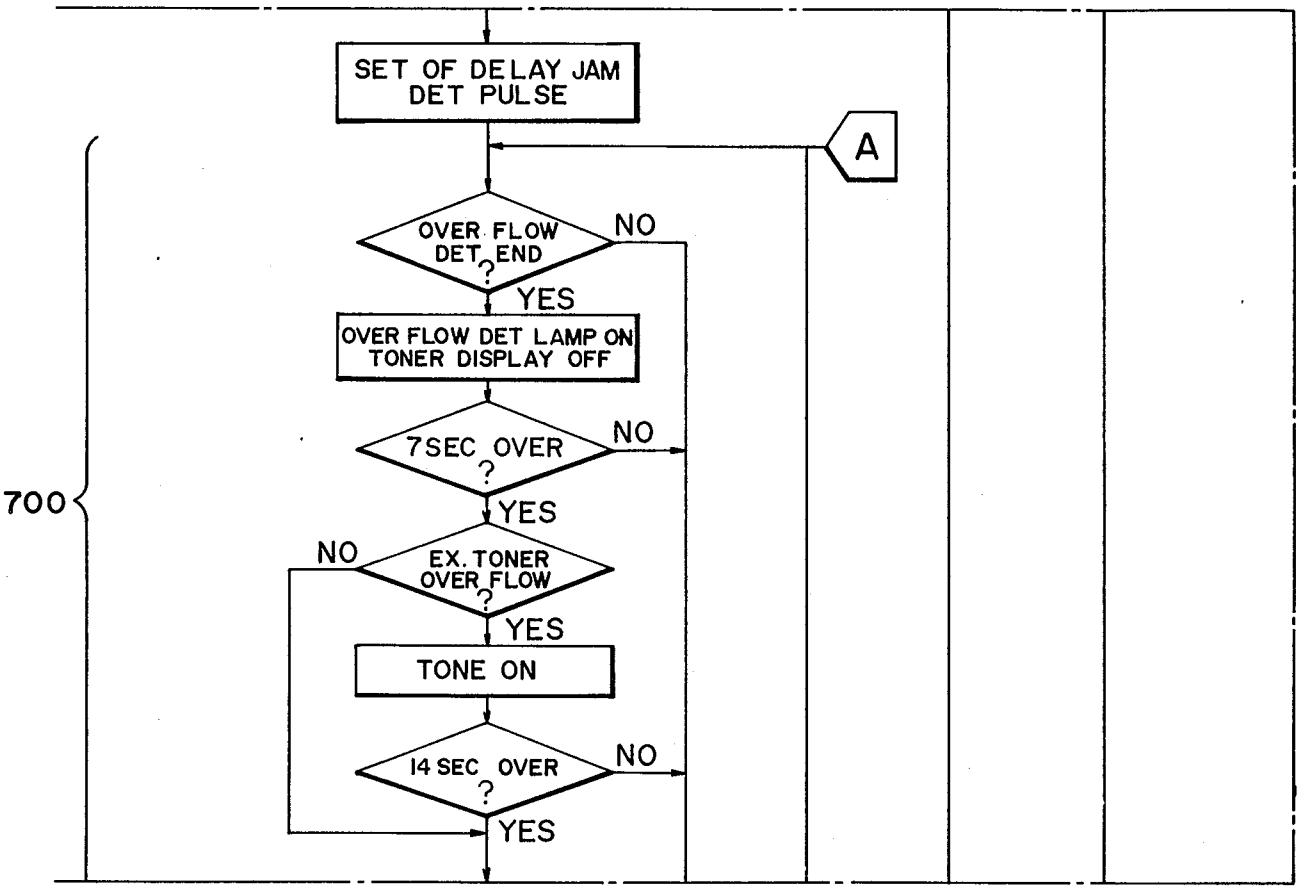
Figures 1C, 5:
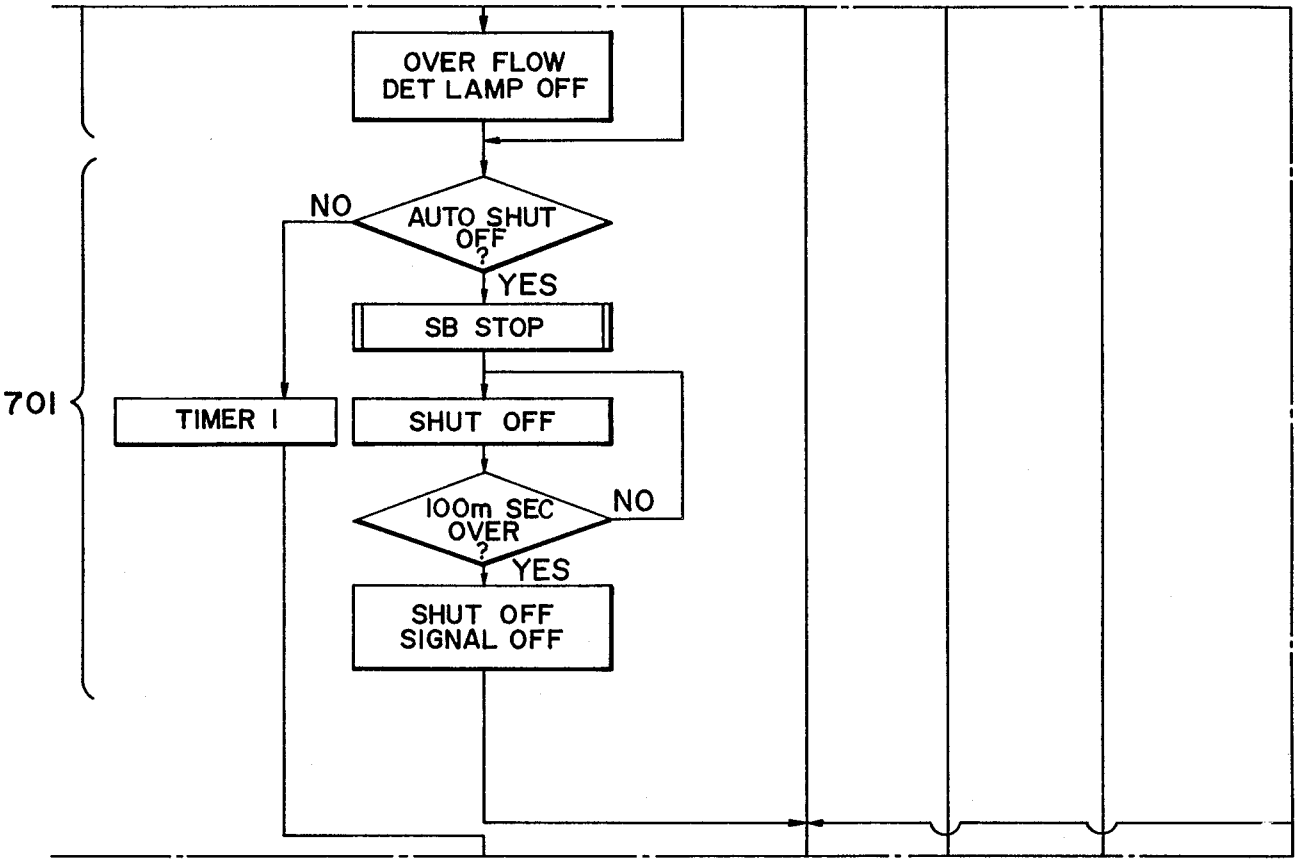
Figures 1F, 5:
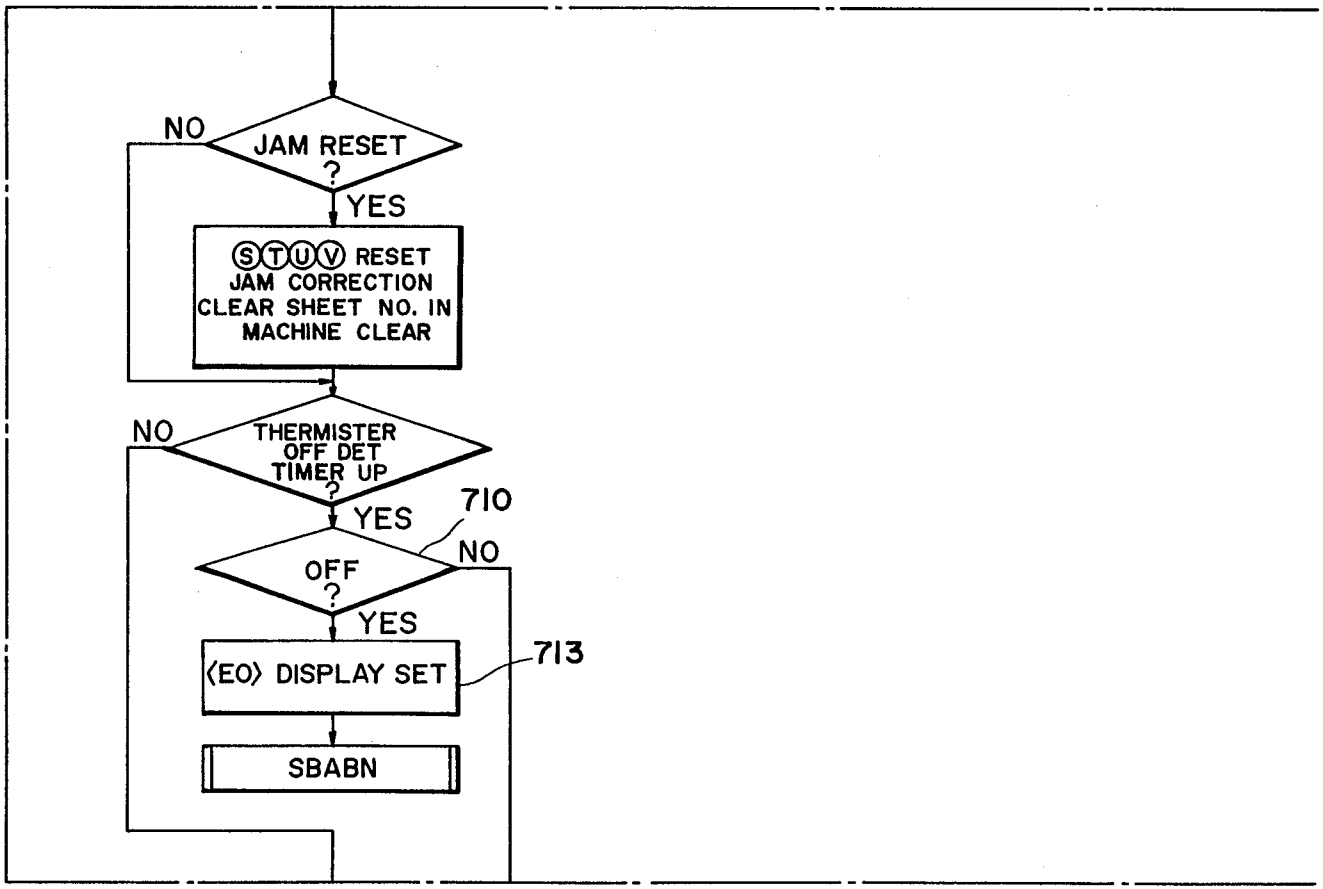
Figures 2A, 5:
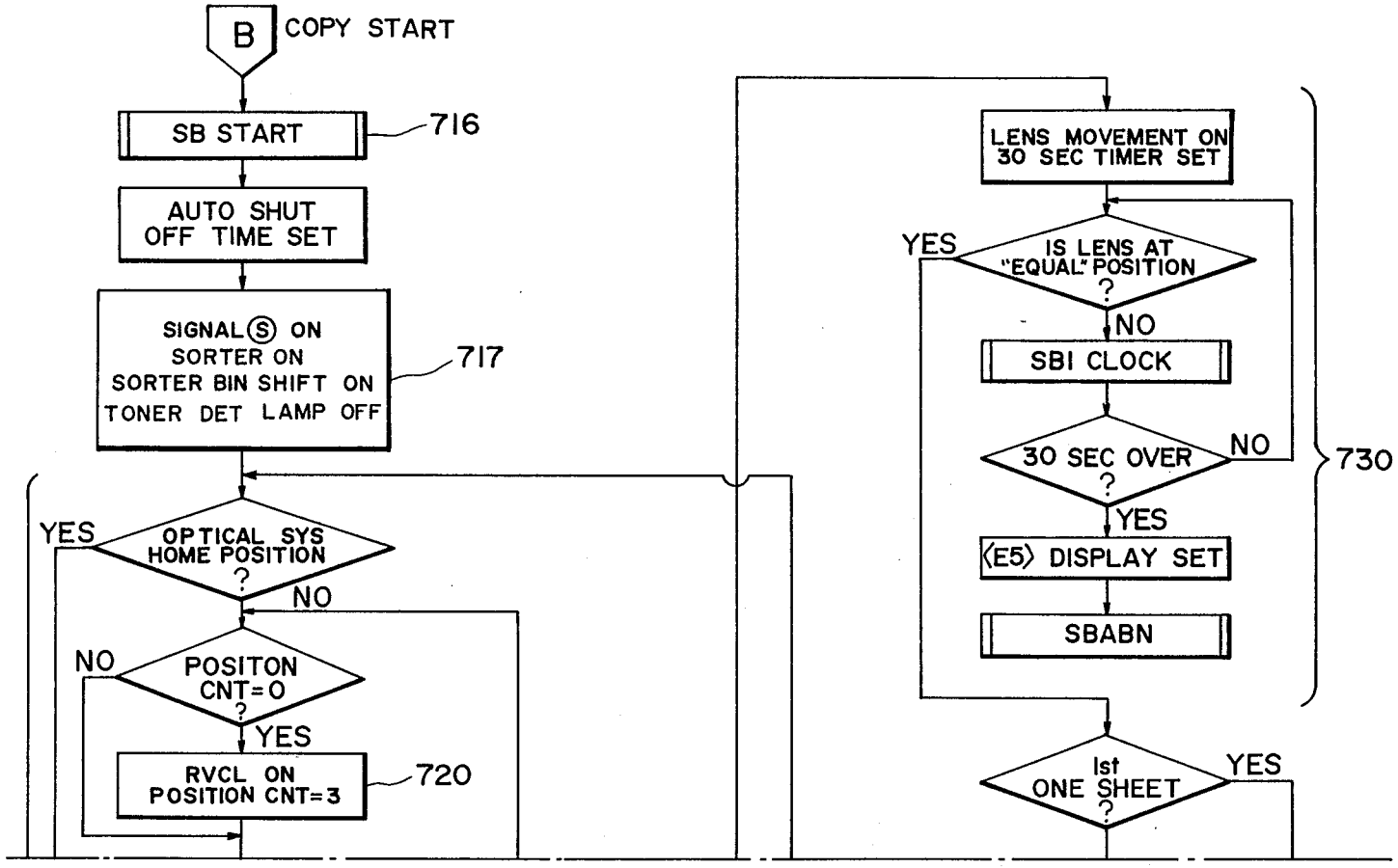
Figures 2B, 5:
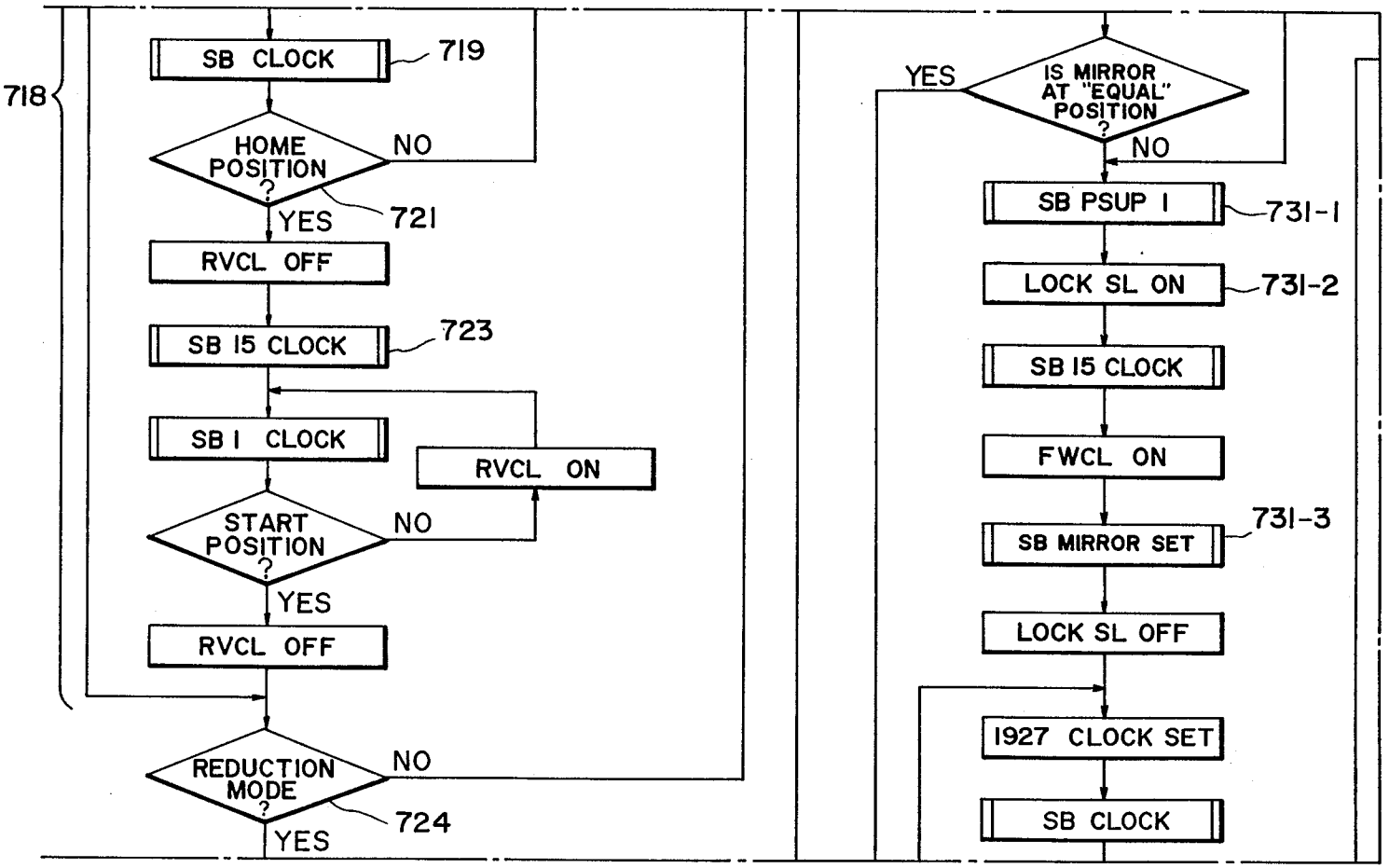
Figures 2C, 5:
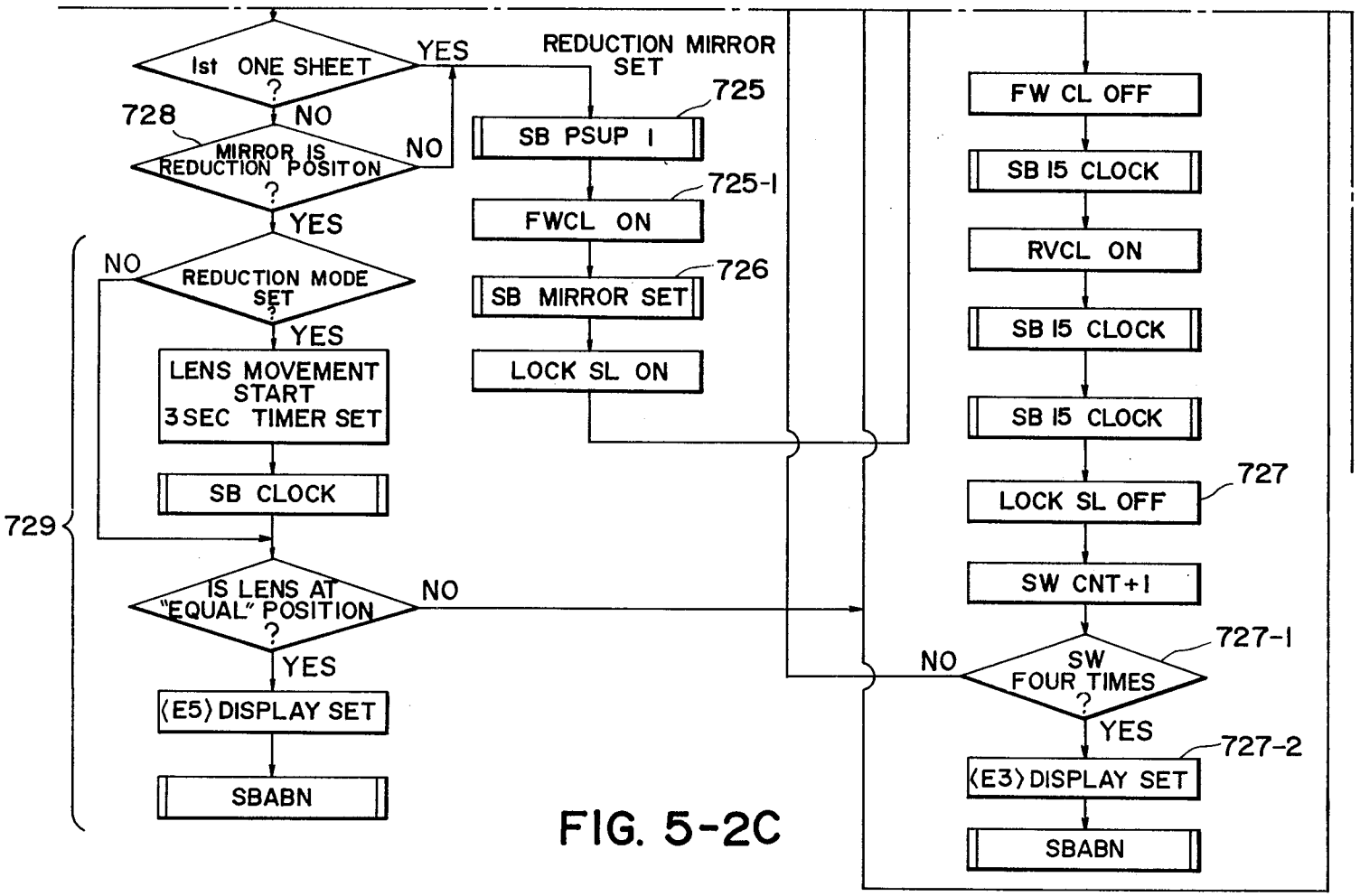
Figures 2D, 5:
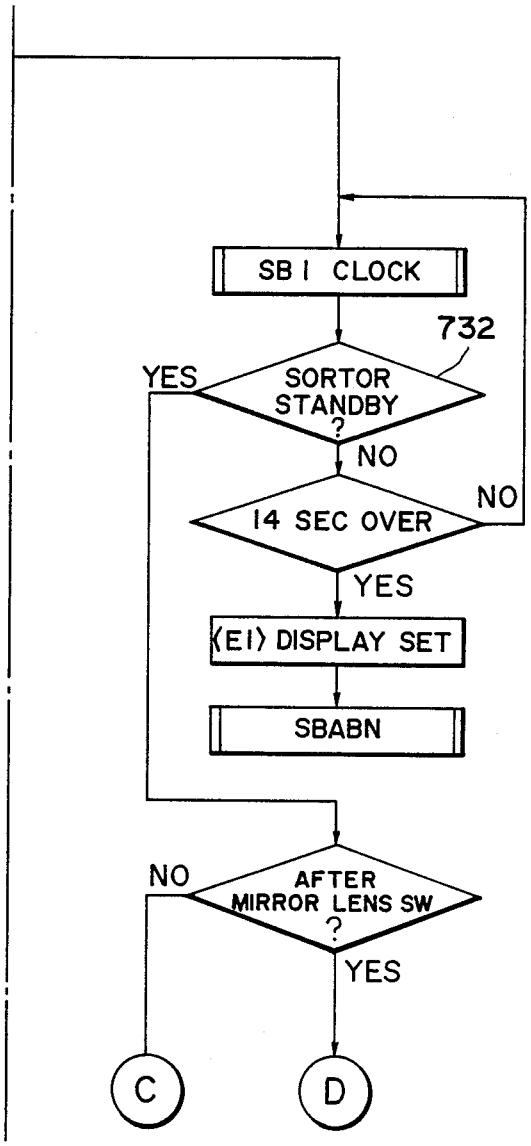
Figures 3A, 5:
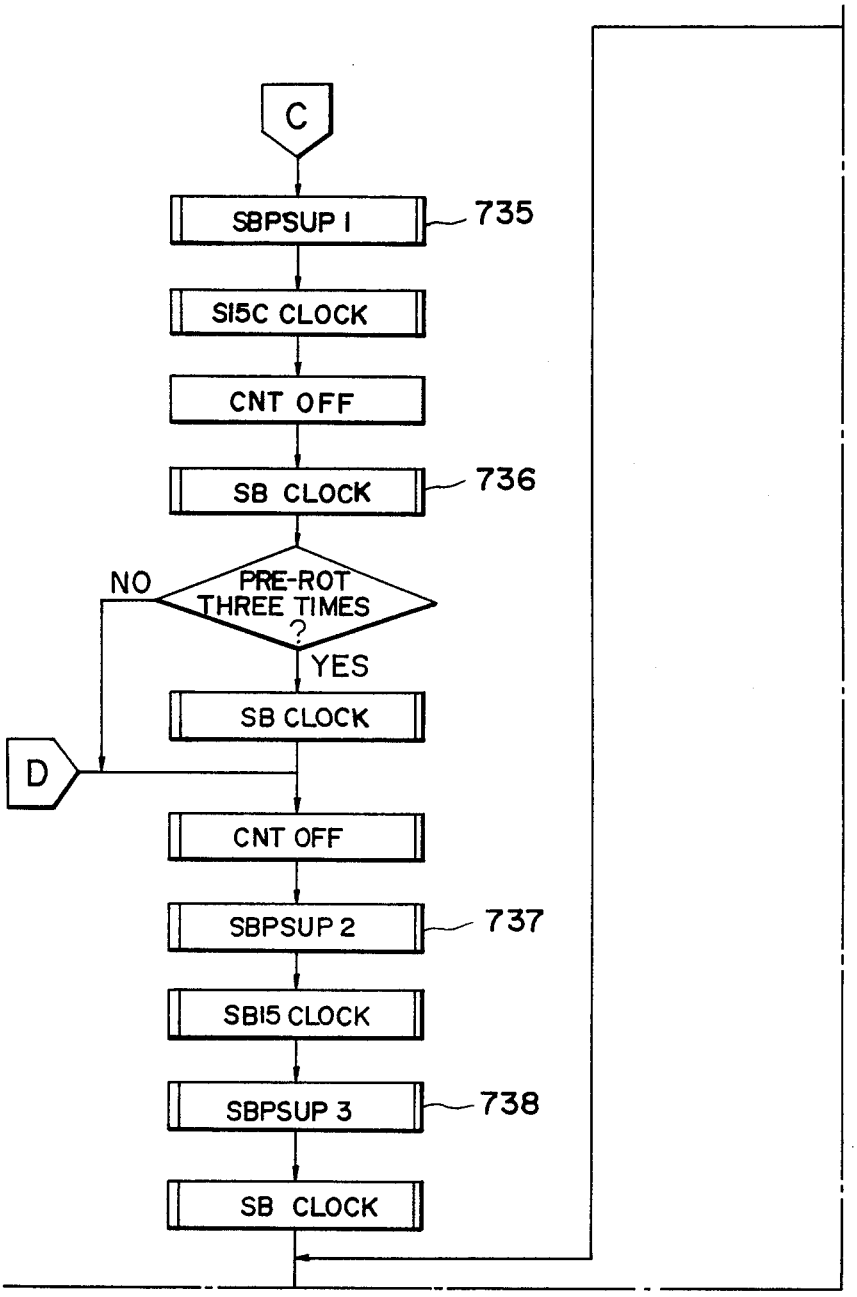
Figures 3B, 5:
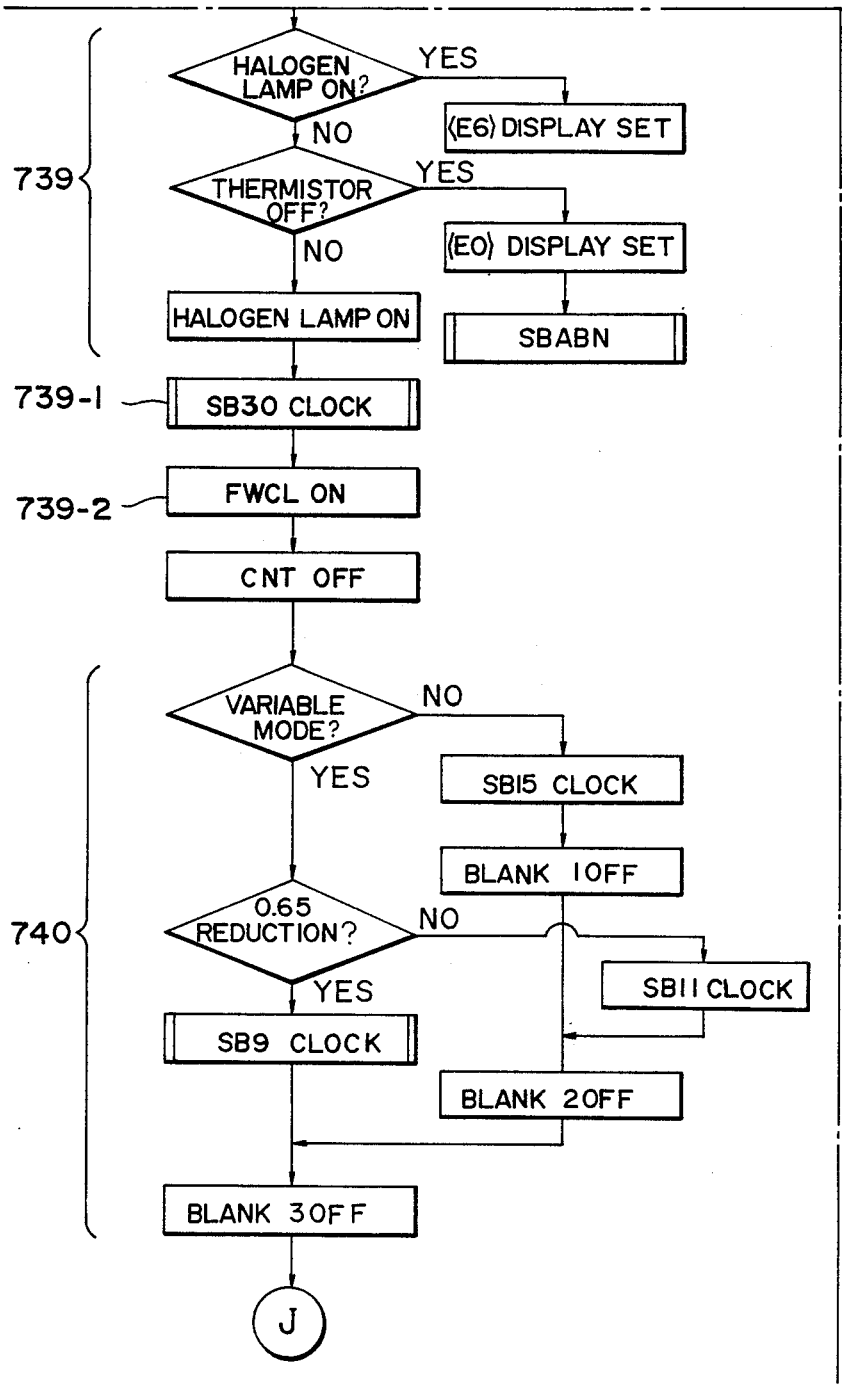
Figures 3C, 5:
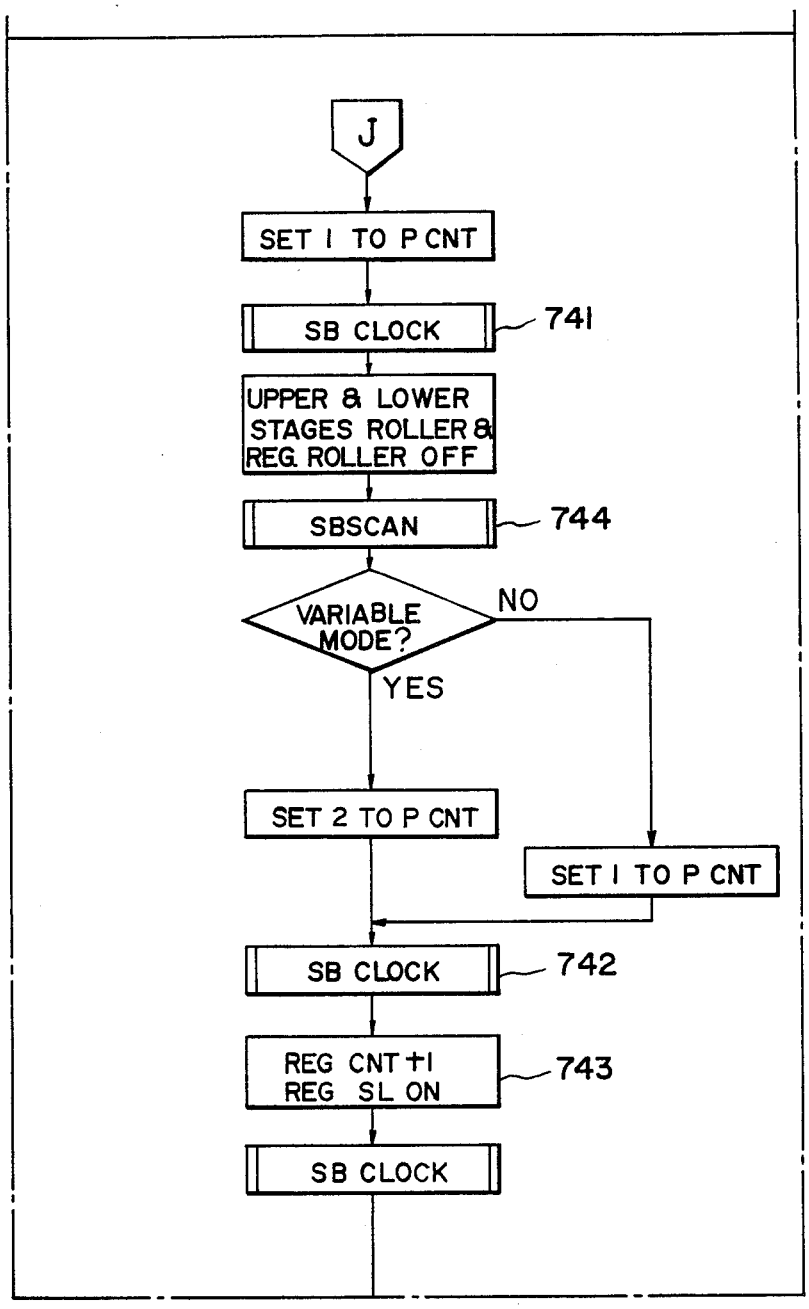
Figures 3D, 5:
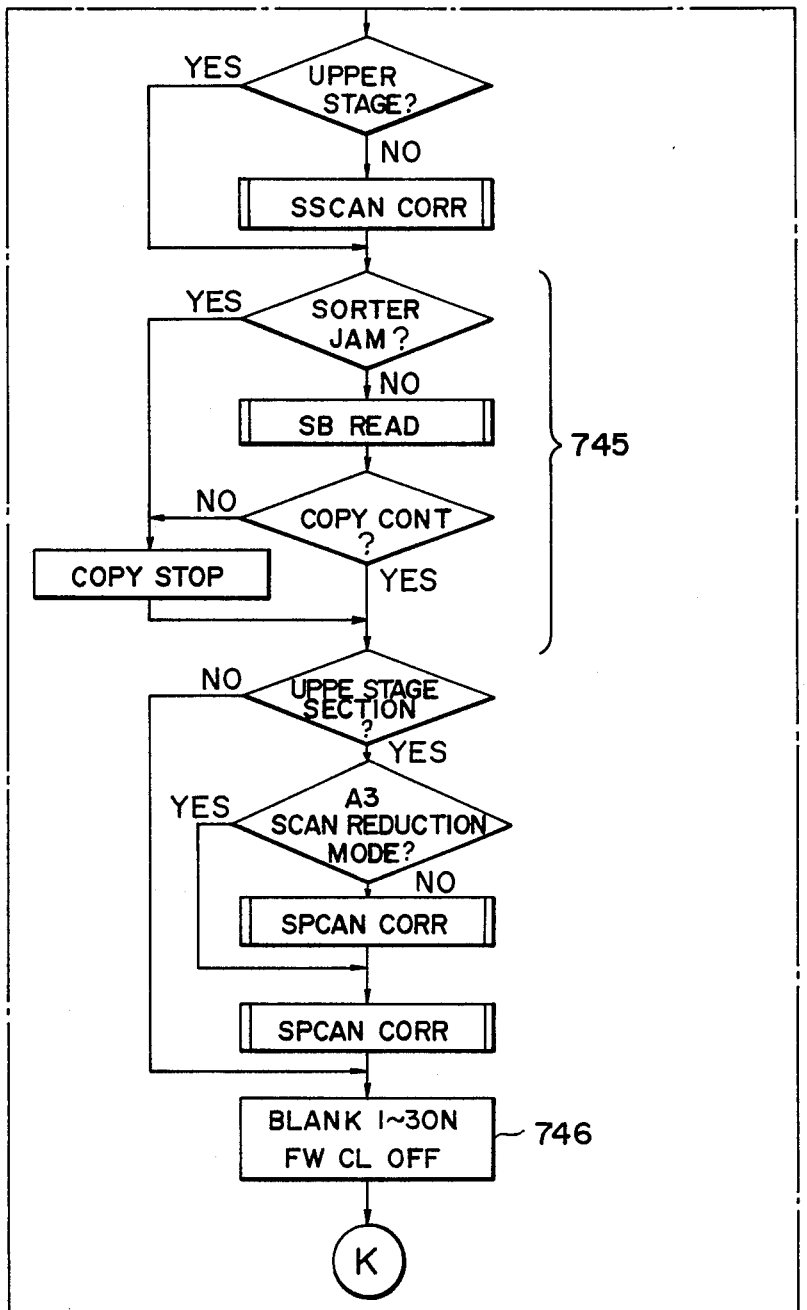
Figures 3E, 5:
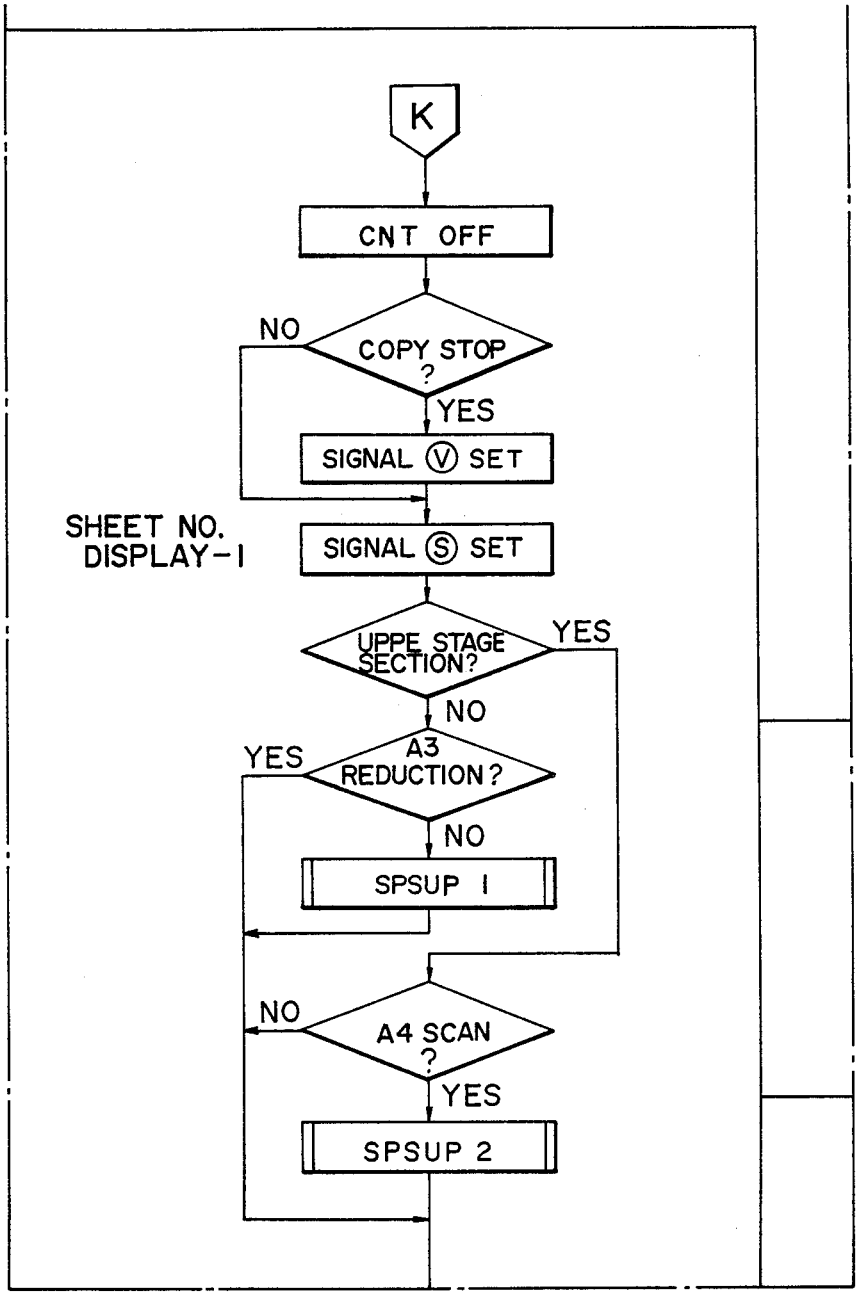
Figures 3F, 5:
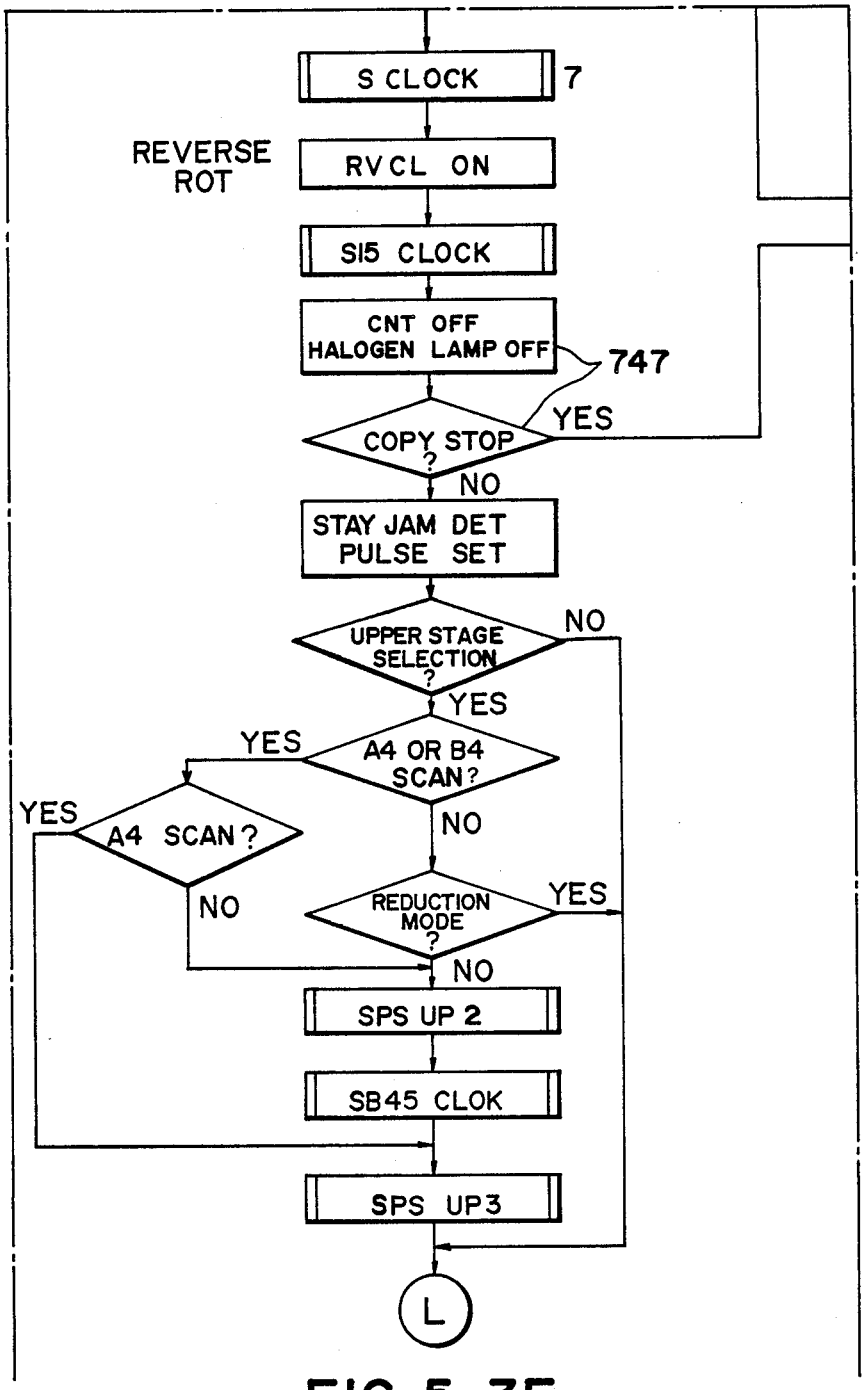
Figures 3G, 5:
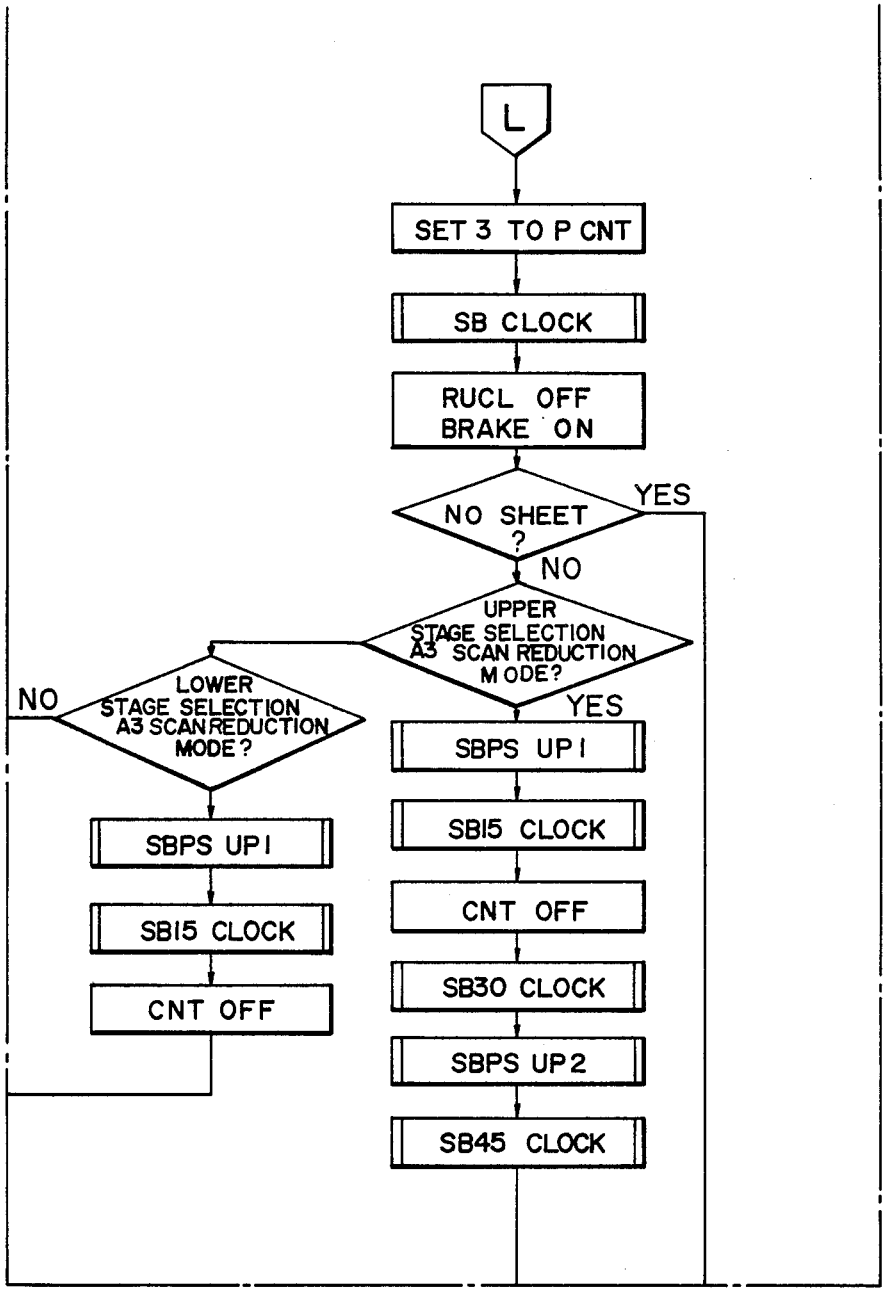
Figures 3H, 5:
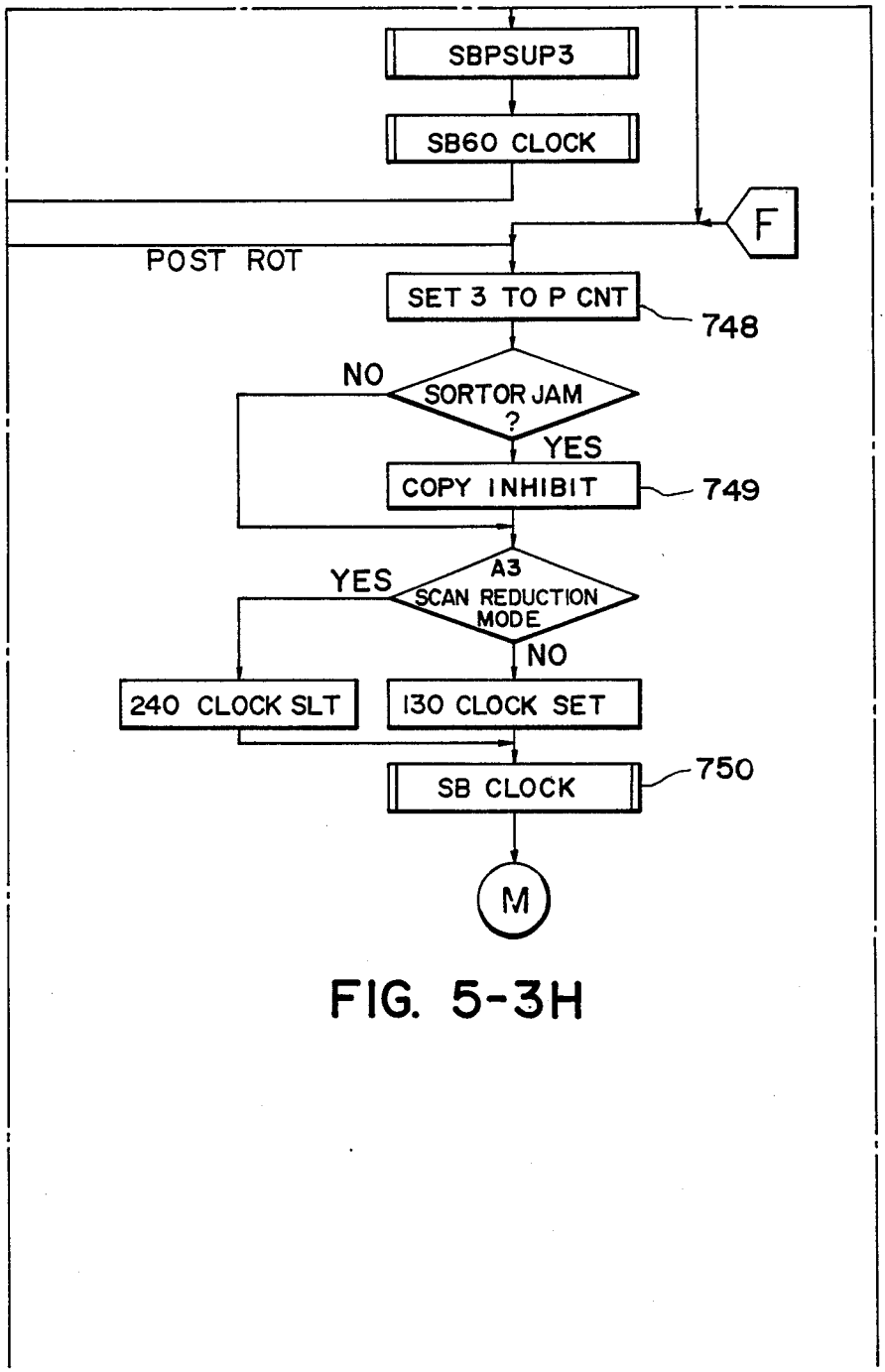
Figures 5, 6, 7, 8, 9, 10, 11, 12, 13, 14, 15, 16, 17, 18, 19, 20, 21, 22, 23, 24, 25, 26, 27, 28, 29, 30, 31:
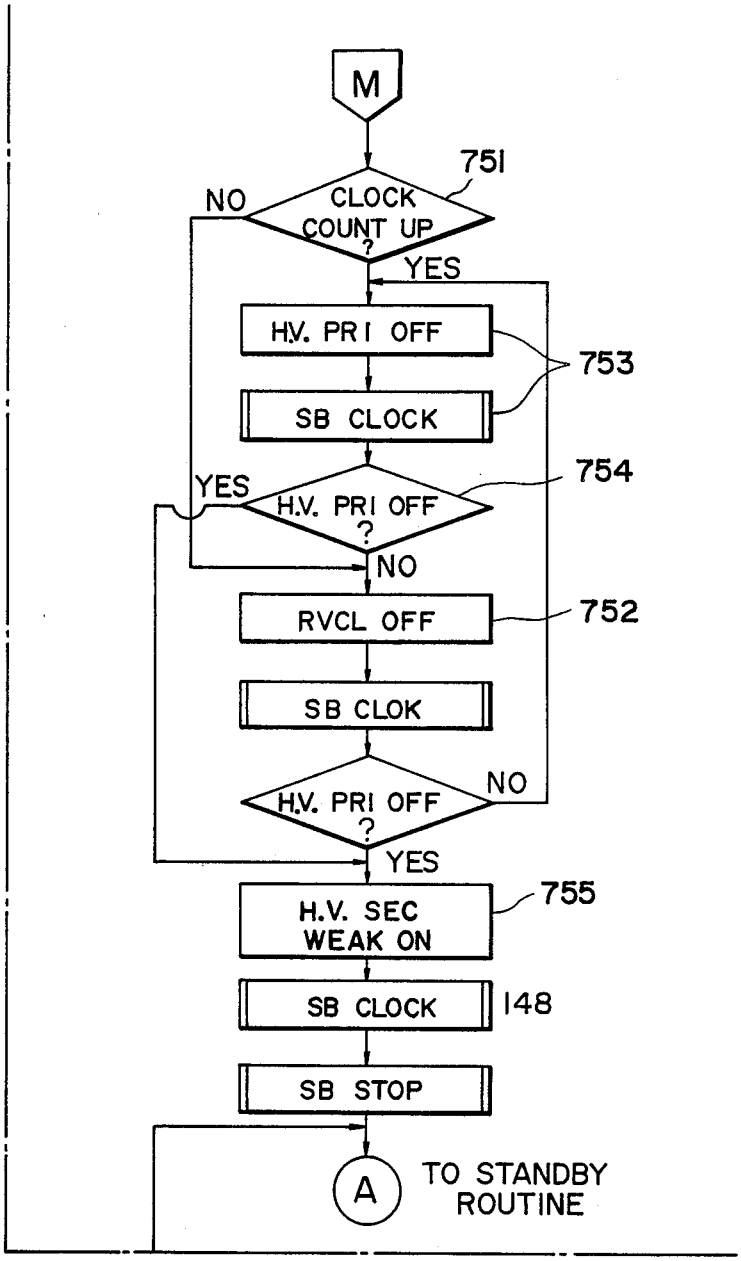
Figures 3, 3J, 5:
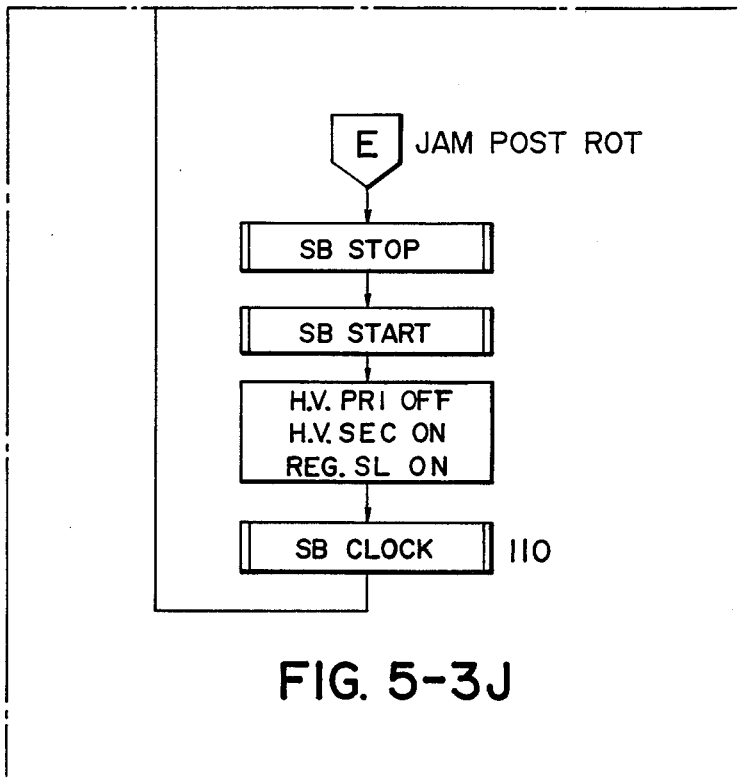
Figures 4A, 5:
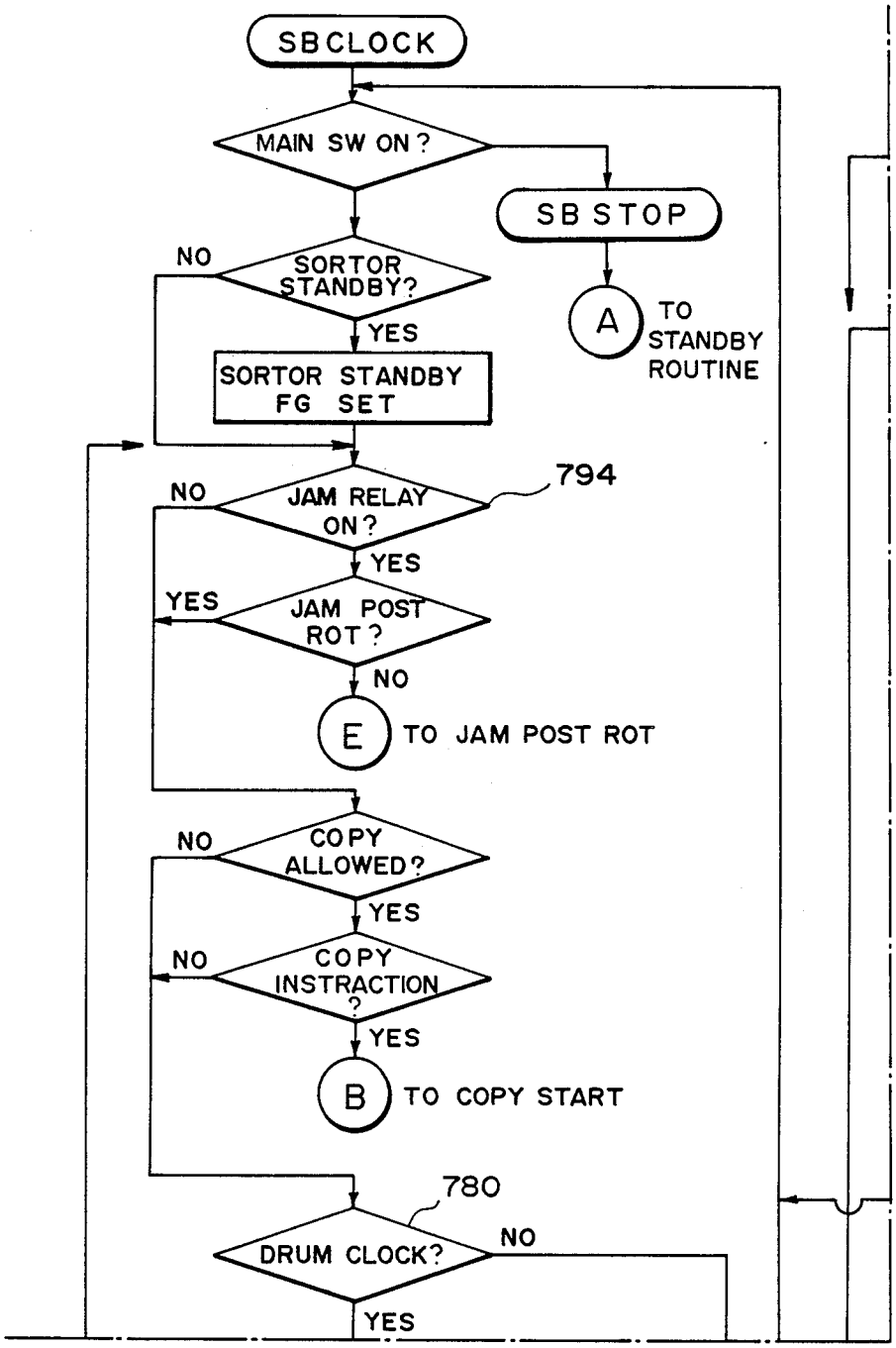
Figures 4B, 5:
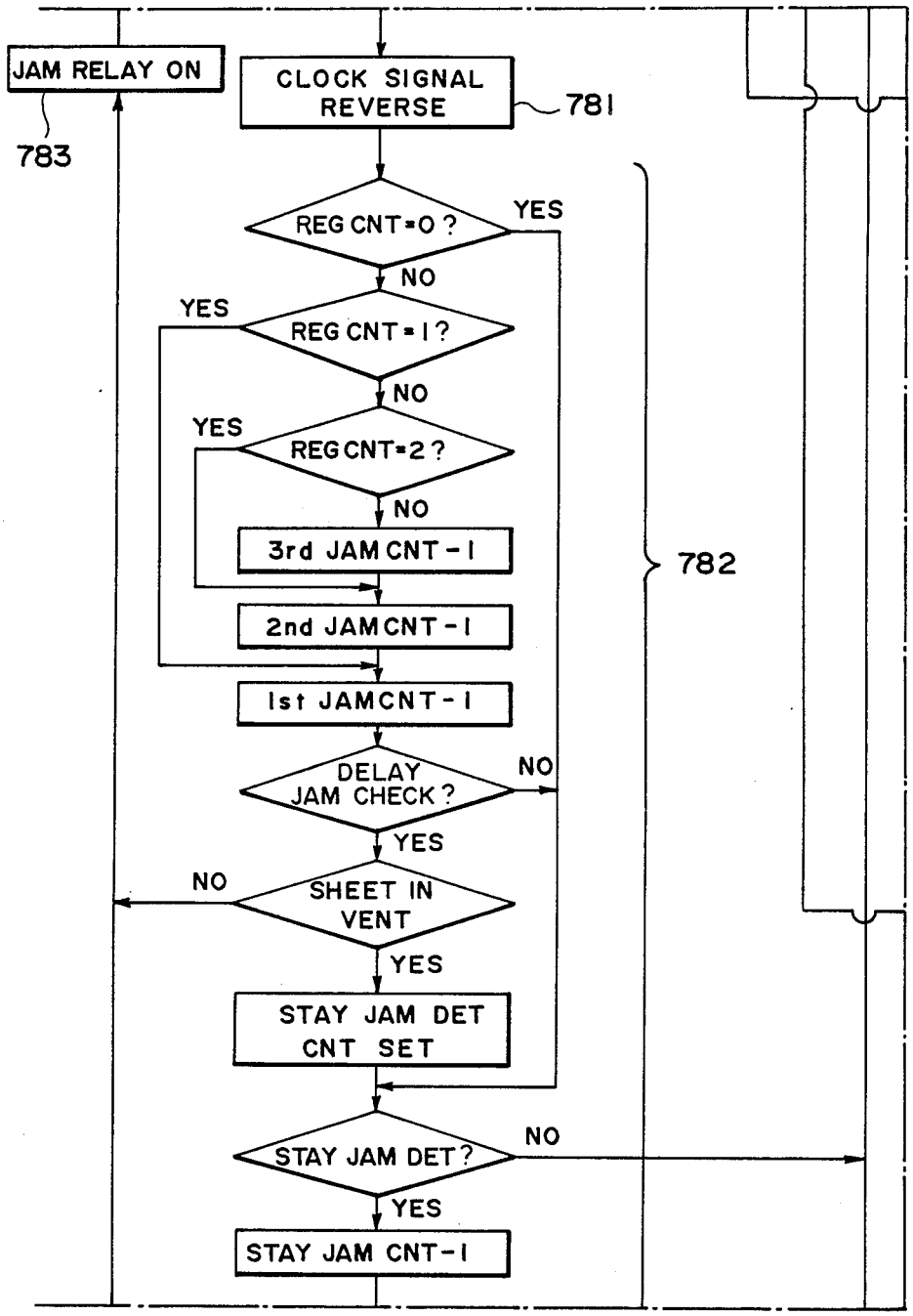
Figures 4C, 5:
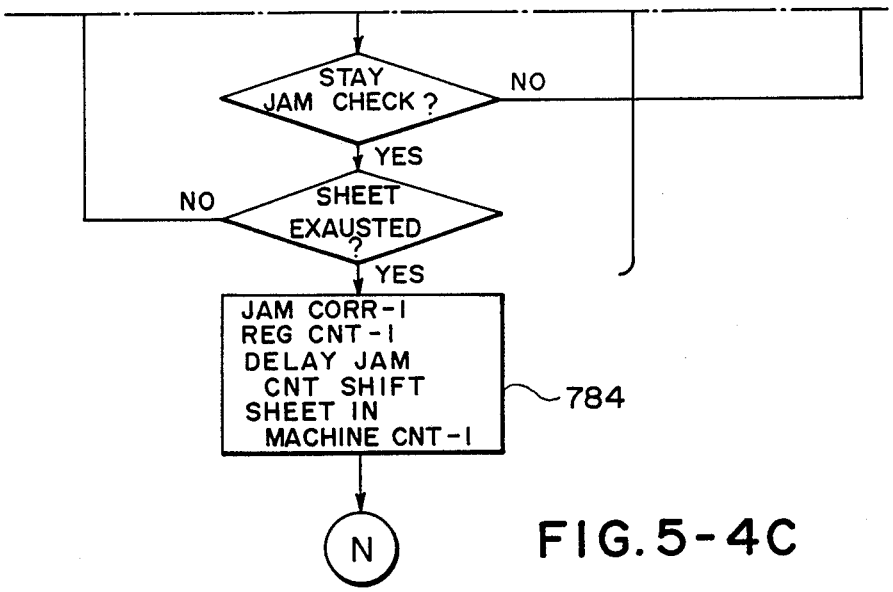
Figures 4, 5:
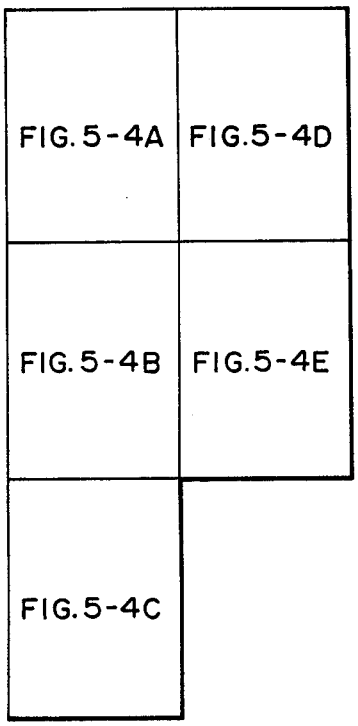

FIGS. 5-1 to 5-7 are flow charts showing the control procedures of the copying apparatus of the present invention, in which those shown in FIGS. 5-1 to 5-4 are the control programs of the sequence CPU Q2 while those shown in FIGS. 5-5 to 5-7 are the control programs for the control CPU Q1.

Upon turning on of the power supply to the apparatus, a step 600 is executed to clear the random access memory, and the program proceeds to the check program routine if a mode for checking the various units of the apparatus is selected in a step 601. If not, the program proceeds to a step 602 for identifying the copying modes available to the apparatus (equal-size copying, reduction copyings with reduction rates of 0.67, 0.78 etc.) from the mode set signal 419 shown in FIG. 4 and initializing the control CPU Q1 accordingly by a 4-bit signal STUV.

Thereafter the information concerning the copy sequence (for example pre-rotation, post-rotation, sheet jamming) is transmitted by said signal STUV from the sequence CPU Q2 to the control CPU Q1, and the information concerning the copy instruction (for example scanning width, cassette selection, copying mode) is transmitted from the control CPU by another 4-bit signal XYZW shown in FIG. 4.

FIG. 5-1 shows so-called stand-by routine in which a step 700 constitutes a routine for detecting the overflow of the used toner in the container 31. According to said routine the overflow detecting lamp 40 is lighted when the main switch 56 is turned on or after the completion of a copying operation, and the overflow is detected when the light to the photosensor is intercepted by the used toner. In such state the corresponding indicator is lighted and the copying operation is disabled.

In consideration of a delay in the response of said photosensor, said detection is effected at about 7 seconds after said lamp is turned on, and, if said overflow state is not present, the lamp 40 is immediately turned off in order to avoid the coagulation of toner by the heat of said lamp. Said detection is however cancelled if the copy start key 104 is actuated during said detection step.

A step 701 constitutes an automatic shut-off routine for turning off the main switch 56 by the control circuit 407 in case no key input signal is received for a determined period. A timer register for measuring said period is reset in response to a key input signal or at the turning off of the main switch.

Now there will be given an explanation on the control procedure in case of a sheet jamming.

There are provided two detecting means respectively for the sheet jamming during the stand-by state and during the copying operation, as will be further explained later. During the stand-by state steps 703, 704 are executed to identify if the sensor 26 or the sensor 59 in the sorter detects sheet jamming, and, if affirmative, a step 706 is executed to energize and latch the jam relay 414.

In this manner the latched state cannot be reset until the detected sheets are completely removed, so that it is possible to prevent re-jamming of a forgotten sheet.

In case of a sheet jamming during a copying operation with the sorter, the copying operation is interrupted with the last recording sheet supplied from the upper or lower cassette 18, 19 before said detection, and the program returns to the stand-by routine A. In such case a step 705 detects the above-mentioned jamming to latch the jam relay 414 in a similar manner.

Said jam relay 414 lights the jam indicator 113 on the control panel. The latched jam state is detected in a step 702 and is transmitted to the control CPU Q1, and at the same time the jam relay 414 is deactivated. However said jam relay 414 remains in the latched state until resetting by a jam reset lever.

In case a sheet jamming is detected during the copying operation, the jam relay 414 is energized and the program returns to the stand-by routine A after a jam post-rotation step to be explained later is completed. Also as a post-treatment for the sheet jamming, a step 707 is executed to display the number of sheets staying in the apparatus on the copy counter 107, for example as "P3". Said number is obtained as the difference between the number of sheets supplied from the upper or lower cassette 18, 19 and those counted by the sheet sensor 26 at the exit, and said display allows the operator to know the exact number of sheets to be removed.

Upon opening a door with an unrepresented jam reset lever, the jam relay 414 is unlatched and the power supply of 24 V is cut off, whereupon the program proceeds to a step 708. All the indicators on the control panel are turned off in this state, and a correction number for sheet count is transmitted to the control CPU Q1. Said correction number is obtained as the difference between the count of completed exposure cycles and the number of sheets counted by the sheet sensor 26 at the exit. The control CPU Q1 thus determines the exact number of remaining copy cycles from the copy count immediately before the sheet jamming and from said correction number.

When the door is closed after the jam handling, the power supply is again turned on and the program proceeds from the step 702 to a step 709, thereby transmitting to the control CPU Q1 that the jam relay 414 is reset. Thereafter steps 703–705 are executed to identify if the aforementioned jam handling process is properly effected, and the foregoing procedure is repeated in case a sheet is detected by the sensor at the exit or in the sorter.

A step 710, which is a routine for detecting a failure in a thermistor used in the temperature control circuit 442 of the fixing heater, detects said failure by the detection signal 420 supplied from a resistance bridge circuit containing said thermistor, about 90 seconds after the main switch 56 is turned on. Said period of 90 seconds is extended by a step 711 during the jam state or while the main switch 56 is turned off.

In this manner said detection is delayed corresponding to the turned-off period of the heater, thereby ensuring exact failure detection. In case a failure is detected, the program branches from the step 710 to a step 713 to display said thermistor failure on the copy indicator 107 for example by a code "E0". Other detected abnormalities are also indicated by similar codes starting with "E", and the copying operation is suspended.

In case the fixing roller is heated while it is stopped in the stand-by mode under a low temperature condition, the roller cannot acquire a uniform temperature. Thus, in case the fixing roller does not reach a determined temperature at a determined period after the main switch 56 is turned on, a step 714 is executed to rotate the fixing roller for about 1 minute, thereby uniformly heating said roller and thus ensuring satisfactory image fixation. Said rotation step is hereinafter called the multiple pre-rotation step.

Said multiple pre-rotation step is interrupted as soon as the fixing roller reaches the determined temperature, and the apparatus goes into the stand-by state after the post-rotation step.

Once a copying operation is executed, said multiple pre-rotation step is not conducted until the next turning on of the power supply to the apparatus.

A step 715 identifies the start of a copying operation in response to the copy instruction from the control CPU Q1, and the program returns to the aforementioned routine A in the absence of said copying instruction.

FIGS. 5-2 and 5-3 show copy routines, in which FIG. 5-2 shows a routine for obtaining a desired image magnification by moving the second scanning mirror 8 and the in-mirror lens 9 respectively to the positions F, H shown in FIG. 1 in the equal-size copying or to the positions G, I in the reduction copying, prior to the start of copying operation.

The subroutine is started at a step 716 for turning on the main motor 3, pre-exposure lamp 11, primary and secondary high voltage sources. A step 717 sends the copy start signal to the sorter 29 and a determined signal to the control CPU Q1 thereby advising the start of the copy sequence.

A step 718 returns the first scanning mirror 8 to an exposure start position.

The home position of the aforementioned shield plate 47 is defined as a position intercepting the photointerrupter 51. If said shield plate 47 is not at the home position, the reversing clutch is activated to displace the first scanning mirror 6 in a direction E. In this state a step 719 is executed to count the pulses generated by said drum clock pulse generator 42, 41, to count the number of shield plates passing through the photointerrupter 49 and to detect that the shield plate 47 is at the home position. A number "3" is set in a position counter in the CPU in a preceding step 720, and the program proceeds to a step 721 upon detection of the front end of a third shield plate 49 passing through the photointerrupter 49 or upon detection that the shield plate 47 is at the home position. The foregoing procedure is repeated if the shield plate 47 is not yet at the home position in the step 721. If the shield plate 47 is already at the home position, the reversing clutch is once turned off, then a step 723 is executed to count 15 drum clock pulses, and the reversing clutch is again activated until the start position is reached in which the photointerrupter is intercepted by the shield plate 46. Said delay for 15 drum clock pulses allows to stop the first scanning mirror 6 at the start position without shock.

Now there will be explained a setting control for the second scanning mirror 8 and the in-mirror lens 9, with reference to the time chart shown in FIG. 6-2, in which "EQUAL-RED" indicates a case of changing the copying mode from the equal-size copying to the reduction copying, and "RED-EQUAL" indicates a case of changing the copying mode from the reduction copying to the equal-size copying.

In case a reduction copying mode is identified in a step 724, a step 728 is executed to identify if the second scanning mirror 8 is at a position G for the reduction copying mode, where the shield plate 48 intercepts the photointerrupter 52. If the mirror is not at said position, or for a first copying operation after the memory resetting, the program proceeds to a step 725 for switching the position of the second scanning mirror etc.

In said step 725 the feed roller 20 or 21 of the selected cassette 18 or 19 is rotated by a half turn to advance a recording sheet therefrom. A step 725-1 activates the forward clutch, and a step 726, constituting a mirror setting subroutine, moves the first and second scanning mirror carriages to a determined position for disconnecting said carriages and energizes the unlocking solenoid 65 to disconnect the second scanning mirror 8 from the scanning system by a lever connected to said solenoid. The first scanning mirror 6 and the corresponding carriage 43 continues the scanning operation corresponding to A3 size, and, after it is reversed, the unlocking solenoid 65 is turned off at a step 727, whereby the second scanning mirror carriage, in stopped state, is connected to the first scanning mirror carriage corresponding to a reduction copying mode. Thereafter the first scanning mirror carriage 43 is returned to the start position through the subroutine 718. Then a step 728 is executed to check the position of the second scanning mirror 8 in a manner as explained above. If the mirror position is not changed properly the above-mentioned procedure is repeated. If a step 727-1 detects that said change is not achieved even after three scanning motions, a step 727-2 displays an abnormality by a code "E3" on the copy indicator 107 and interrupts the function of the apparatus.

After the second scanning mirror 8 is switched to a position for reduction copying, the program proceeds to a step 729 for moving the in-mirror lens 9 in a direction I for the reduction copying. In this procedure the lens drive motor 66 is activated for a determined period, and the lens movement is identified complete if the switch 53 detects that the in-mirror lens 9 is not at the position for equal-size copying. If the lens is still detected at the position H for equal-size copying, a code "E5" for an abnormality in lens is displayed on the copy count indicator 107 and the function of the apparatus is suspended.

On the other hand, in case of setting to the equal-size copying mode, the program branches from the step 724 to a step 730 to identify by the switch 53 that the in-mirror lens 9 is at the position H for the equal-size copying, and, if not, to activate the lens driving motor until the lens is detected by the switch 53.

Simultaneously with said activation a timer is started, and, if the lens displacement is not completed within a determined time, a code "E5" for abnormality in lens displacement is displayed on the copy count indicator 107 and the function of the apparatus is suspended. Subsequently started is a routine for changing the position of the second scanning mirror 8. A scanning motion corresponding to the A3 size for mirror position change as explained above is conducted for a first copying operation after the memory resetting or in case the shield plate 48 does not intercepts the photointerrupter 50, indicating that the second scanning mirror 8 is not at the position F for equal-size copying.

Then steps 731-1 and 731-2 feed a recording sheet as explained before, simultaneously energize the unlocking solenoid 64 to disconnect the second scanning mirror carriage from the first scanning mirror carriage by a lever connected to said solenoid and initiate the scanning motion of the first scanning mirror carriage while the second scanning mirror 8 is stopped at the position G. A step 731-3 constituting a subroutine for mirror setting continues the scanning motion to a determined position by counting the drum clock pulses and then deactivating the unlocking solenoid 64, whereby the second scanning mirror carriage is connected at a position corresponding to the equal-size copying to the first scanning mirror carriage 43. After reversing of the scanning motion, the first scanning mirror carriage 43 is returned to the start position.

As explained in the foregoing, in the present embodiment, the displacement of the second mirror 8 from the position G to F for selecting the equal-size copying mode is effected after the displacement of the in-mirror lens 9 from the position I to H is confirmed, in order to avoid eventual mutual contact and any demage resulting from any abnormality in the second scanning mirror 8 and/or in-mirror lens 9. In selecting the reduction copying mode, the above-mentioned displacements are effected in inverse order.

Also it is easily possible to simultaneously displace the lens and mirror in order to reduce the time required for mode switching.

The function and object of the unlocking solenoids 64, 65 used for the position change of the second scanning mirror 8 are already explained in the foregoing, but it is also possible to simultaneously drive said solenoids. For example, the position change to the reduction copying mode is achieved by the function of the unlocking solenoid 65 as already explained before, but the solenoid 64 may also be controlled in the same manner, without causing any effect on the function of the solenoid 65. For this reason, in the present embodiment, a common control signal is used for both solenoids 65 and 64 in order to simplify the drive circuit and the control signals.

Further, although the present embodiment is limited to the equal-size copying mode and the reduction copying modes, the position setting for the lens and mirror can be similarly achieved also for an enlarged copying mode if such mode is provided in the copying apparatus.

When the second scanning mirror 8 and the in-mirror lens 9 are positioned corresponding to a de-copying mode or after said mirror and lens arrive at such positions through above-described position switching control, a step 732 is executed to count the drum clock pulses until the sorter completes the bin shifting and enters the stand-by state.

In case such waiting state exceeds a determined period, a code "E1" indicating an abnormality in the sorter is displayed on the copy count indicator 107, and the function of the apparatus is suspended.

As soon as the sorter 29 enters the stand-by state, the program proceeds to a branch D or C in FIG. 5-3, respectively when the position change of said mirror and lens is conducted or not.

FIG. 5-3 shows the copy sequence control procedure shown by the time chart in FIG. 6-1.

In case said second scanning mirror 8 and in-mirror 9 are positioned corresponding to the desired copying mode and do not require a setting sequence, a step 735 is executed to release the feed roller drive signal and the key counter drive signal.

Said key counter drive signal, of a duration of ca. 100 ms, also stepwise advances a large-size counter or a small-size counter according to the presence or absence of a large-size signal supplied from the control CPU Q1 to the counter control driver 439 in response to the selected size of the recording sheet.

A step 736 counts the pulses of a number corresponding to a half rotation of the drum 2 to erase the retentive charge and memory on the drum 2 by means of chargers, pre-exposure lamp and blank exposure lamp, thereby obtaining a desired photosensitivity. This step is hereinafter called the pre-rotation step.

It is also possible to rotate the drum 3 turns in said pre-rotation step by suitably selecting the mode set signal 419, thereby securing a high photosensitivity of the drum 2.

In the following explained is the paper feeding operation.

In the present embodiment, in order to compensate the difference in distance from the upper cassette 18 or lower cassette 19 to the registering roller 22, the upper feed roller 20 is rotated two turns while the lower feed roller 21 is rotated one turn at the paper feeding operation. The paper feed solenoid 67, 68 for activating semicircular rollers are activated as shown in the time chart in FIG. 6. In case the upper cassette is selected, a step 737, constituting a subroutine PSUP2, turns off the upper solenoid to rotate the upper feed roller 20 further by a half turn, and a step 738, constituting a subroutine PSUP3 again energizes the solenoid to rotate said roller further by a half turn. As the consequence, the lower feed roller 21 is stopped after a half turn while the upper feed roller 20 is stopped after one and half turns.

A step 739, constituting a subroutine for lighting the exposure halogen lamp 7, at first confirms that said light is turned off, and, if not, displays a code "E6" on the copy count indicator 107 and suspends the function of the apparatus. Also the failure of the thermistor during the copying operation can be checked by the detection signal 420. In this manner it is rendered possible to prevent an abnormally high temperature and a damage resulting therefrom caused by the abnormal continuous lighting of the exposure lamp 7 or by the failure of the thermistor in the course of a continuous copying operation.

A step 739-1 counts a period of about 250 ms after the lamp 7 is lighted, and thereafter a step 739-2 is executed to activate the forward clutch, thereby initiating the exposure and scanning of the original document.

A step 740 constitutes a subroutine for blank exposure for avoiding the unnecessary deposition of toner in the non-imaging area appearing in the reduction copying mode or in the copying of B-series originals.

In this state the exposure lamp is lighted and has started the scanning operation in the pre-scanning path from the home position. Since said lamp 7 is still in the low-intensity state immediately after lighting and illuminates also the rear side of a cover on said pre-running path, the charge on the drum 2 is not completely dissipated to cause toner deposition in said non-imaging area.

Consequently it is necessary to light the blank exposure lamp 15, in order to eliminate said charge until the exposure lamp 7 reaches the front end of the image. A step 740 turns off the blank exposure lamp 15 after the optical system is advanced by the above-mentioned pre-running distance. In response to the difference in the scanning speed depending on the image reduction rate, the blank exposure lamp 15 is turned off after counting 15 drum clock pulses in the equal-size copying mode, or 9 clock pulses in the reduction copying for a reduction rate of 0.65 or 11 clocks for a reduction rate 0.78.

In this manner the charge is completely eliminated over the entire pre-running length regardless of the image magnification, thereby avoiding the unnecessary toner deposition.

In addition, said blank exposure is conducted when the control CPU Q1 selects a B-sized cassette (including B4, B5, A4R and B5R sizes) to avoid the unnecessary toner deposition on the non-imaging area of the drum. Such blank exposure is hereinafter referred to as B-size blank exposure operation.

A step 741 detects a timing when the shield plate 45 starts to intercept the photointerrupter 49 to deactivate the paper feed solenoid 67 or 68, whereby the paper feed roller 20 or 21 is further rotated by a half turn to push the sheet toward the registering roller 22.

On the other hand a step 742 starts the rotation of the registering roller 22 when the photointerrupter 49 start to be intercepted by the first shield plate in the equal-size copying mode, or, in the reduction copying mode, when the interception by the second shield plate is terminated. Consequently the amount of sheet loop can be adjusted by the position of the shield plates 44 and 45.

Pulses of a determined number are counted from the start of rotation of said registering roller 22 at which the front end of a recording sheet supplied from the upper or lower cassette has arrived. At the end of said counting the sensor identifies if the sheet has arrived at the exit, and, if not, a sheet jamming is identified in the path between the registering roller 22 and the sensor 26. Such jamming is hereinafter called the delayed jamming.

In a continuous copying operation, the above-mentioned delayed jamming is checked for plural sheets by stepwise increasing the register counter at each sheet passage in a step 743, and the delayed jamming counter is controlled by said count. Said register counter is stepwise reduced at each sheet ejection.

Also the above-mentioned registering signal start the counting of pulses of a number corresponding to the scanning width of the original, and a step 745 is executed immediately before the optical system is reversed to check the completion of copying operation and the sheet jamming in the sorter. In case the copying operation is to be continued, the feeding of a succeeding recording sheet is initiated according to the selected copying mode.

Then a step 746 starts the blank exposure again, terminates the scanning, resets the signal S indicating that a copying operation is in progress, and instructs the control CPU Q1 a decrement of the control CPU Q1.

In case the copying operation is stopped, the signal V is simultaneously set to inform the control CPU Q1 of the timing for starting the post-rotation.

Then a step 747 turns off the exposure lamp 7, reverses the optical system and feeds a sheet in case the copying operation is to be continued, and the program returns to the step 739 to repeat the foregoing procedure.

Now reference is made to a branch F in FIG. 5-3 showing a program for controlling the post-rotation.

The post-rotation routine, for ejecting the recording sheet after the completion of copying cycle and simultaneously eliminating the charge remaining on the photosensitive drum 2 to stabilize the potential thereon, is generally initiated simultaneously with the completion of original exposure. In a step 748 a number "3" is set in the position counter to return the optical system until the photointerrupter 49 detects the third shield plate 46. Then a step 750, constituting a subroutine CLOCK, rotates the drum corresponding to a determined number of pulses in order to develop the exposed area of the drum 2 and to transfer the developed image onto the recording sheet. This step is hereinafter referred to as post-rotation 1.

Said subroutine branches to a step 752 to turn off the reversing clutch in case the shield plate is detected or in case the optical system reaches the start position in the step 751. Also said subroutine proceeds to a step 753 at the end of said post-rotation 1 to turn off the primary charger and to eliminate the charge in the area of image transfer by means only of the secondary charger. This step is hereinafter referred to as post-rotation 2.

Thereafter the power supply to said secondary charger is weakened in order to prevent the formation of a negative potential on the drum surface and to avoid uneven charge elimination, and a step 755 is executed to count a determined number of pulses. These constitute a step called the post-rotation 3. Then all the loads are turned off and the program returns to the stand-by routine A in FIG. 5-1.

Now there will be given an explanation on the subroutine CLOCK, for counting the drum clock pulses, for counting the sheets in a delayed or stay jamming, and for detecting the position of the optical system.

In response to drum clock pulses 403 supplied to the interruption port of the sequence CPU Q2 shown in FIG. 4, a step 780 in FIG. 5-4 detects the trailing end of each pulse and a step 781 counts said pulses. A step 782 constitutes a subroutine for detecting the aforementioned delayed jamming and operates three counters at maximum for each recording sheet staying in the apparatus.

At first a first-sheet jam counter completes counting. If the sensor 26 has not detected the sheet, a delayed jamming is identified and the program proceeds to a step 783 for energizing the jam relay 414.

In case such delayed jamming is not found, a procedure for inspecting a stay jamming is immediately started. In the present embodiment the sheet sizes are divided into two groups (for example those shorter or longer than the longer side of A4 size) and the time required for passing the fixing unit 55 can be checked for each group. Thus, if the sensor 26 has not detected the ejection of a sheet after the pulses of a number corresponding to the sheet size are counted, a stay jamming in the fixing unit is identified and the program proceeds to a step 783 to energize the jam relay 414.

Neither the delayed jamming nor the stay jamming is detected in the above-described procedure, the program proceeds to a step 784 to stepwise reduce the sheet counter indicating the number of sheets in the apparatus, register counter and jam correction number. Then the contents of the third-sheet jam counter and of the second-sheet jam counter are respectively transferred to the second-sheet jam counter and the first-sheet jam counter, and the jam detection for the succeeding sheet is effected in the above-described manner.

A step 785 constitutes a routine for advising the sorter that the ejection of the final sheet is completed. In case the copy start key is actuated for instructing a succeeding copying operation during the post-rotation step, the sorter-on signal is turned off for a determined period after the ejection of the final sheet in the preceding copying operation and is then turned on again, in order to separate two copying operations.

Consequently the sorter can correctly initialize the storage bins even when the copy start key is actuated during the post-rotation step of the preceding copying operation.

Also in order to prevent damage resulting from erroneous function of the optical system, a step 786 is executed to count pulses from the energization of the forward or reversing clutch, and, if a signal is not generated from the photointerrupter 51 or 49, a code "E2" indicating an abnormality in the optical system is displayed on the copy count indicator 107 and the function of the apparatus is suspended.

Pulses of a determined number set before entering the subroutine CLOCK are counted one by one at each passing of the step 787, and the program returns to the start of the subroutine if said counting is not completed. On the other hand, when said counting is completed, the program returns to the main routine through a step 788.

In case an interruption by a drum clock edge is not detected in a step 780, the program proceeds to a step 789 for detecting the position of the optical system and checking the abnormality in the drum clock pulses.

At first a step 790 is executed to identify by the photointerrupter 51 if the optical system is at the home position, and, if affirmative, the program proceeds to a step 788 to terminate the subroutine and deactivate the reversing clutch. Also in case the position counter set before entering said subroutine is not "0" in a step 791, the program branches at a step 792 according to whether the photointerrupter 49 detects the front ends or rear ends of the shield plates 44, 45, 46. In either case the position counter is stepwise decreased at each edge detection, and the subroutine is terminated at the step 788 when the position counter reaches zero. On the other hand, in case said edge is not detected, the program returns to the start of the subroutine and repeats the above-mentioned procedure through the step 789 until an interruption by the drum clock edge is found. If such state continues for about 2.5 seconds, i.e. said interruption is absent for 2.5 seconds or more, a code "E7" indicating an abnormality in the drum clock pulse is displayed on the copy count indicator 107, and the function of the apparatus is suspended.

In case of a sheet jamming, the jam relay 414 is energized in the step 783 as explained before. In case a step 794 identifies that the jam relay 414 is activated, the program enters the jam post-rotation routine shown by E in FIG. 5-3.

The jam post-rotation routine promptly terminates sheet feeding, effects the charge elimination same as in the post-rotation-3 step explained above and returns the semi-circular paper feed rollers to the determined positions.

In the present embodiment, therefore, the jam post-rotation is conducted for a period required for resetting said paper feed rollers to the determined positions regardless of the timing of such jamming.

FIGS. 5-5 to 5-7 are flow charts showing the control programs of the control CPU Q1.

The control CPU Q1 principally controls the dynamic displays on the 7-segment 2-digit indicator 107, reduction mode indicators 130, 131, 132, 123, 125, cassette indicators 117, 118 etc. in response to the numeral keys 105, reduction mode keys 127, 128, 129, 124, 126, cassette selecting keys 115, 116 and interruption key 102 of the control panel. Also it performs blinking display of a suitable cassette in response to the selected reduction mode key, and dynamically displays the cassette size with the indicator 119 by reading cams on each cassette with a cassette size detector 36 or 37 composed of four switches.

The control CPU Q1 communicates with the aforementioned sequence CPU Q2 through 4-bit signals XYZW and STUV. The control CPU Q1 transmits the copying mode determined by the above-mentioned keys (for example reduction copying mode with sheet feeding from the upper A3 cassette), upon actuation of the copy start key, by said signal XYZW to the sequence CPU Q2, and performs the decrement of the copy counter and the display of a jam state or an abnormality according to the signal STUV transmitted from the sequence CPU Q2.

The program of the control CPU Q1 consists of the jam correction routine, key-sense routine, key-read routine, copy counter decrement routine, cassette/paper absence reading routine, scanning instruction set routine and display subroutine, each of which will be explained in the following.

At first, when the power supply to the apparatus is turned on, the random access memory is cleared in a step 804 as an initial step.

Subsequently, during the signal S trasmitted for ca. 1.2 seconds from the sequence CPU Q2, a step 804-1 stores the information of image magnification of the optical system (0.67, 0.78 or equal size) by the 3-bit signal TUV into the random access memory until the CPU is again reset.

A step 800, constituting a subroutine for preventing the chattering of the signal STUV, does not accept a change in the signal until the data read several times mutually coincide.

A step 801 is a routine for setting the data of an error found in the sequence CPU Q2 for display on the copy count indicator 107, by the codes E0–E7. An error signal is transmitted to the interruption port of the control CPU Q1, and the code (E0–E7) is transmitted by the signal TUV. Said signal is also used for turning off the fixing heater, thereby preventing the damage and fire hazard in the fixing unit.

A step 802 identifies the on-off state of 24 V power supply depending on the state of main switch and door, and the program proceeds to a step 803 when said power supply is turned off. Also in case an abnormality other than the thermistor failure, indicated by the code "E0", is found, the program proceeds to a step 804 to cancel the suspension of function resulting from the detection of abnormality.

In case of thermistor failure, the suspension of function is retained and cannot be reset, in order to prevent fire hazard, unless the CPU is forcedly reset for example by extracting the plug from the receptacle.

A step 805 constitutes a pulse generating routine for detecting a "runaway" or uncontrollable operation passibly leading to the destruction of the control CPU Q1. In said step determined pulses are generated at a determined frequency, and the absence of consecutive pulses within a determined time is detected by a detecting circuit 434 to reset the CPU's Q1 and Q2. Said detecting circuit 434 receives the pulses from the sequence CPU Q2 in synchronization with the drum clock pulses 403, or equivalent pulses from an internal timer during the stand-by period. Also said circuit receives the pulses from the control CPU Q1 during the off-state of the main switch 56, or the digit signals for dynamic display to be explained later during the on-state of said switch. Said circuit identifies the "runaway" state of the CPU if the corresponding signal does not change the level within a determined period, and resets both CPU's and output port enlarging adaptor 401 to prevent unexpected destruction of the process loads.

A step 806 resets the copy indicator to "1" if a jam state is not found, and terminates the output signal to the fan motor driver 429 to turn off an unrepresented fixer exhaust fan if the main switch 56 remains turned off for 15 minutes. Said fan is turned on simultaneously with the termination of the waiting step, in order to prevent toner deposition in the fixing unit, or particularly in the used toner container 31. If the noise after the main switch 56 is turned off has to be abated, it is also possible, by means of a switch, to terminate the output signal to the motor driver 429 simultaneously with the turning off of the main switch 56.

If a step 811 confirms that the jam handling is completed, the program proceeds to a step 814 to restore the display data diverted into the random access memory, in order to restore the copying mode immediately before the jam detection. However, in case said jam state has occured immediately before a preceding copying operation is interrupted by the interruption key, a step 815 turns off the display for the interruption mode and restores the copying mode immediately before said interruption, thereby cancelling the instruction by the interruption key. Also in case said jam has occured on the last sheet in an interruption copying mode, a step 816 is executed to turn on the display for interruption copying mode and restores such copying mode.

A step 818 adds a 2-bit signal VU transmitted from the sequence CPU Q2 at the jam resetting as the jam correction number to the copy count restored after said jam resetting, and sets the result of said addition as the display data.

As the result of the foregoing control, the copy count display at a jam state shows following changes as an example: "5"—"P2"—off—"6". It is to be understood that the display is turned off when the door is opened for jam handling.

The jam state, in which the code "P2" is displayed, cannot be reset by merely actuating the main switch. The jam state, jam display and code "P2" display are maintained until the jam relay 414 is reset by the jam reset lever while the main switch is turned off.

If a step 802 identifies that the main switch is turned on, the program proceeds to a step 809 to identify that the heater is turned off from the heater detection signal 431, whereby the waiting cycle is completed and the aforementioned output signal to the fan motor driver 429 is turned on.

Now there will be given an explanation on the jam correction routine.

A step 810 identifies a jam state and stores a 2-bit signal UV from the sequence CPU Q2 representing the number of sheets staying in the apparatus. Then a step 811 identifies that the jam relay 414 is not yet reset so that the jam handling is not yet made, and the program proceeds to a step 812 to divert the copy mode and display data (for example the reduction copying mode with sheet feed from the upper A3 cassette and with a copy set count "5") into the random access memory until the jam state is resolved. Then the program proceeds to a step 813 to display the number of sheets stored in the step 810 on the copy count indicator 107, in the form of a code preceded by "P".

Now explained is the key-sense routine.

At first a step 819 identifies if the function of the apparatus is suspended by the detection of an abnormality, and, if not, the program proceeds to a step 821 to enable key input and to check the presence of key input. Then key scanning signals are released in succession, and, in the absence of any key input, the program proceeds to a step 822 for increment of an off-chattering counter unless its content is already "3" and for starting an automatic clearing timer of about 60 seconds. Also in case the content of said counter is "3", an exact key-off state (for preventing off-chattering) is identified and the key input is enabled.

In case a key input is detected in the step 821, the key scanning is interrupted and the program proceeds to a step 823.

If the key input is enabled at said step 823, a key-on chattering counter is stepwise advanced for preventing on-chattering.

When the content of said on-chattering counter reaches a determined value, an exact key input is identified. Then said key input is transmitted to the sequence CPU Q2 in order to set the automatic shut-off timer, and a keyword is prepared from the value of key scanning signal.

In case the input key is not accepted, the program proceeds to a step 824 to turn off the display for copy set number "1" and for the interruption copying at the end of counting of the automatic clearing timer unless the function of the apparatus is suspended by the waiting cycle, absence of toner or paper, or toner overflow, and the program proceeds to a branch B shown in FIG. 5-6.

On the other hand, in case the input key is accepted, the program enters the keyword reading routine explained in the following.

At first a step 825 identifies the actuation of the interruption key and light the interruption mode indicator 102. In case the stop key is actuated, the copy instruction signal XYZW is cancelled and the program proceeds to a branch C shown in FIG. 5-6. Also if a copying cycle in progress is identified in a step 826, the program proceeds to a branch C shown in FIG. 5-6 to terminate the key reading routine and to disregard the actuated key.

In case the clear key is actuated, the copy set number is changed to "1".

A step 834 decodes the above-mentioned key words for numerals into segment display data for 7-segment display. Said display data are released in sucession in the branch C in FIG. 5-6, and the program proceeds to the display subroutine for dynamic display.

Now explained in the following is the copy counter decrement routine.

A step 835 forbids the function of atuomatic clearing timer during the copying operation, and, if the key counter detection signal 430 indicates that the key counter 62 is extracted, a step 835-1 resets the copy instruction signal XYZW in order to interrupt the copying operation.

The control CPU Q1 identifies the copying operation in progress from the high-level state of the signal S, and detects the trailing end of the signal S in a step 836 for decrement of the copy counter at the reversing of the optical system.

In the high-level state of the signal S indicating that a copying operation is in progress, the program proceeds to a step 837, and the copying operation is terminated by resetting the copy instruction when the copy counter reaches "1". Unless a jam state is detected, the decrement of the copy counter is effected in synchronization with the trailing end of the signal S. In case the stop key is actuated, a step 838 is executed to change the copy count to the copy set number. If an interruption copying is in progress, a copy mode immediately before the interruption is restored and simultaneously the entry of copy set number is enabled if the copy set number is "1".

A step 823 sets the display data corresponding to an actuated key, and the program proceeds to a branch C shown in FIG. 5-6. It is to be understood that the reduction-1 key means the key 126 or 129, the reduction-2 key means the key 124 or 128, and the reduction-3 key is not present in FIG. 2 but means the key 127 shown in FIG. 3.

In case of the actuation of a numeral key, the key reading is effected in the step 828 but the program proceeds to a branch A in FIG. 5-6 for setting the copy number. At first a step 829 identifies if the indicator has 2-digit data, and, if not, the program proceeds to a step 830 for confirming the presence of data in the second digit. In case of absence of such data, the program proceeds to a step 831. The actuation of the key "0" is disregarded for the first digit. In response to the actuation of other numeral keys, a step 832 sets blank display data for the second digit. Then a step 831 sets the input keyword as the display data for the first digit, and a step 832 stores the display data for two digits. Also in case the step 830 identifies a key input for the second digit, following a key input already entered for the first digit, the program proceeds to a step 835 to transfer the display data for the first digit to the second digit and to set the new input data as the display data for the first digit. Then the step 832 stores the display data.

In case the upper cassette is selected or the manual insertion cassette is detected by the microswitch, a step 833 in the branch B shown in FIG. 5-6 enables the display of copy set number, thereby allowing the entry of copy set number for the succeeding copying operation without requiring to clear the copy set number by the clear key.

In case a step 836 identifies the trailing end of the signal S, the program proceeds to a step 839 to execute stepwise reduction if it is allowed. Numeral "0" in the second digit is replaced by blank data in order to suppress the display. The end of a copying operation is identified when a step 840 identifies that the first digit is equal to "0" and the seccond digit is blank, whereby a copy stop process is executed by a step 838.

Now explained in the following is the cassette reading and scanning instruction set routine.

A step 841 releases a scanning instruction signal for reading the state of cassette-reading switches of the cassette selecting means as a 4-bit signal. The presence of the manual insertion tray is detected by the microswitch 38, only when the upper cassette is selected, and, upon said detection, display data are set for lighting the manual insertion indicator 120.

A step 842 identifies the absence of paper or cassette from a 4-bit signal entered according to the above-mentioned scanning instruction, and light the paper absence indicator 110. The detected cassette sizes are divided into large sizes and small sizes, which are respectively indicated by "1" and "0". The corresponding size signal is transmitted to the sequence CPU Q2, and the absence of paper during a copying operation is indicated by inverting said size signal.

In case the detected cassette size is of B-series (A4R, B5R, B4 or B5), a step 843 releases the B-size blank signal during the copying operation in order to prevent unnecessary toner outside the image transfer area. Also except in the manual insertion copy mode, display data are set in order to light the size indicator 119 corresponding to the identified cassette size.

In the present embodiment, the optical scanning width of the original is selected from A3, B4 and A4 sizes according to the size of the mounted cassette. As an example, when the reduction copying mode with a reduction rate of 0.78 is selected in combination with the B5 cassette, a scanning width of A4 size is selected in order that the reduced image can be completely transferred onto the sheet of B5 size supplied in the lateral direction.

A step 844 constitutes a routine for determining the scanning width according to the size of selected cassette and to the image reduction rate. Said scanning width is encoded into a 2-bit signal and stored as the scanning instruction data in the random access memory through the accumulator.

In case the manual insertion mode is selected, the scanning is always conducted for the A3 size, regardless of the cassette size.

The above-mentioned method of determining the scanning width will be explained later in detail in another embodiment.

Now there will be explained the cassette blinking display routine.

In the present embodiment there are provided plural reduction mode selecting keys in the control panel as shown in FIGS. 2 and 3.

The image reduction rate in FIG. 2 is 0.67, corresponding to a size reduction from A3 to A4 or B4 to B5, while that in FIG. 3 is 0.78, corresponding to a size reduction from A3 to B4, B4 to A4 or A4 to B5. The keys 126, 124, 129, 128 and 127 have a function, in case the selected cassette is not adequate for the original size, to cause blinking display of an appropriate cassette size in the indicator 119.

A step 845 in FIG. 5-6 constitutes a routine for blinking display of the cassette for the above-mentioned purpose. In said step the reduction-1 mode means a size reduction from A3 to A4 in an apparatus with a reduction rate of 0.67, or from A3 to B4 in an apparatus with a reduction rate of 0.78, while the reduction-2 mode means a size reduction from B4 to B5 in an apparatus with a reduction rate of 0.67, and the reduction-3 mode means a size reduction from B4 to A4 in an apparatus with a reduction rate of 0.78. In the present embodiment the copying operation is possible even when an inadequate cassette is selected, so that it is possible to obtain a reduction copy of a necessary image area by utilizing the marginal area or by suitably moving the original.

A step 846 in FIG. 5-7 constitutes a routine for detecting the expiration of the waiting step. After the main switch 56 and the door switch are turned on, the wait indicator 103 is maintained blinking and the copying operation is prohibited until the fixing roller 57 reaches the determined temperature and the fixing heater is once turned off.

A step 848 constitutes a routine for releasing, in response to the copying instruction, a 4-bit signal XYZW according to the aforementioned instruction data for the scanning, cassette selection and image magnification, and said signal is reset when the copying instruction is reset.

A step 849 resets a signal BCR for prohibiting the bin shift in the sorter 29 only in case the copying operation of the set copy number is completed, thereby preventing the sorter bins from returning to the initial state when a copying operation, interrupted by the absence of paper or by a jamming, is restarted. After a step 850 constituting a display subroutine for dynamic display, the program returns to a branch G in FIG. 5-5, and the above-described program is thereafter repeated.

In the following there will be explained another embodiment of the present invention.

FIG. 7 is a schematic cross-sectional view of a copying apparatus with variable image magnification in which the present invention is applicable. In FIG. 7 there are shown a casing 201; an original 202 placed on a platen 203; pulleys 204, 205 for reciprocating the platen 203; a clutch 219 for connecting the pulley 205 with a synchronous motor 220 driven in synchronization with a photosensitive drum 213; mirrors 210, 212; a lens system 211 in the direction of arrow according to a desired image magnification; an exposure lamp 208; a microswitch HP 223 to be actuated by a cam 221 provided on the platen to stop the movement thereof; a microswitch RP 224 to be actuated by said cam for driving a timing roller (registering roller) 216; and a roller 225 for picking up and feeding a sheet 217 from a cassette 227. Said clutch 219 is provided with gears for changing the transmission speed according to the desired image magnification. A disk 214 concentric with the photosensitive drum is provided with apertures which are detected by a photointerrupter 215 to generate serial pulses.

In response to the actuation of an unrepresented copy start button, the drum 213 performs pre-rotation for a determined period corresponding at least to a full turn. Then the lamp 208 is turned on and the movement of the platen 203 is started. The drum previously charged with a charger 228 is exposed to the image of the original, and is developed in a developing unit 229, and the developed image is transferred onto the sheet 217 advanced in synchronization. The platen 203 actuates the switch 224 during the course of movement thereby activating the timing roller 216, then is stopped at a determined position and reversed, and is stopped upon actuating the switch 223. Then the platen is restarted in case a repetitive copying operation instructed by numeral keys. A switch 226 for detecting the size of the cassette 227 is so constructed as to detect 6 sizes as shown in FIG. 13.

The end position of said scanning, or the scanning width is selected in three ways corresponding to A4, B4 or A3 size as shown in FIG. 8.

The control of the above-described functions will be explained in the following, with reference to the circuit diagram shown in FIG. 9 and the flow charts shown in FIGS. 10 to 12.

In FIG. 9 there are shown a control microcomputer $\mu$1 for receiving a copy start key signal, numeral key signals, magnification signals indicating the equal-size or magnifications M1, M2 etc. from a control unit 250 and a cassette size signal from the cassette 226 and releasing various control signals for copy start, scanning distance, displays etc.; and a sequence microcomputer $\mu$2 for receiving signals from the photointerrupter 215, switches 223, 224 etc. and performing sequence control of the platen clutch 219, lamp 208, roller clutch 218, main motor etc. Said microcomputer can be composed of known one-chip microcomputers such as $\mu$COM43 and mutually exchanges data for scanning distance control, repetitive copying control, process step, sheet jam etc.

The sequence microcomputer $\mu$2 stores a program as schematically shown in FIG. 10, of which step 106 (SBSCAN) for determining the scanning distance is detailedly shown in FIG. 11. Also the control microcomputer $\mu$1 stores a program for determining the scanning distance data in response to the cassette size signal and the image magnification key signal.

In FIG. 9, lines a, b connecting the output ports of the microcomputer $\mu$1 with the input ports of the microcomputer $\mu$2 are for 2-bit parallel transmission of scanning data, which constitute 4-bit parallel data in combination with image magnification data etc. transmitted through other lines c, d. Said data (a, b) will be (1, 0) for the scanning width of A3 size, (0, 1) for the scanning width of B4 size, (1, 1) for the scanning width of A4 size, or (0, 0) for a copy stop instruction before a continuous copying operation is completed. In this manner the selection of scanning width is limited to three, or two if only one line is allotted for the data transmission.

On the other hand, as shown in FIG. 13, the image magnification can be selected in 3 ways from the equal-size, magnifications M1 or M2, while the cassette size is variable in 6 ways, so that there are required 18 scanning distances in total. In the present embodiment these distances are divided into 3 classes in order to minimize the required data transmissions.

More specifically a scanning width for A3, B4 or A4 size is selected respectively when "1", "2" or "3" is set in the accumulator Acc of the control microcomputer $\mu$1, and said value is transmitted through the lines a, b. The control microcomputer $\mu$1 executes a subroutine shown in FIG. 12 at each key entry routine. At first a step 300 sets "1" in the accumulator Acc, and a step 301 identifies whether the size signal from the cassette switch 226 indicates the A3 size. If affirmative, data (1, 0) are set on the lines a, b since no longer scanning distance exists. If not, a step 302 is executed to identify whether said signal indicates the B4 size, and, if affirmative, a step 303 identifies whether an image reduction rate M1 or M2 is instructed by the reduction keys on the control unit 250. If affirmative, data for the scanning distance for A3 size are set in the accumulator Acc, thus setting (1, 0) on the lines a, b. In case the equal-image size is instructed instead of the reduction rate M1 or M2 by the equal-size key on the control unit 250, a step 304 increases the content of the accumulator Acc to "2", thus setting (0, 1) on the lines a, b for the scanning width for B4 size. If the step 302 identifies that the cassette is not B4 size, a step 305 identifies whether the size signal indicates the A4R size, and, if affirmative, a step 306 identifies whether the reduction rate M1 is instructed, and, if affirmative, data (1, 0) are set for the scanning width for A3 size. In case the reduction rate M1 is not instructed, a step 307 is executed to identify whether the reduction rate M2 is instructed, and, if affirmative, data (0, 1) are set for the scanning width for B4 size. If the reduction rate is neither M1 nor M2, data (0, 1) are set for the scanning width for B4 size. The A4R size indicates an A4 size rotated by 90°. In case the step 305 identifies that the size signal does not indicate the A4R size, a step 308 is executed to stepwise increase the content of the accumulator Acc, and a step 309 identifies whether said signal indicates the A4 size. If affirmative, and if the image magnification is for equal-size copying, a step 304 is executed for further stepwise increase to set "3", thereby setting (1, 1) on the lines a, b. If a reduction rate is selected, data are set for the scanning width of B4 size. If the size signal does not indicate A4 size, a step 310 identifies whether said signal indicates B5 size, and, if affirmative, a step 306 identifies whether the reduction rate M1 is instructed. If so data are set for the scanning width of B4 size. Also if the size signal indicates B5R size (B4 size rotated by 90°) instead of B5, data are set for the scanning width of B4 size.

The above-mentioned data transmitted through the lines a, b are red in a routine SBSCAN of the sequence microcomputer $\mu$2 shown in FIG. 11.

Now referring to FIG. 10, upon actuation of the copy start key in a step 101, a step 102 is executed to drive the main motor and the drum, and to start counting of the pulses P from the photointerrupter 215. Then a step 103 drives the feed roller 225 and energizes the clutch 219 to start the movement of the platen 203, both at a determined pulse count. Then a step 105 identifies whether the microswitch 224 is actuated by the cam 22. If actuated, a step 106 sets a pulse number for stopping and reversing the platen 203 according to the subroutine SBSCAN. In said step, more specifically, the image magnification signal from the line c is identified at first, and a pulse count 6, 7 or 8 is set in a memory in the sequence microcomputer $\mu$2 according to the data transmitted through the lines a, b, i.e. respectively when the scanning width corresponds to A3, B4 or A4 size.

Also for the reduction rate M1, a pulse number 4 or 5 is set in the microcomputer $\mu$2 according to the data sent through the lines a, b, i.e. respectively when the scanning width corresponds to A3 or B4 size.

For the reduction rate M2, a pulse number 1, 2 or 3 is set in the microcomputer $\mu$2 according to the data sent through the lines a, b, i.e. respectively when the scanning width corresponds to B4, A4 or A3 size.

Thereafter a step 107 initiates the counting of pulses up to the set pulse number.

When the pulse counting is completed according to the image magnification, a step 108 deactivates the clutch 219 to stop and reverse the platen. When the platen is stopped by the switch 223, a step 109 identifies if the copying operation is to be continued, and, if affirmative, the platen starts to proceed again under the above-described control. If the copying operation is not to be repeated, a step 110 performs the post-rotation and the copying operation is terminated.

FIG. 11 shows the subroutine SBSCAN for determining the number of pulses to be counted in the step 107 shown in FIG. 10, according to the image magnification and the scanning width.

If an equal-size magnification is identified in a step 201, a step 202 identifies whether the scanning width is for A3 size, and, if affirmative, a step 203 sets a pulse number "6" in the memory of the sequence microcomputer $\mu$2. If not, a step 204 identifies whether the scanning width corresponds to B4 size, and if affirmative, a step 205 sets a pulse number "7" in said memory. If not, the scanning width is regarded as corresponding to A4 size, and a pulse number "8" is set. If a varied magnification is identified in the step 201, a step 207 identifies whether the reduction rate corresponds to M1, and, if not, the reduction rate is regarded as M2. Thus, if the scanning width is for B4 size, a step 208 sets a pulse number "1". Also if the scanning width is for A4 size, a step 209 sets a pulse number "2". Also if the scanning width is neither for B4 for A4 size, the scanning width is regarded as corresponding to A3 size, and a step 210 sets a pulse number "3". In case the reduction rate M1 is identified in the step 207, a step 211 identifies whether the scanning width corresponds to A3 size, and, if affirmative, a pulse number "4" is set. Also if not, a step 212 sets a pulse number "5".

As explained in the foregoing, the present invention allows to eliminate, by independent movements of lens and mirror for attaining a desired image magnification, mechanical links between said lens and mirror, thereby enabling to simplify the magnification changing mechanism and to facilitate compactization of the copying apparatus.

Such independent movements provide a possibility of movements in different timings, such as a lens movement followed by a mirror movement in case of a change from a reduction copying mode to an equal-size copying mode, and movements in the inverted order in case of a change from an equal-size copying mode to a reduction copying mode, thereby allowing effective use of spaces required for such movements.

In such manner it is also rendered possible to start the mirror movement only after detecting means confirms that the lens has moved to a predetermined position. Consequently it is possible to individually identify the abnormalities in both driving systems, and to prevent destruction of component parts resulting from such abnormalities.

Furthermore the present invention allows to arbitrarily select the active period of the charge eliminating means according to the desired image magnification, thereby realizing complete charge elmination of the photosensitive member regardless of the selected image magnification.

Such charge elimination avoids the toner deposition in unnecessary areas, thus reducing the waste in toner.

Furthermore the present invention enables scanning control with limited data, thereby enabling efficient use of data lines for example of microcomputers.

The present invention is by no means limited to the foregoing embodiments but also includes various modifications without the scope and spirit of the appended claims.

What we claim is:

1. A copying apparatus with variable image magnification comprising:

a light source for exposure scanning of an original;

a photosensitive member for forming an electrostatic latent image in response to the light from said original;

a mirror for guiding said light to said photosensitive member;

a lens for focusing said light onto said photosensitive member; and control means for controlling the movements of said mirror and said lens independently so as to allow said mirror and lens to be moved individually to their respective positions for a desired image magnification and so as to allow one of said movements to be intitiated after the end of the other movement;

wherein said control means includes first discrimination means for discriminating whether the movement of said mirror is normal or abnormal and second discrimination means for discriminating whether the movement of said lens is normal or abnormal, wherein said control means allows formation of the electrostatic latent image only when said first and second discrimination means determines that the movements of both said mirror and lens are normal.

2. A copying apparatus according to claim 1, further comprising detecting means for detecting that said lens is positioned corresponding to a desired image magnification.

3. A copying apparatus according to claim 2, wherein said second discrimination means includes timer means adapted for generating an abnormality signal in case said lens does not become positioned corresponding to the desired image magnification within a predetermined time.

4. A copying apparatus according to claim 1, further comprising detecting means for detecting that said mirror is positioned corresponding to a desired image magnification.

5. A copying apparatus according to claim 4, further comprising pulse generating means for determining the destination position of said mirror.

6. A copying apparatus according to claim 4, wherein said first discrimination means comprises counting means for counting the number of incremental movements of said mirror to the position corresponding to a desired image magnification and for generating an abnormality signal in case said mirror is not set at the position corresponding to the desired image magnification with a predetermined number of incremental movements.

7. A copying apparatus according to claim 1, wherein said control means controls both said mirror and said lens in such a manner as to alter the order of movement thereof in accordance with the set image magnification.

8. A copying apparatus with variable image magnification comprising:

scanning means for scanning an original at a scanning speed corresponding to a desired magnification, said scanning means including a light source for exposure scanning of the original;

a photosensitive member for forming an electrostatic latent image in response to the light from said light source;

charge eliminating means for eliminating unnecessary charge from said photosensitive member; and control means for controlling the active period of said charge eliminating means in accordance with the desired image magnification;

wherein said control means determines the active period of said charge eliminating means at a start of the scan by said scanning means, in accordance with the desired image magnification alone, and determines the active period of said charge eliminating means during the scan by said scanning means, in accordance with the desired magnification and the size of a transfer paper fed to said photosensitive member.

9. A copying apparatus according to claim 8, further comprising pulse generating means for determining the active period of said charge eliminating means.

10. A copying apparatus according to claim 9, wherein said control means comprises counting means for counting the pulses generated by said pulse generating means, wherein the number of pulses to be counted is rendered variable according to the desired image magnification.

11. A copying apparatus according to claim 8, wherein said charge eliminating means is an exposure lamp for illuminating said photosensitive member.

12. A copying apparatus according to claim 8, wherein said control means is adapted to cause scanning motion of said light source at a predetermined time after said light source is turned on.

13. A copying apparatus with variable image magnification comprising:

image forming means comprising means for scanning an original;

first input means for entering an image magnification;

second input means for entering a sheet size;

a first computer for controlling the entries from said first and second input means, said first computer determining a scanning distance of said original scanning means in accordance with the entries from said first and second input means, the number of kinds of the scanning distances determined by said first computer being less than that of kinds of sheet sizes inputted by said second input means; and a second computer for entering the data from said first computer and for controlling said image forming means for an image formation;

wherein said first computer is adapted to transmit control data of the scanning distance of said original scanning means to said second computer, said control data being parallel coded data composed of a predetermined number of bits.

14. A copying apparatus according to claim 13, further comprising pulse generating means, wherein said second computer is adapted to determine the scanning distance of said original scanning means by counting the number of said pulses.

15. A copying apparatus according to claim 13, wherein said first computer is adapted to transmit data associated with a variable magnification to said second computer, said data being parallel coded data composed of a predetermined number of bits.

* * * * *

UNITED STATES PATENT AND TRADEMARK OFFICE

CERTIFICATE OF CORRECTION

PATENT NO. : 4,711,558

DATED : December 8, 1987

INVENTOR(S) : HIROSHI TANIOKA, ET AL.

It is certified that error appears in the above-identified patent and that said Letters Patent is hereby corrected as shown below:

IN THE DRAWINGS

Sheet 3, Figure 4A, "412 REGISTATION" should read --412 REGISTRATION--.
Sheet 3, Figure 4A, "416 REGISTATION" should read --416 REGISTRATION--.
Sheet 3, Figure 4A, "420 THEFMISTER OFF" should read --420 THERMISTOR OFF--.
Sheet 4, Figure 4B, "SOURLE DET" should read --SOURCE DET--.
Sheet 5, Figure 4C, "ABNORMAC" should read --ABNORMAL--.
DET CCT
DET CCT
Sheet 6, Figure 5-1A, "THERMISTER" should read --THERMISTOR--.
Sheet 9, Figure 5-1D, "JAM INSTRACTION ON" should read --JAM INSTRUCTION ON--.
Sheet 9, Figure 5-1D, "THERMISTER OFF" should read --THERMISTOR OFF--.
Sheet 11, Figure 5-1F, "THERMISTER" should read --THERMISTOR--.
Sheet 16, Figure 5-2D, "SORTOR " should read --SORTER --.
STANDBY STANDBY
Sheet 20, Figure 5-3D, "UPPE STAGE" should read --UPPER STAGE--.
Sheet 21, Figure 5-3E, "UPPE STAGE" should read --UPPER STAGE--.
Sheet 24, Figure 5-3H, "SORTOR JAM" should read --SORTER JAM--.

UNITED STATES PATENT AND TRADEMARK OFFICE

CERTIFICATE OF CORRECTION

PATENT NO. : 4,711,558

DATED : December 8, 1987

INVENTOR(S) : HIROSHI TANIOKA, ET AL.

It is certified that error appears in the above-identified patent and that said Letters Patent is hereby corrected as shown below:

IN THE DRAWINGS (continued)

Sheet 24, Figure 5-3H, "240 CLOCK SLT" should read --240 CLOCK SET--.

Sheet 27, Figure 5-4A, "SORTOR " should read --SORTER --.
STANDBY STANDBY

Sheet 27, Figure 5-4A, "SORTOR STANDBY" should read --SORTER STANDBY--.

Sheet 27, Figure 5-4A, "  COPY  "
INSTRACTION
should read
--  COPY  --.
INSTRUCTION Sheet 29, Figure 5-4C, "  SHEET "
EXAUSTED
should read
--  SHEET  --.
EXHAUSTED Sheet 30, Figure 5-4D, "  LAST  "
SHEET EXAUSTED
should read
--  LAST  --.
SHEET EXHAUSTED Sheet 30, Figure 5-4D, "SORTOR OFF" should read --SORTER OFF--.

Figures 4D, 5:
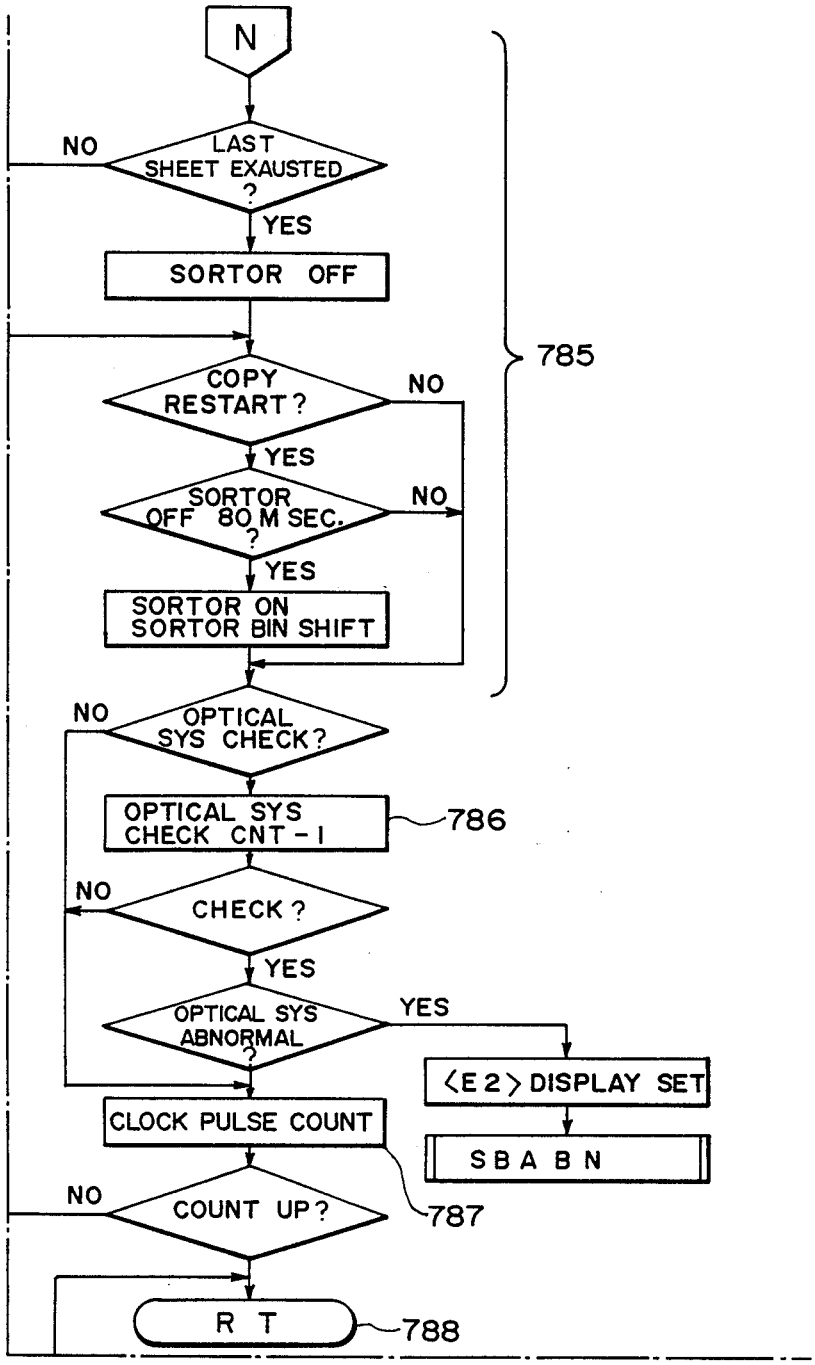
Figures 4E, 5:
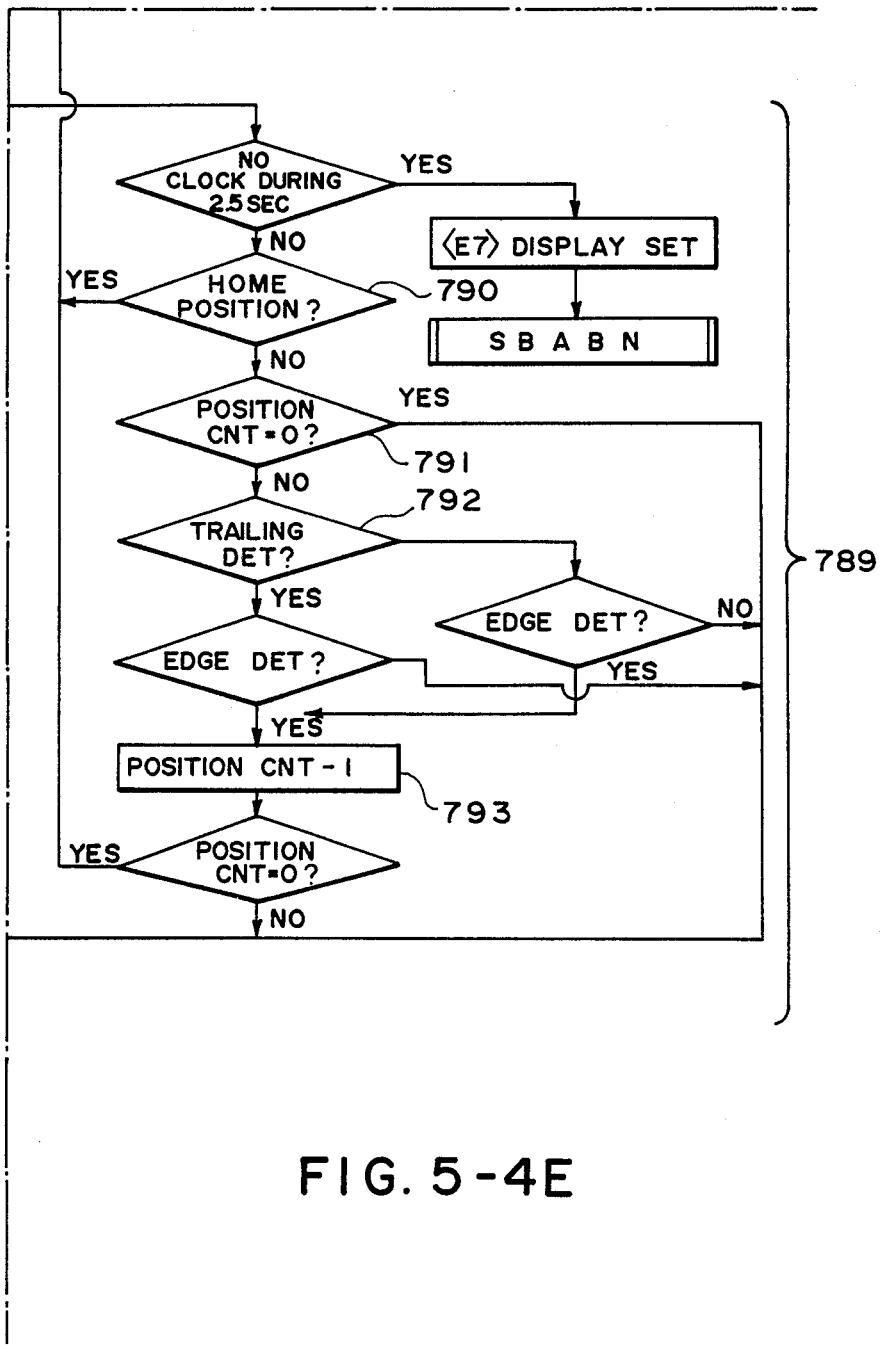
Figures 2, 5:
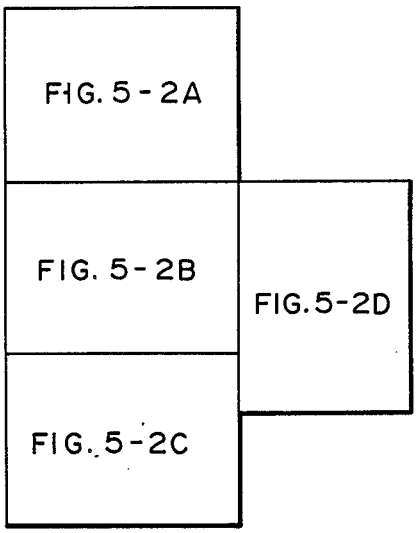
Figure 5:
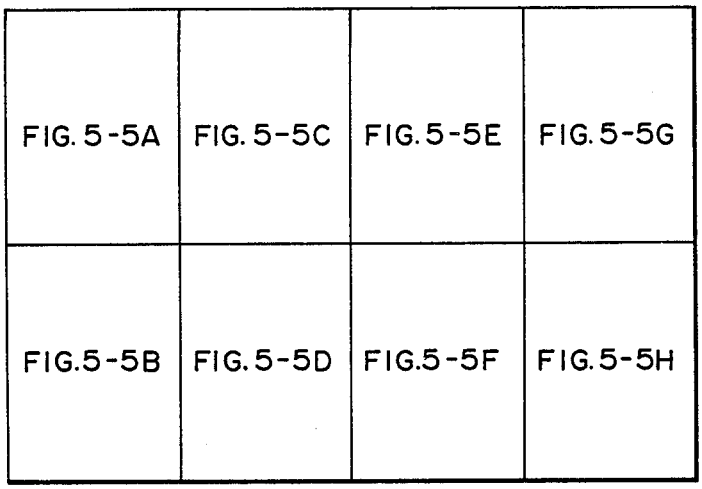

Sheet 30, Figure 5-4D, "  SORTOR  "
OFF 80 M SEC.
should read
--  SORTER  --.
OFF 80 M SEC.

UNITED STATES PATENT AND TRADEMARK OFFICE

CERTIFICATE OF CORRECTION

PATENT NO. : 4,711,558

DATED : December 8, 1987

INVENTOR(S) : HIROSHI TANIOKA, ET AL.

It is certified that error appears in the above-identified patent and that said Letters Patent is hereby corrected as shown below:

IN THE DRAWINGS (continued)

Sheet 30, Figure 5-4D, "SORTOR ON SORTOR BIN SHIFT" should read --SORTER ON SORTER BIN SHIFT--.

Figures 5, 5A:
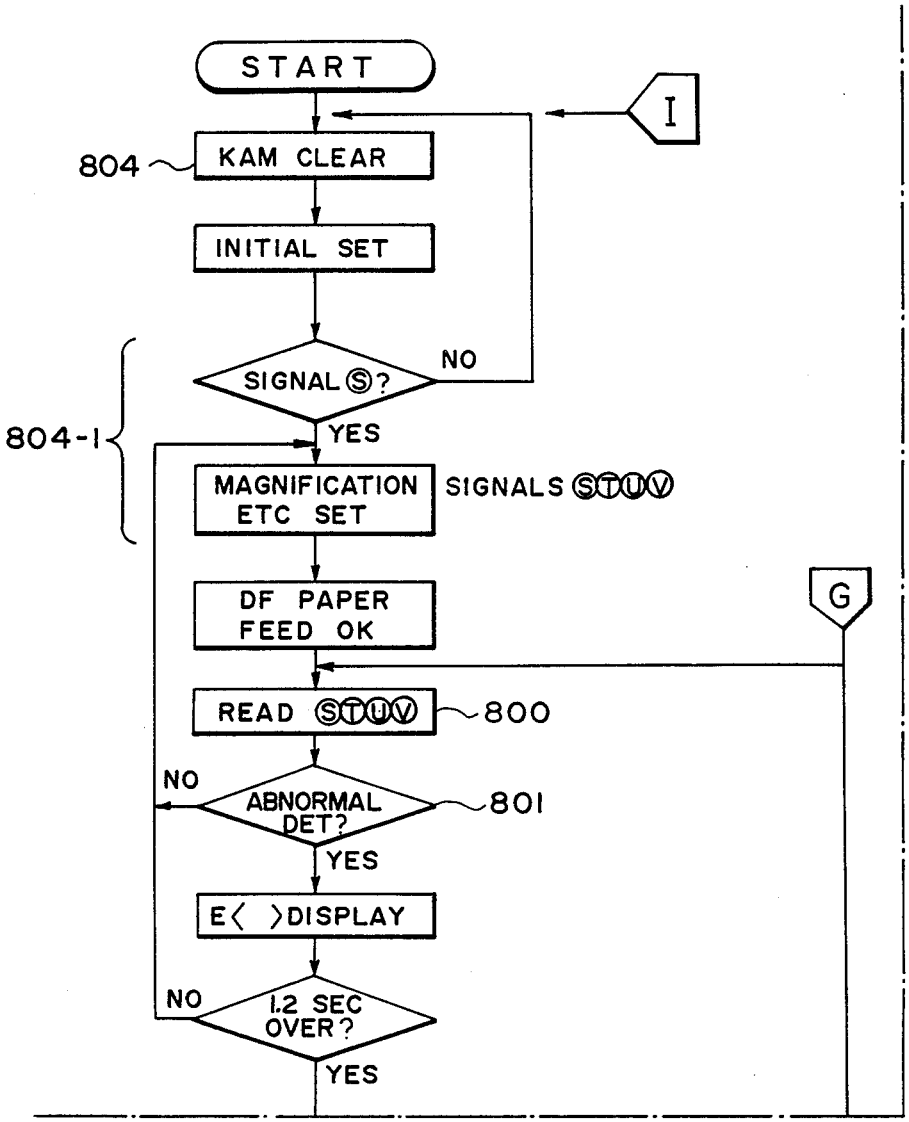
Figures 5, 5B:
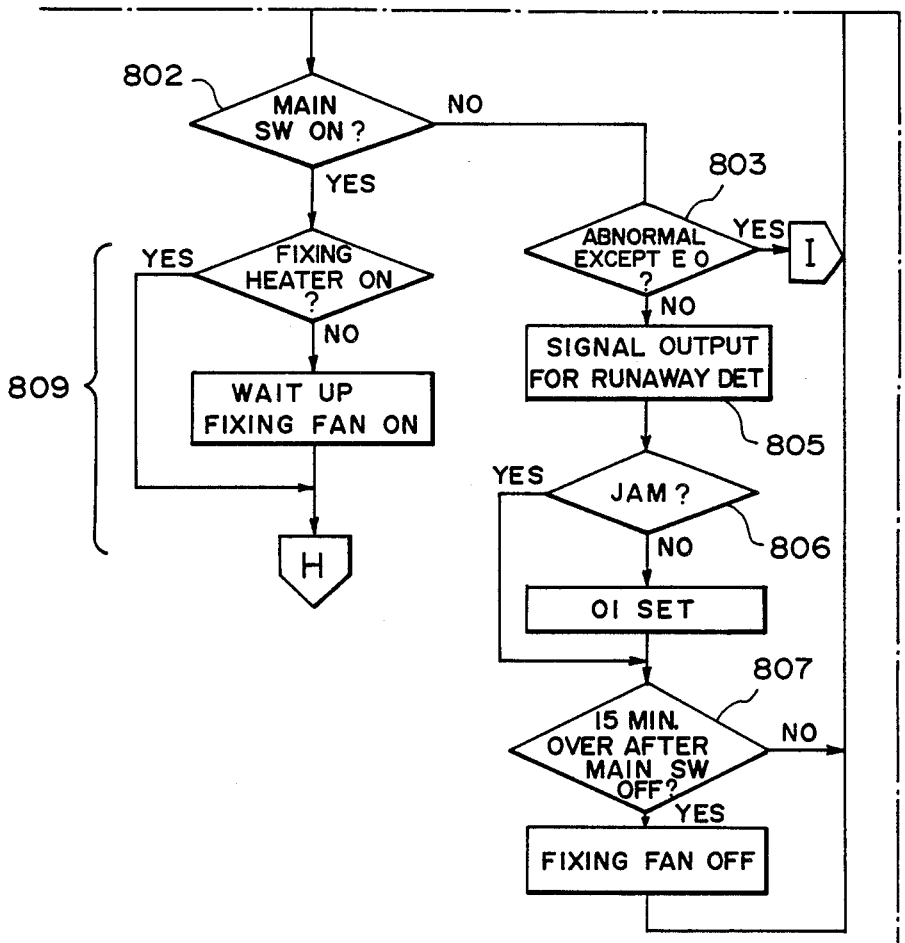
Figures 5, 5C:
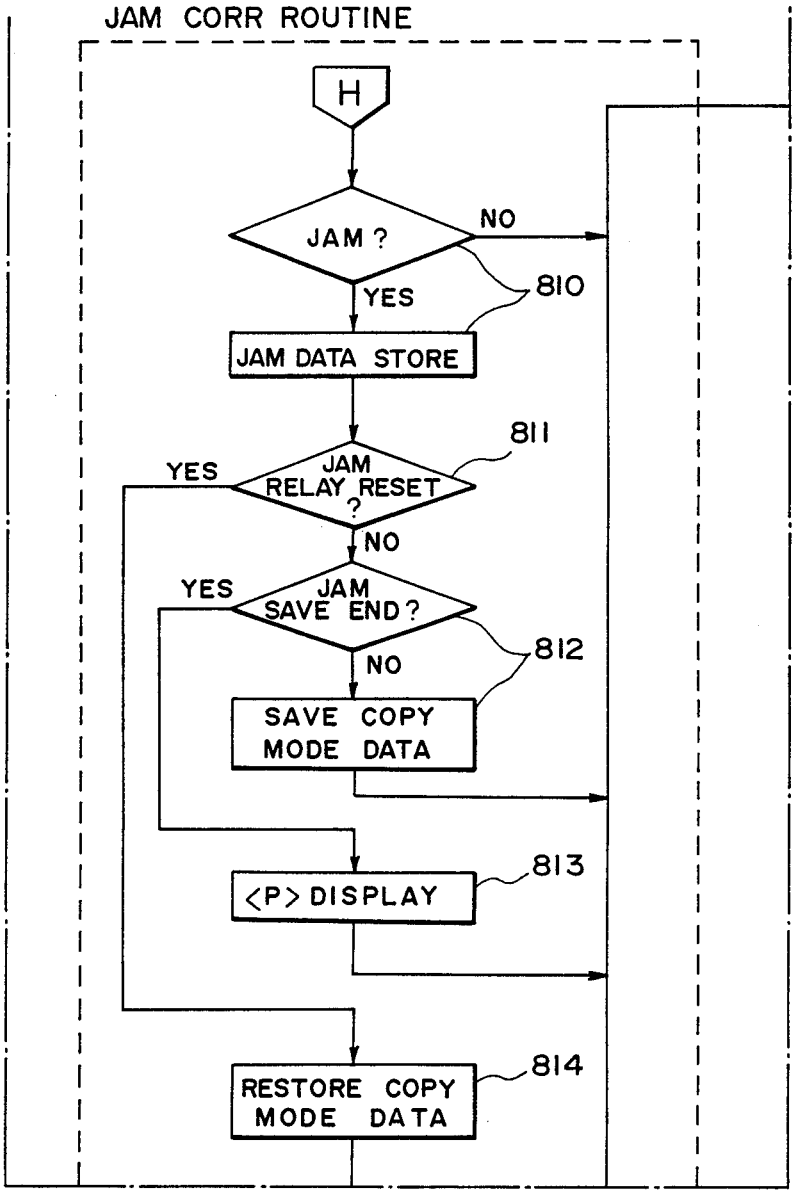
Figures 5, 5D:
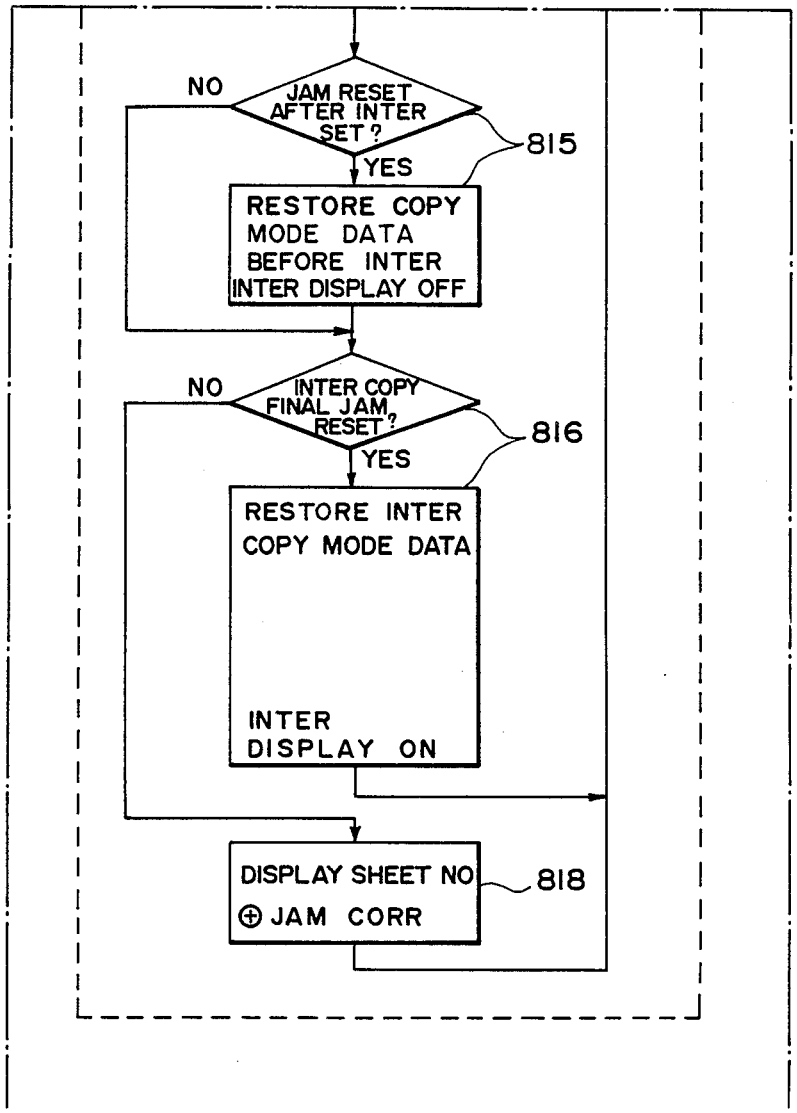
Figures 5, 5E:
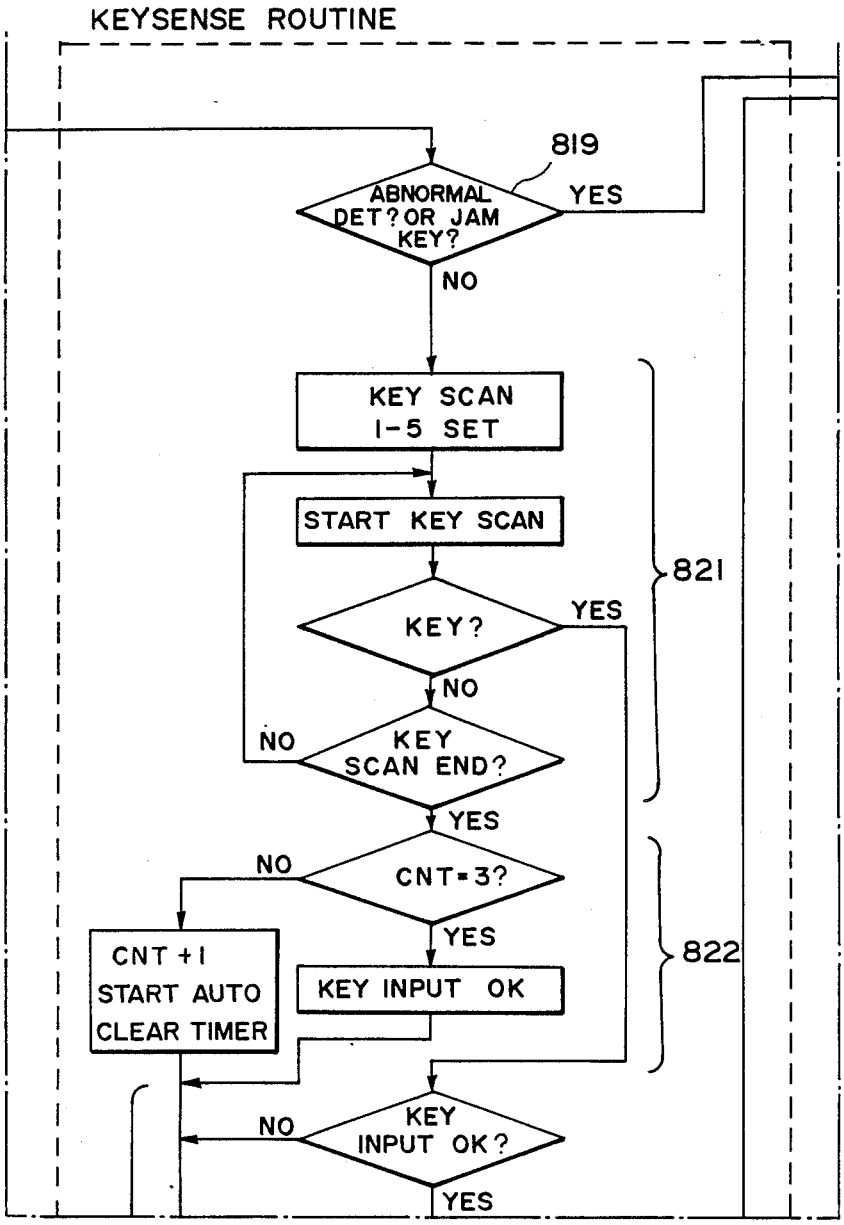
Figures 5, 5F:
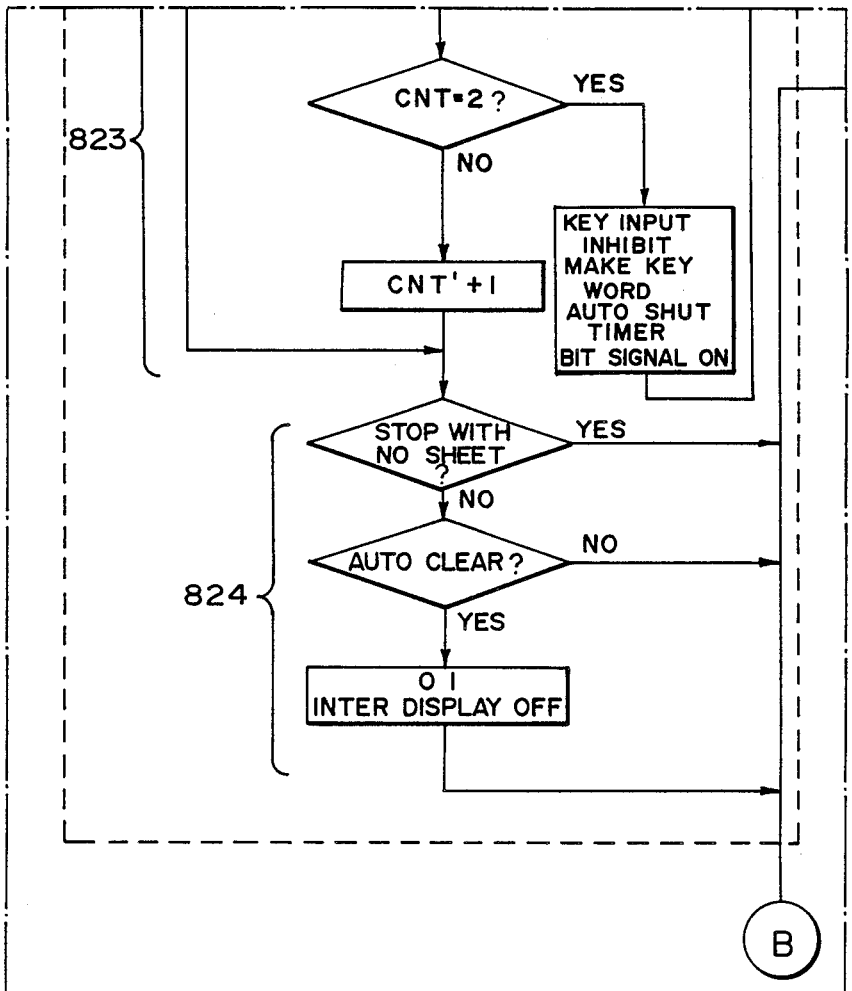
Figures 5, 5G:
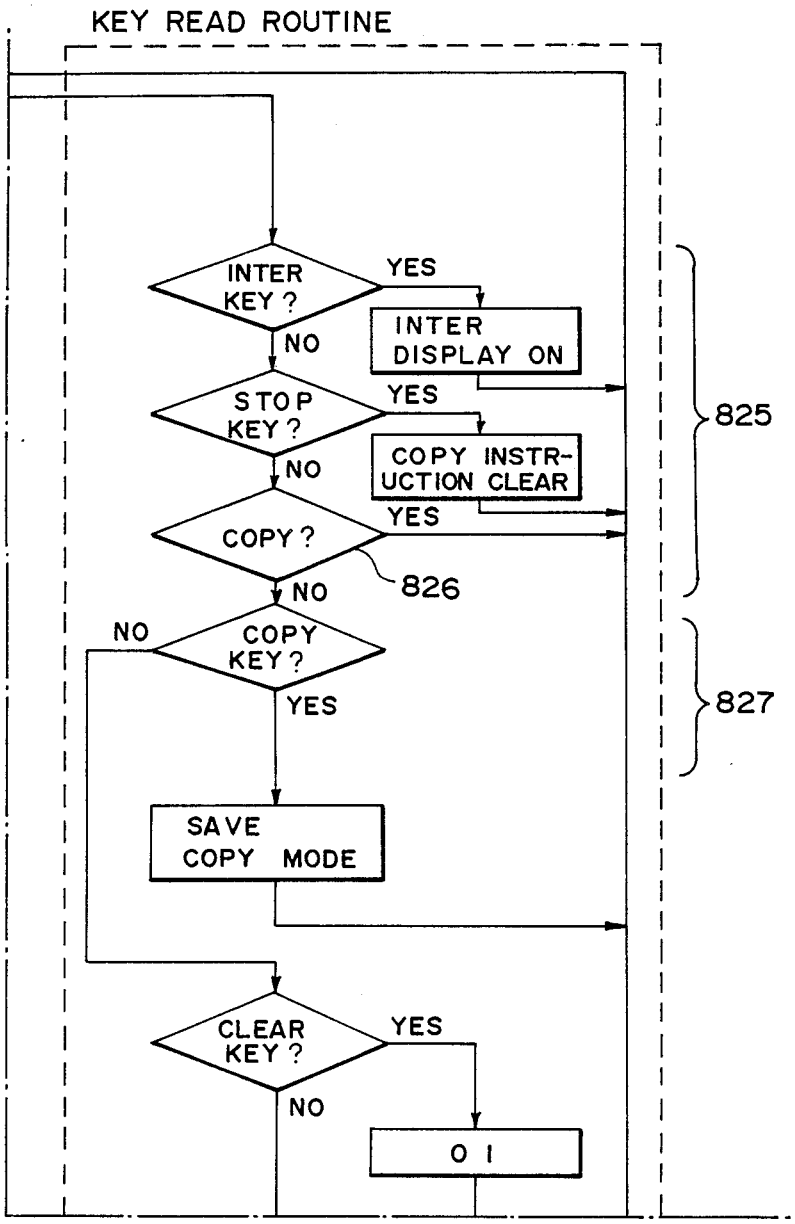
Figures 5, 5H:
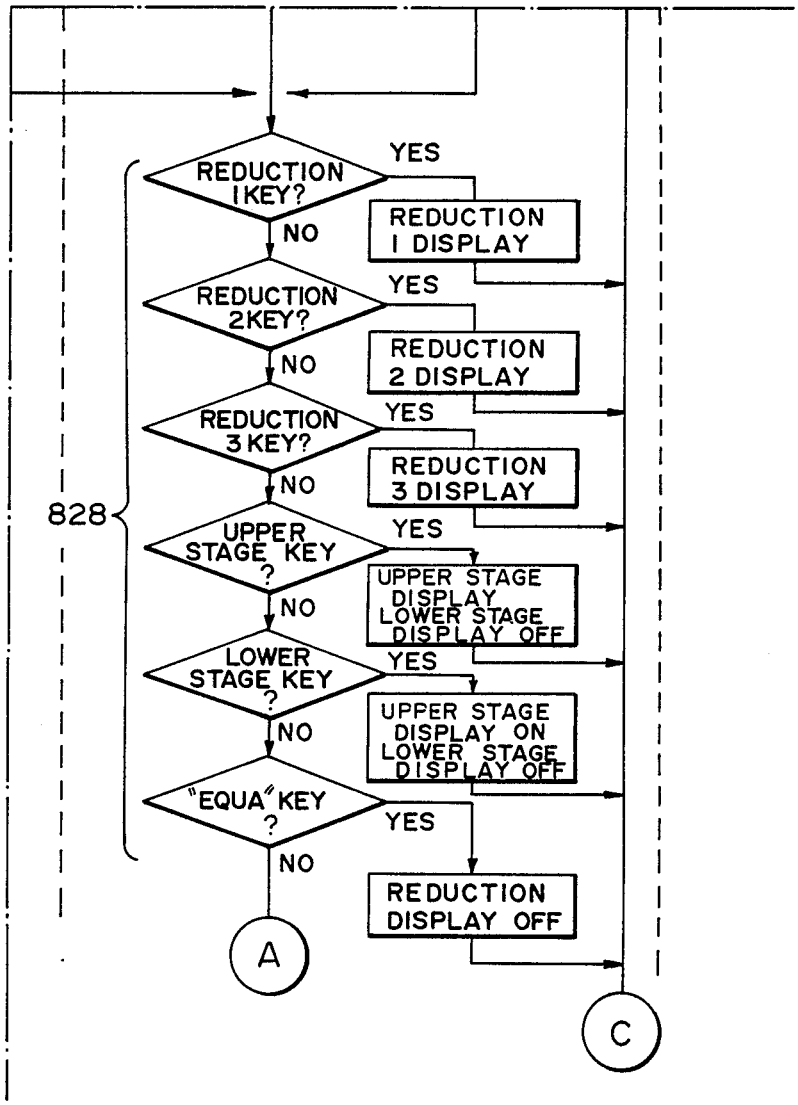
Figures 5, 6, 6A:
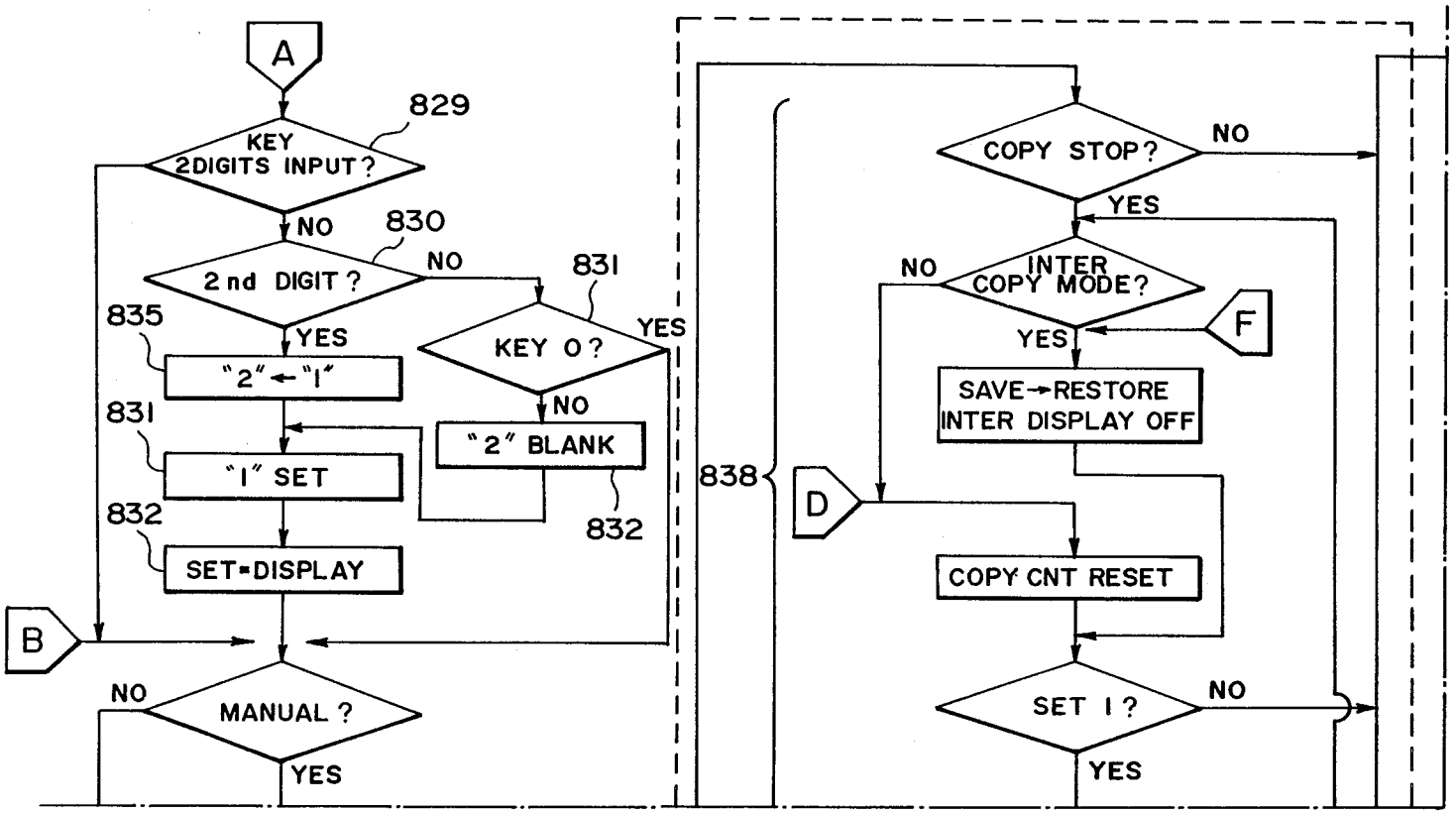
Figures 5, 6, 6B:
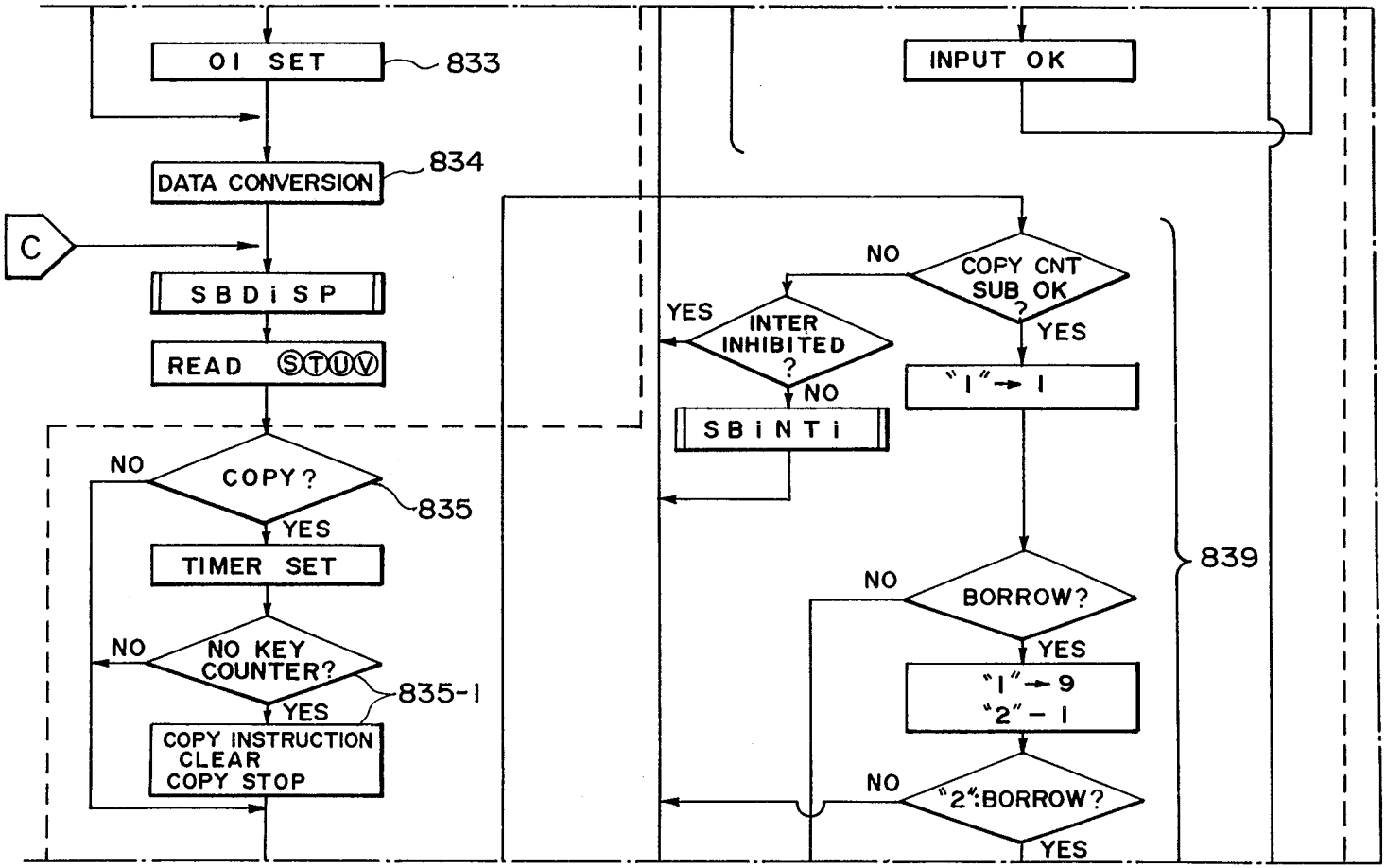
Figures 5, 6, 6C:
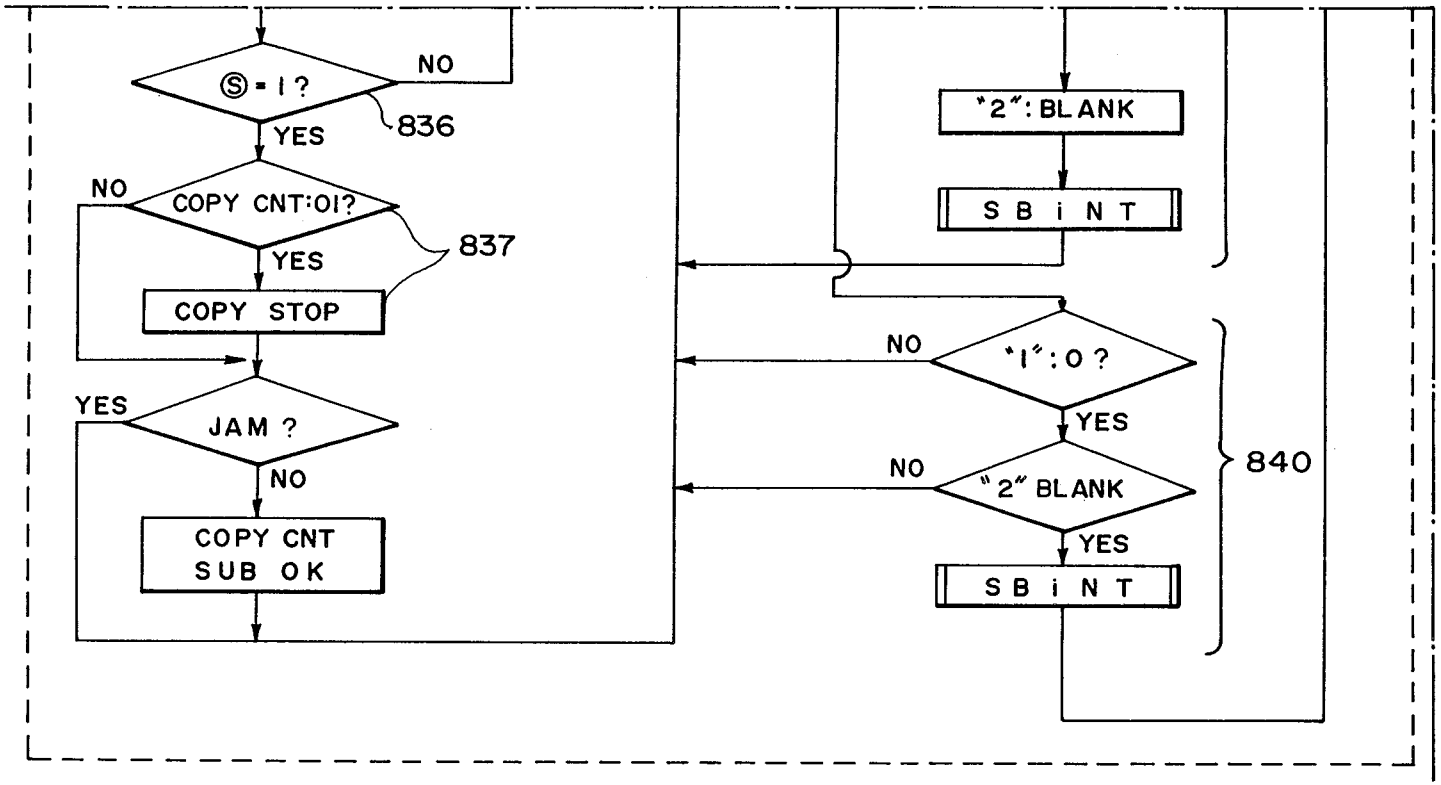
Figures 5, 6, 6D:
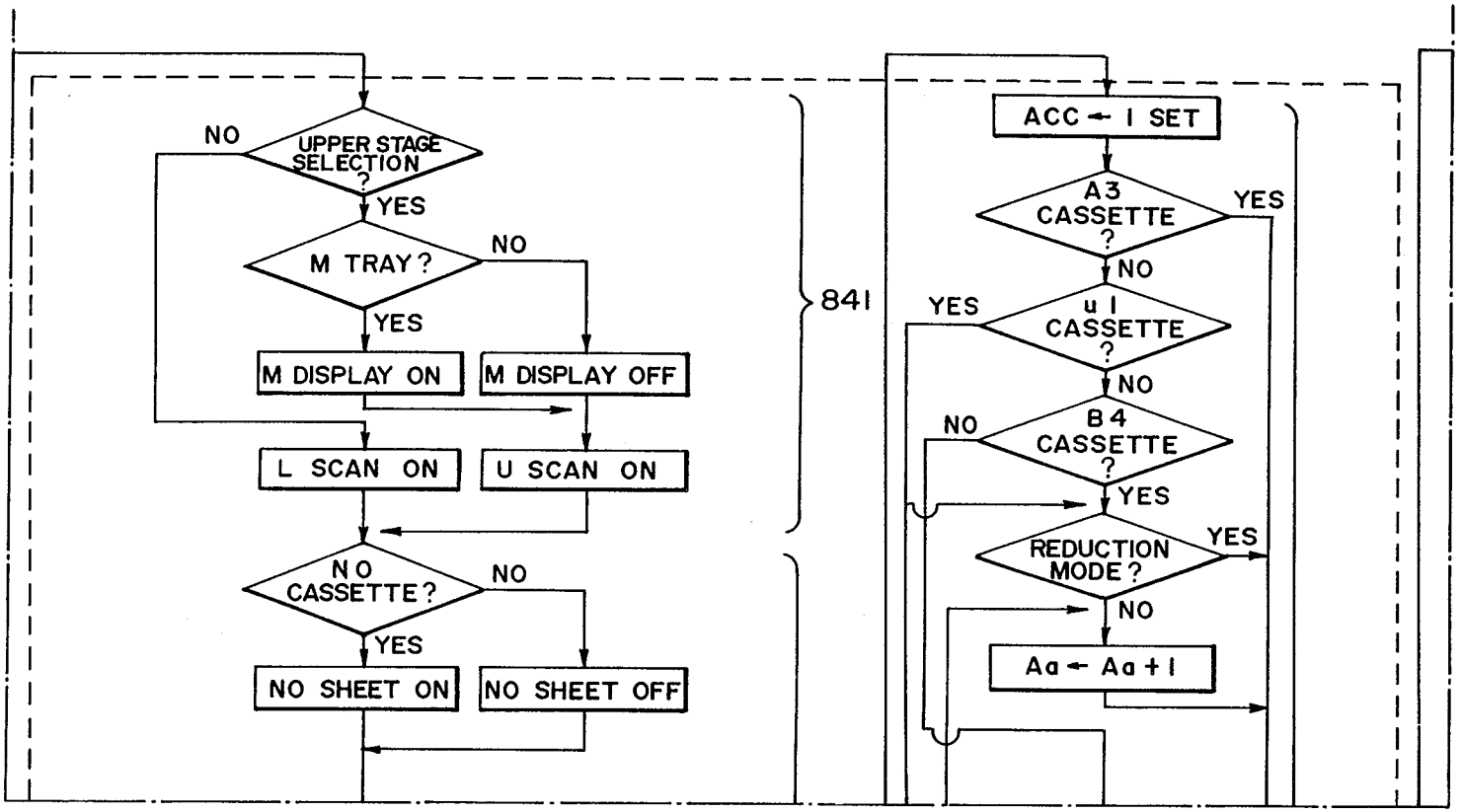
Figures 5, 6, 6E:
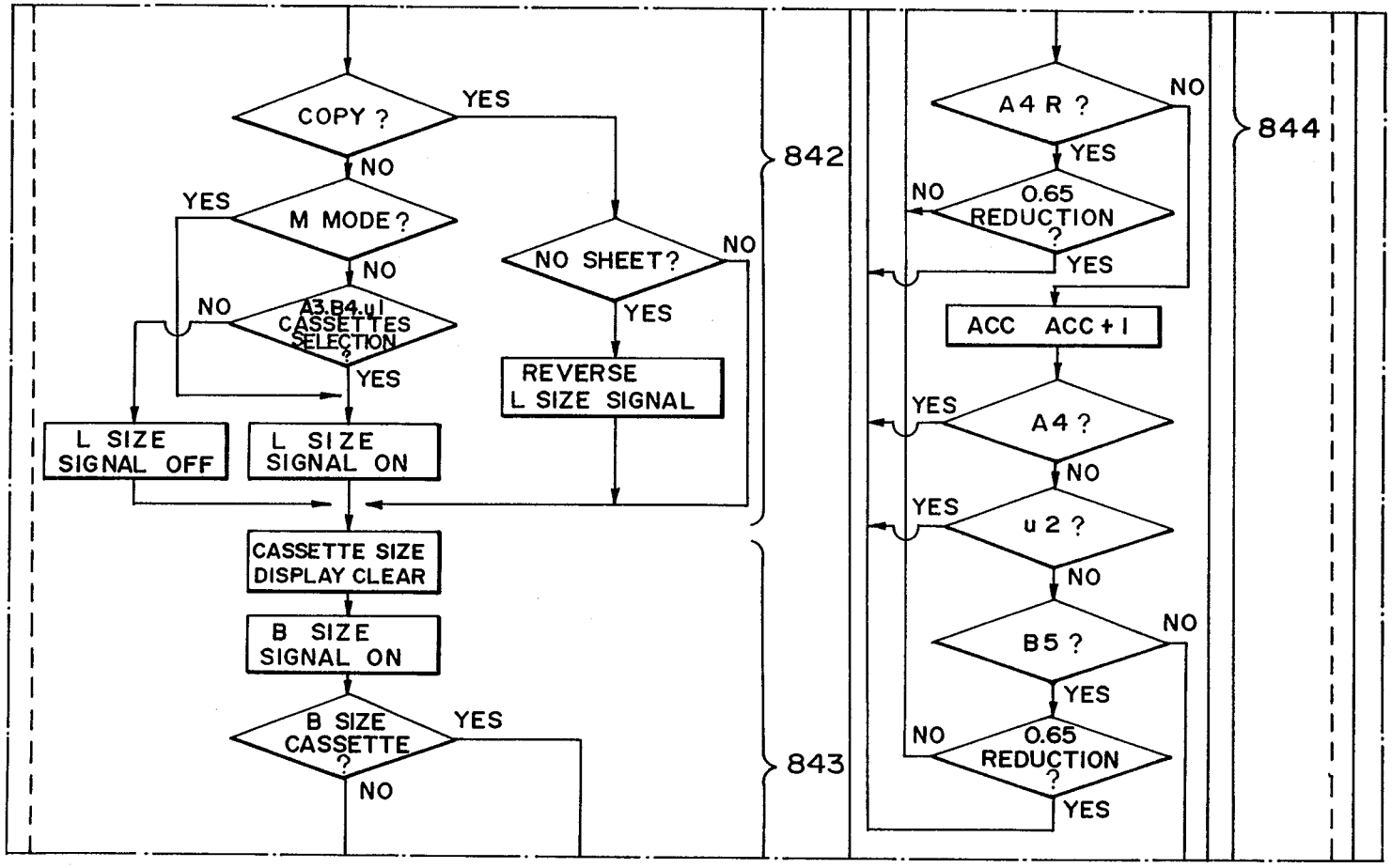
Figures 5, 6, 6F:
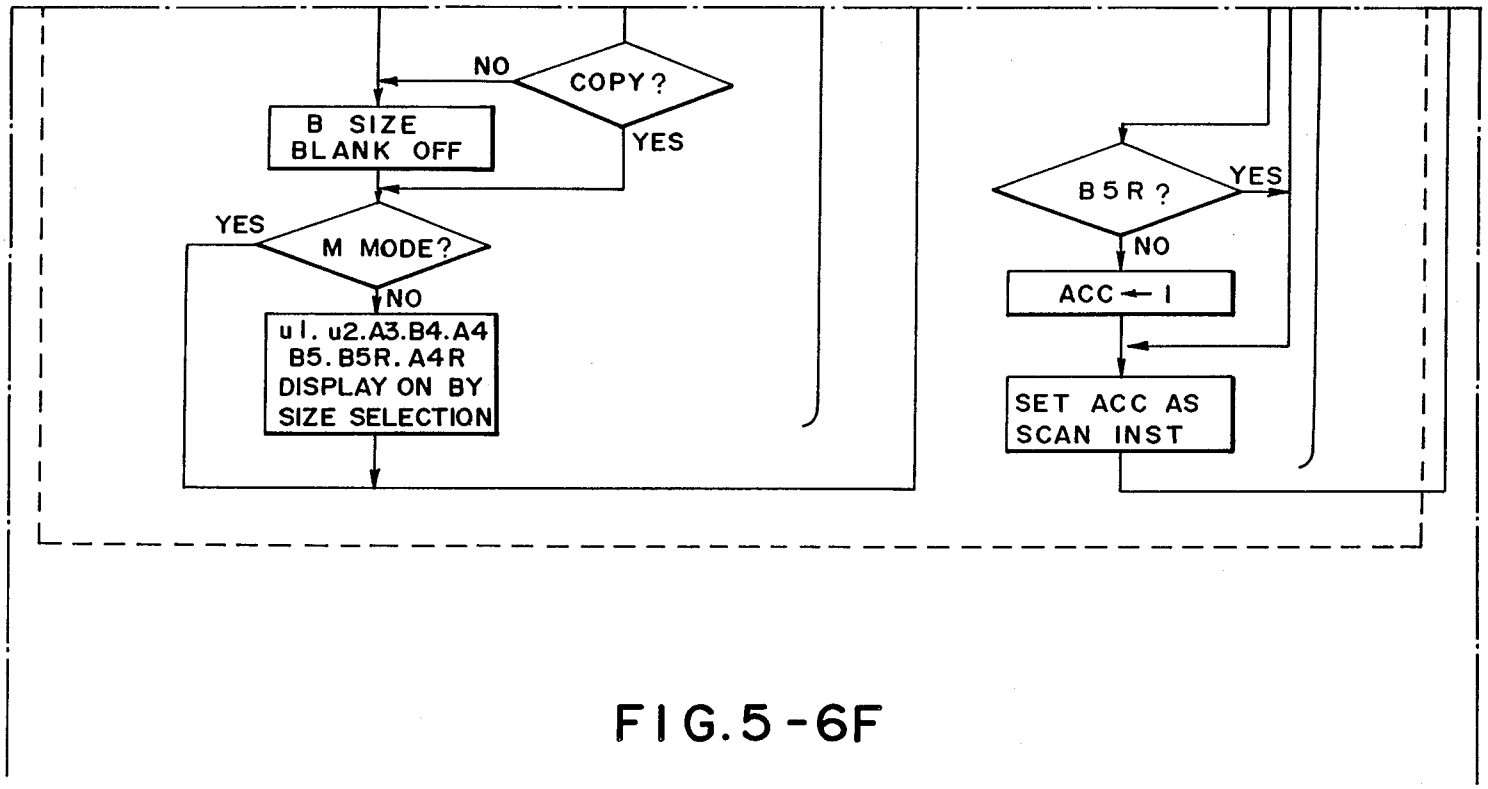
Figures 5, 6, 6G:
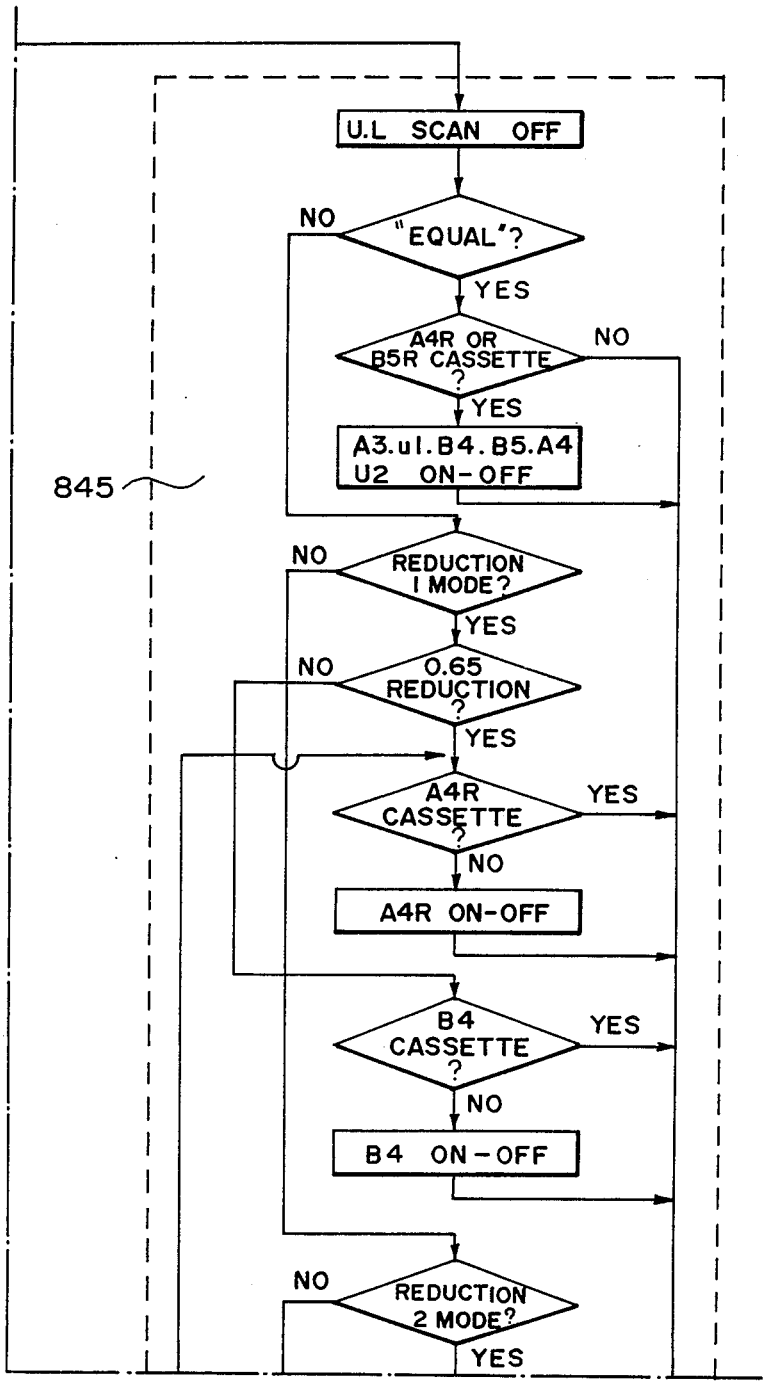
Figures 5, 6, 6H:
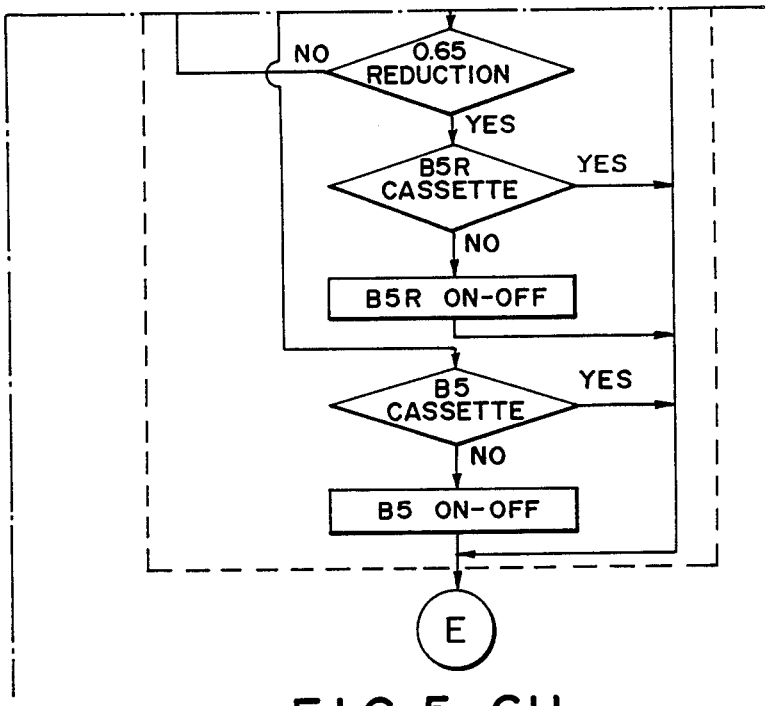
Figures 5, 6:
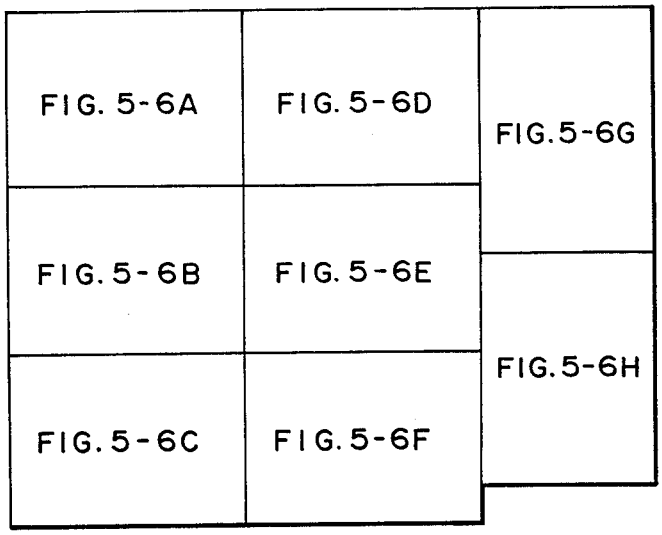
Figures 5, 6, 7, 7A:
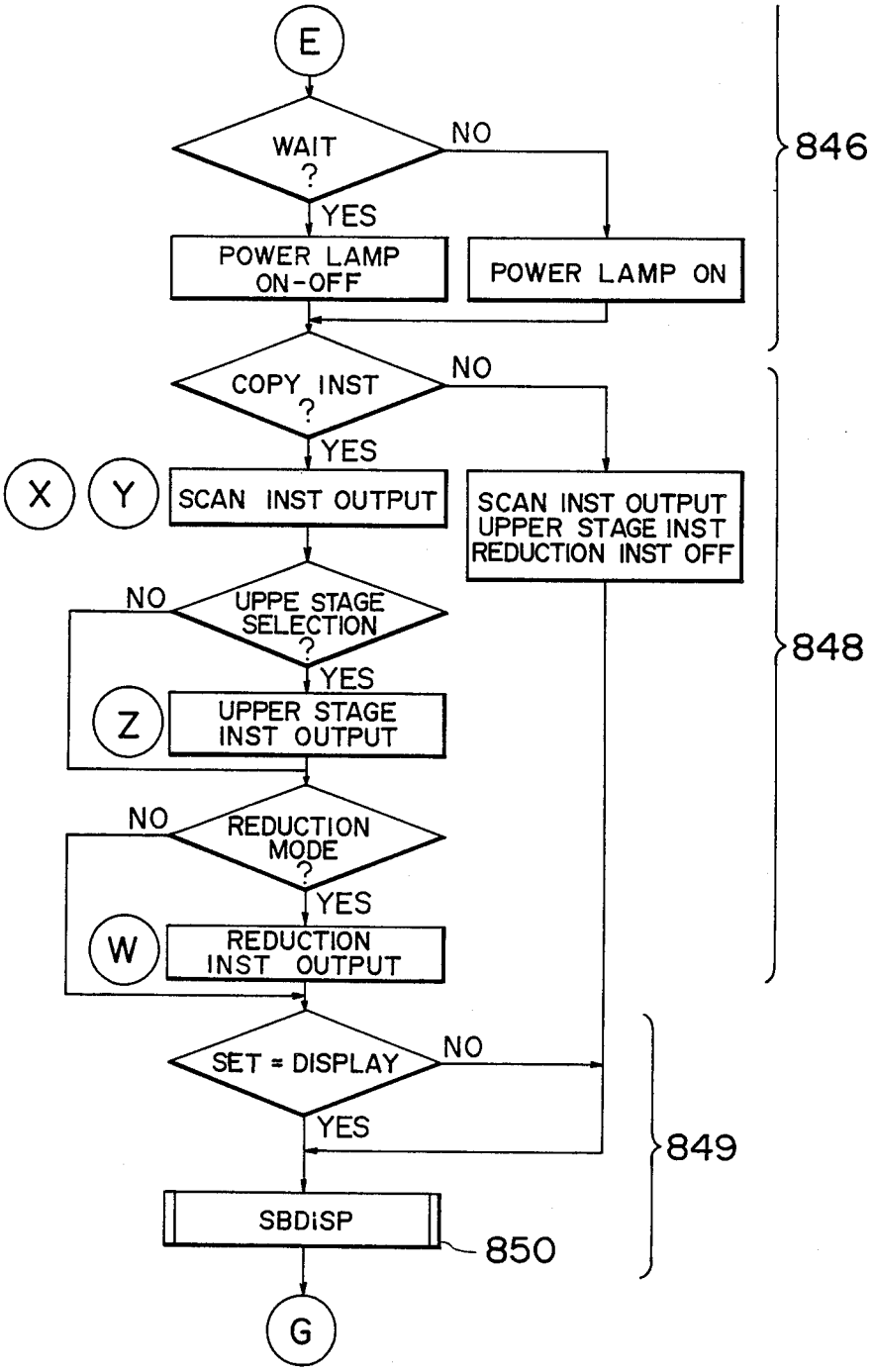
Figures 5, 6, 7, 7B:
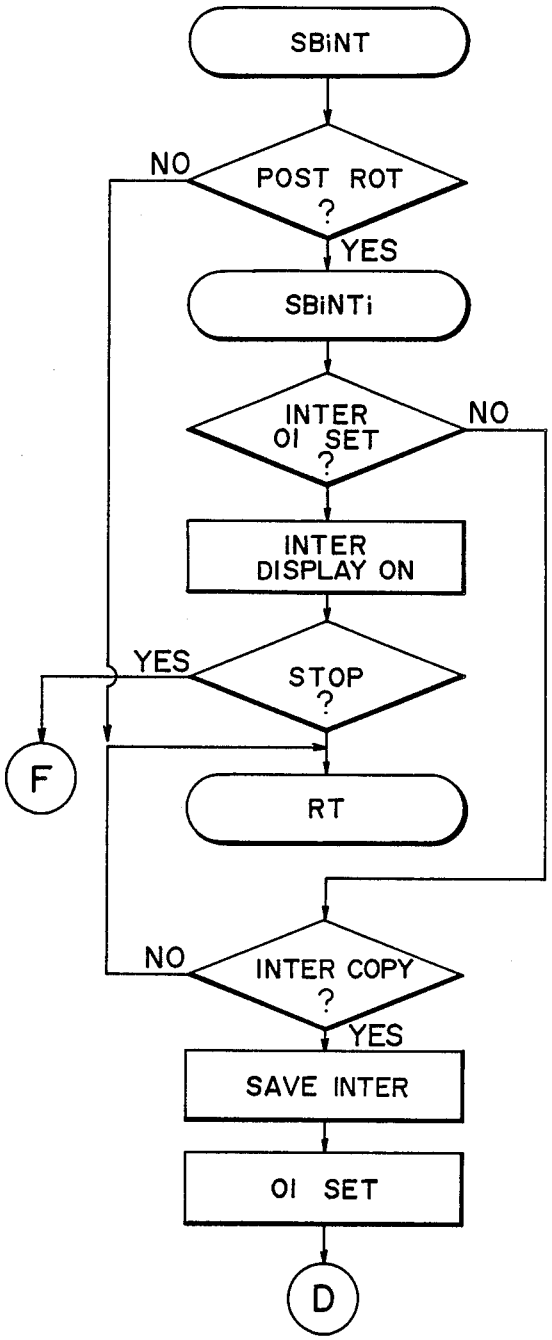
Figures 5, 6, 7, 7C:
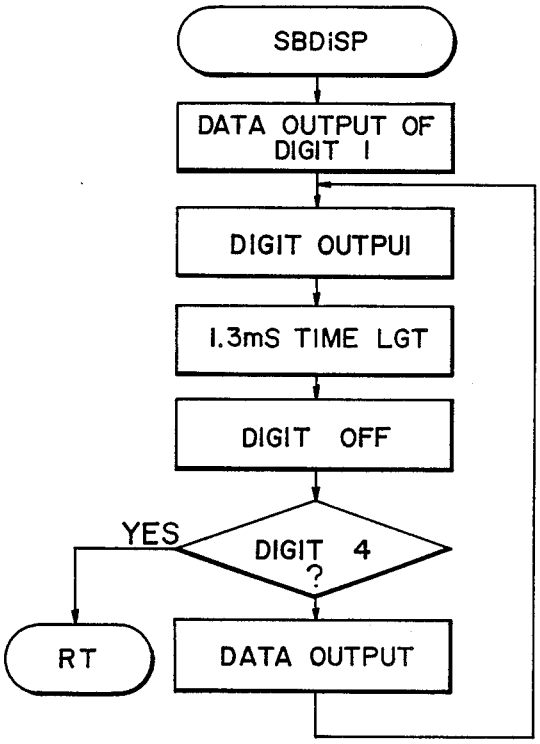
Figures 5, 6, 7:
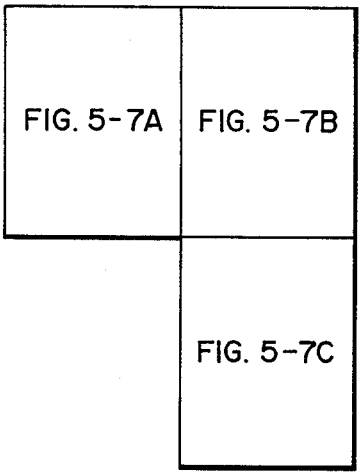
Figures 1, 6:
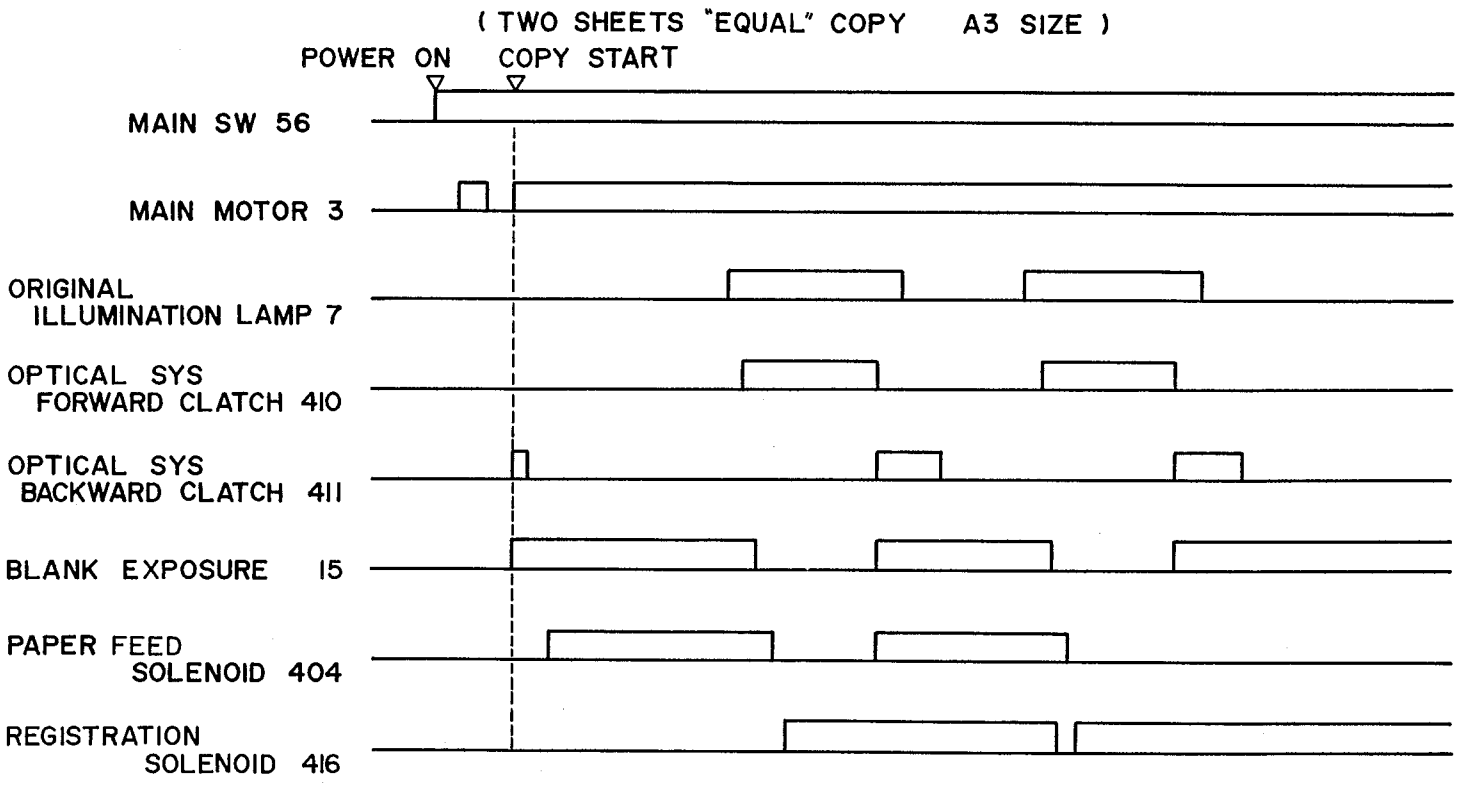
Figures 2, 6:
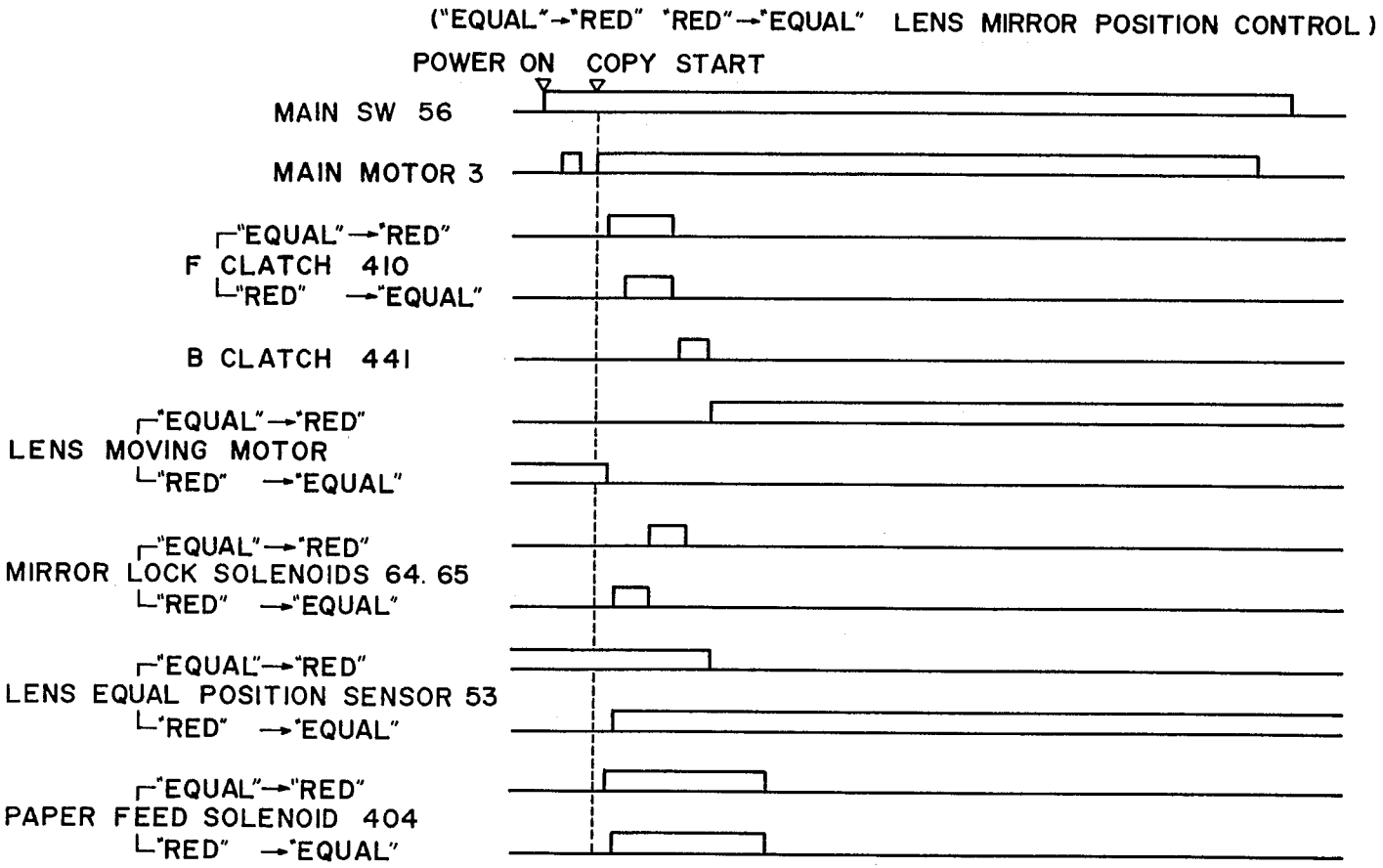
Figure 7:
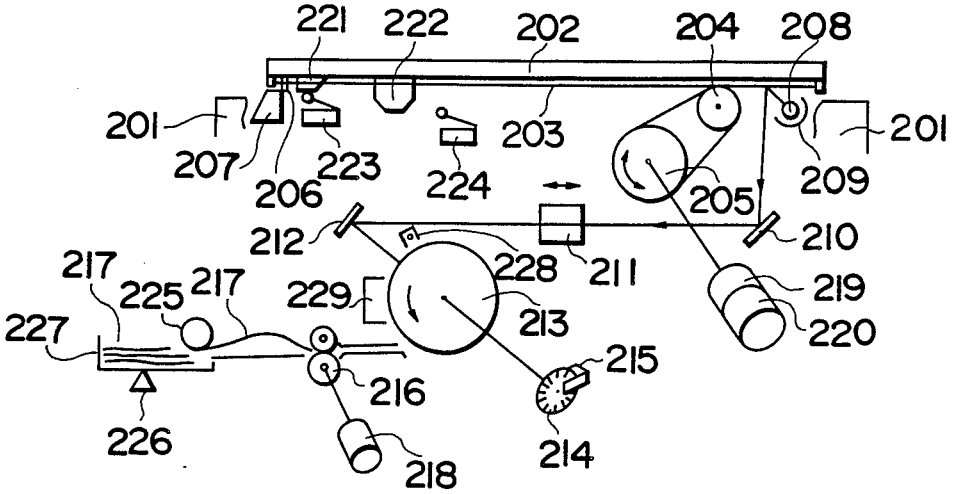
Figure 8:
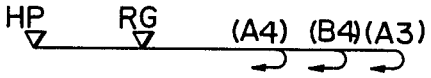
FIG. 8 is a schematic view showing the reversing positions of the platen.
Figure 9:
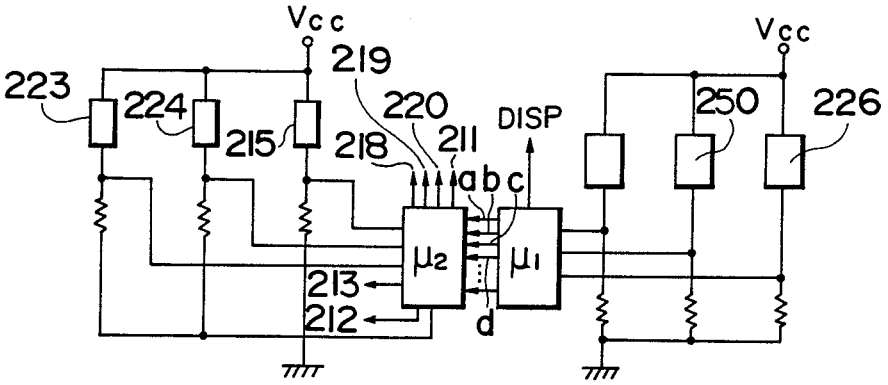
FIG. 9 is a block diagram of the control circuit for the copying apparatus shown in FIG. 7.
Figure 10:
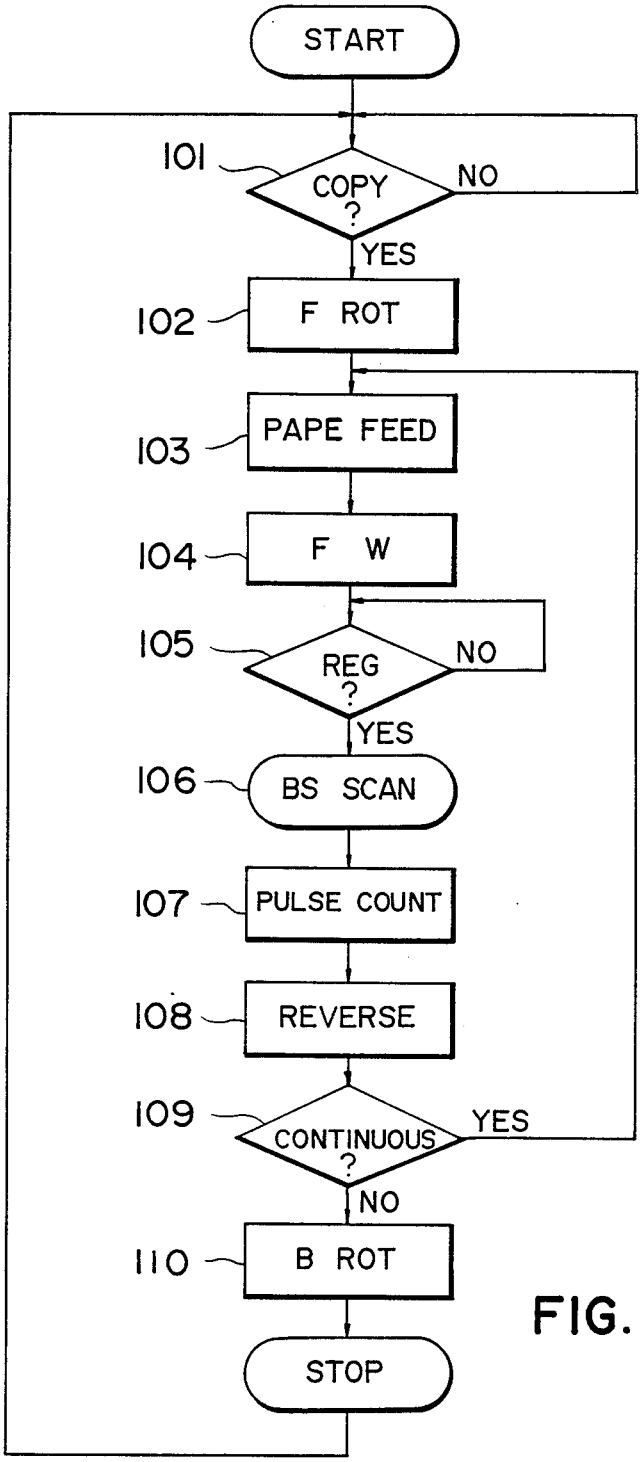
FIG. 10 is a control flow chart thereof.
Figure 11A:
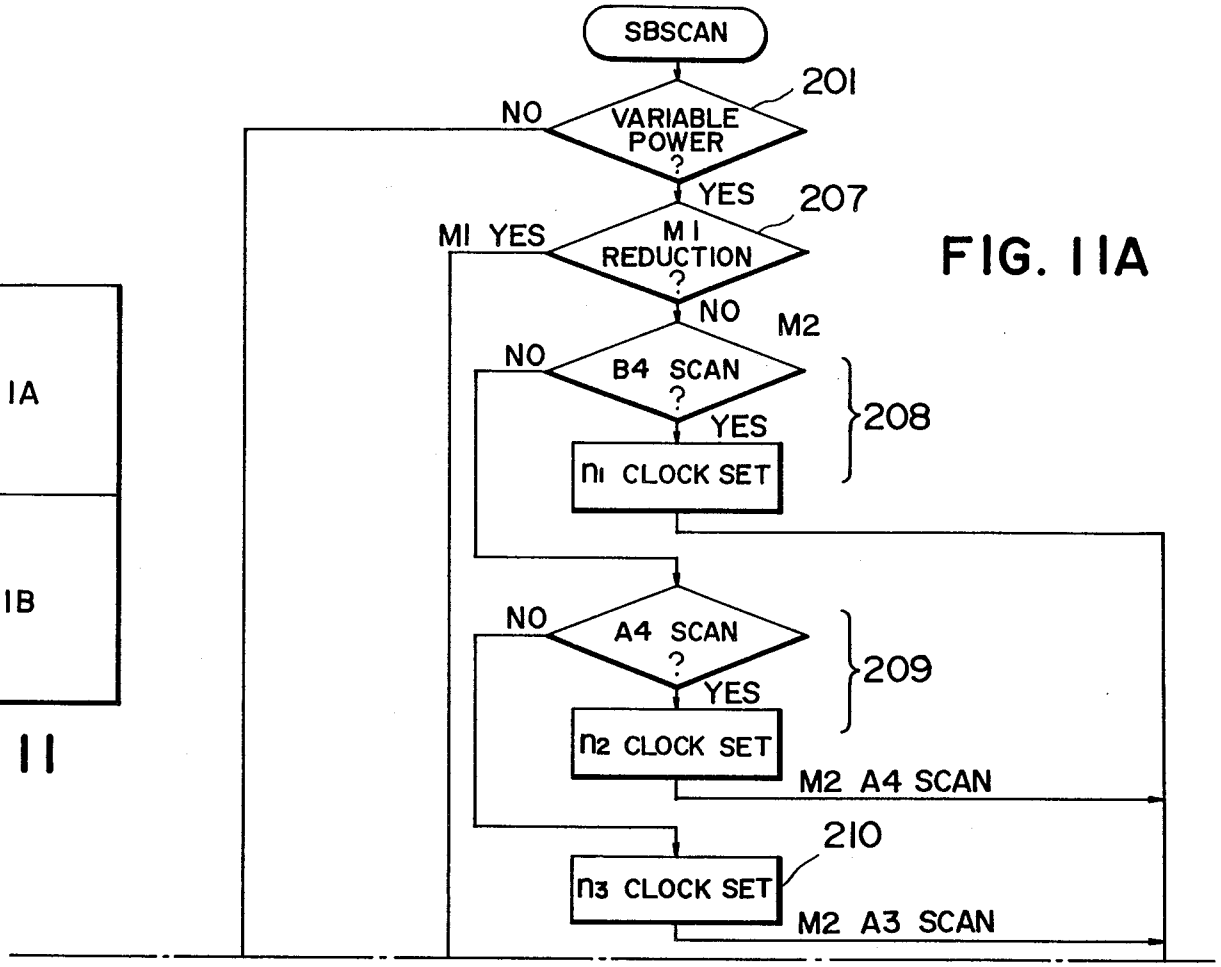
FIG. 11 composed of FIGS. 11A and 11B a flow chart of a subroutine SBSCAN shown in FIG. 10.
Figure 11:
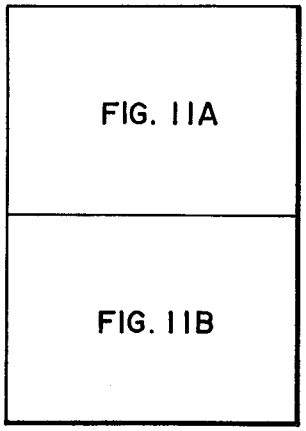
Figure 11B:
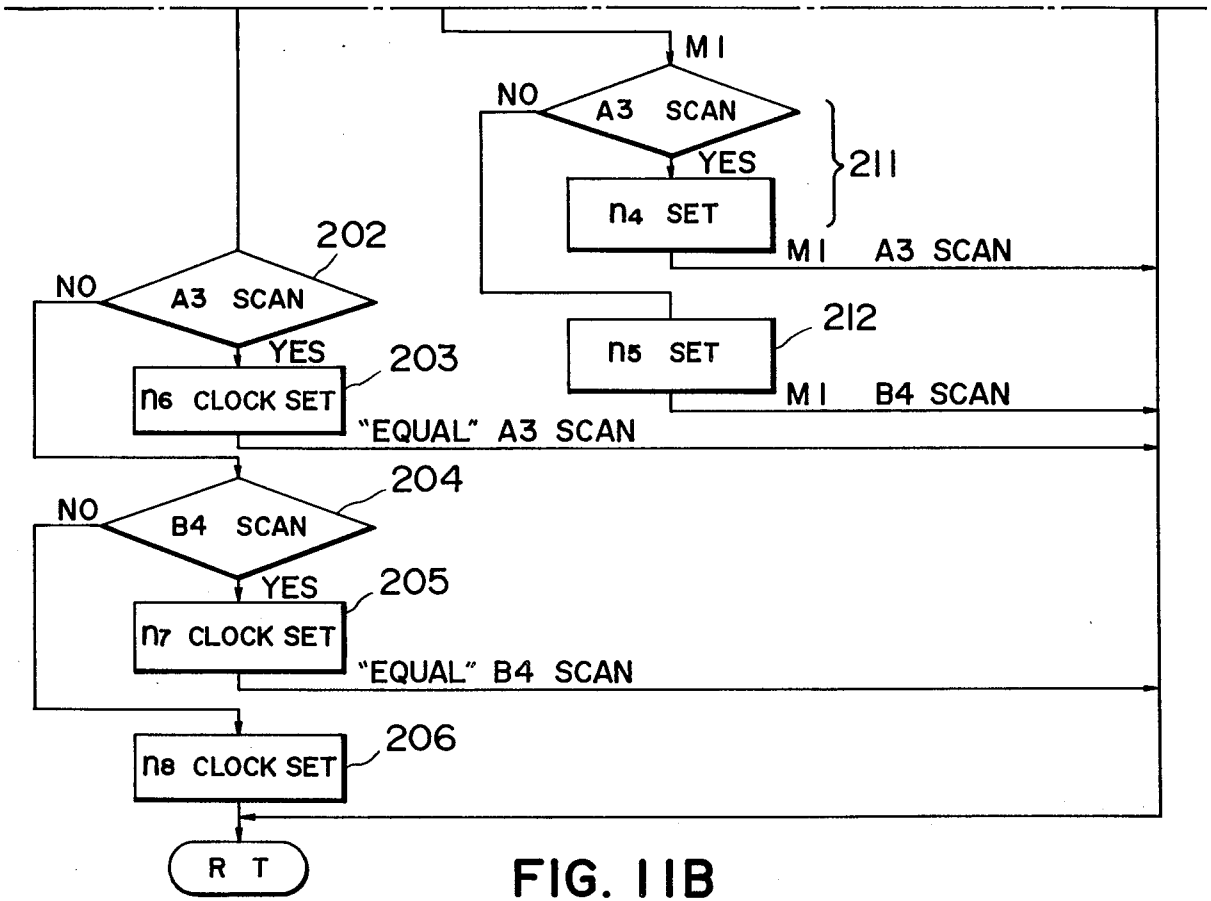
Figure 12:
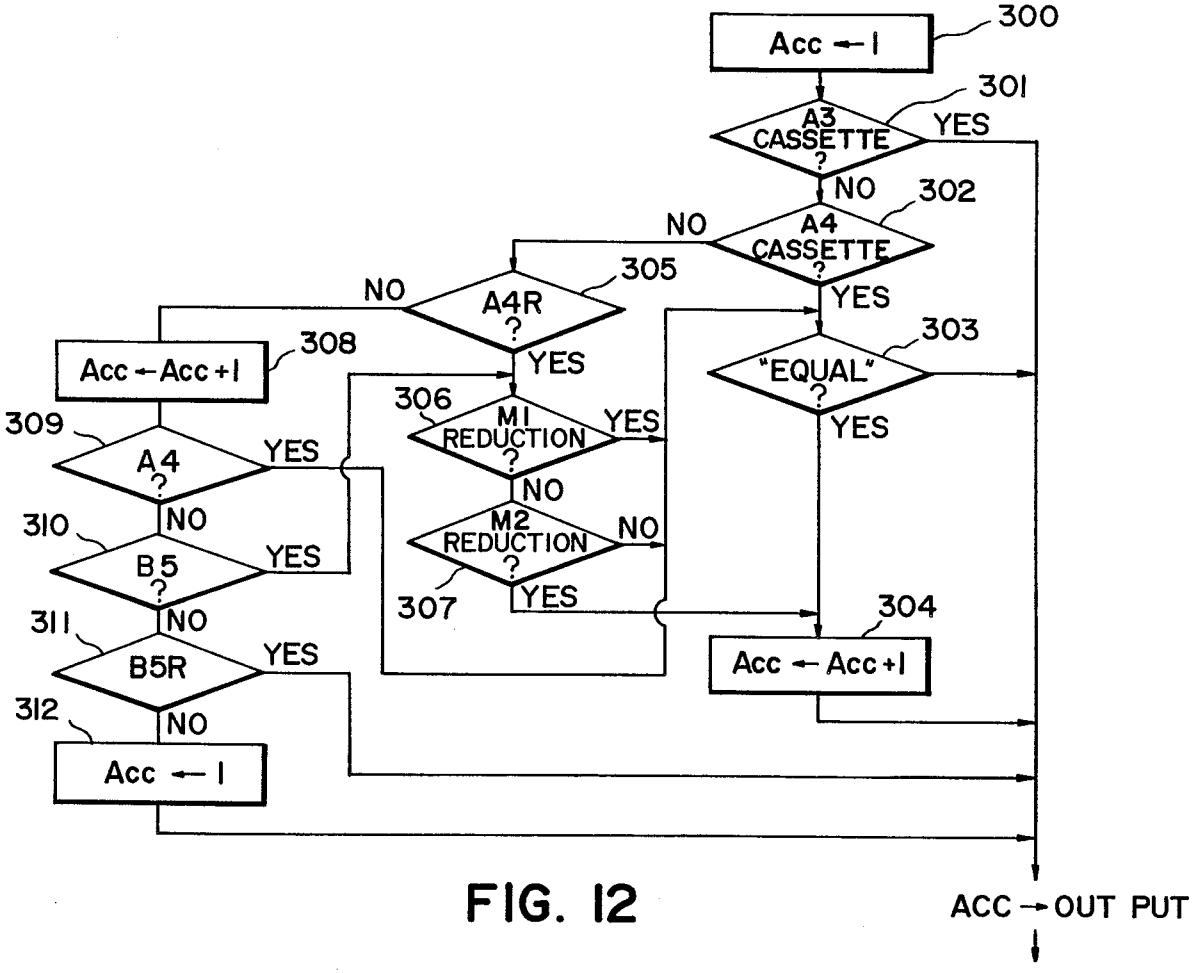
FIG. 12 is a flow chart of a subroutine for determining the scanning width.

Sheet 33, Figure 5-5A, "804 KAM CLEAR" should read --804 RAM CLEAR--.

Sheet 52, Figure 6-1, "FORWARD CLATCH" should read --FORWARD CLUTCH--.

Sheet 52, Figure 6-1, "BACKWARD CLATCH" should read --BACKWARD CLUTCH--.

Sheet 53, Figure 6-2, "B CLATCH" should read --B CLUTCH--.

COLUMN 2

Line 60, "4C a" should read --4C is a--.

COLUMN 3

Line 22, "to" should read --and--.
Line 31, "11B a" should read --11B is a--.

COLUMN 4

Line 7, "a" should read --an--.

UNITED STATES PATENT AND TRADEMARK OFFICE

CERTIFICATE OF CORRECTION

PATENT NO. : 4,711,558

DATED : December 8, 1987

INVENTOR(S) : HIROSHI TANIOKA, ET AL.

It is certified that error appears in the above-identified patent and that said Letters Patent is hereby corrected as shown below:

COLUMN 5

Line 15, "a half of that" should read --half that of--.
Line 20, "light-emitting-" should read --light-emitting--.

COLUMN 6

Line 2, "or cassette;" should read --or lower cassette;--.
Line 29, "continous" should read --continuous--.

COLUMN 7

Line 25, "microcomputer" should read --microcomputers--.

COLUMN 8

Line 7, "a size cassette size" should read --a cassette size--.

COLUMN 12

Line 3, "intercepts" should read --intercept--.
Line 27, "demage" should read --damage--.

COLUMN 13

Line 24, "explained is" should read --is explained--.
Line 31, "solenoid" should read --solenoids--.
Line 40, "and half" should read --and a half--.

UNITED STATES PATENT AND TRADEMARK OFFICE

CERTIFICATE OF CORRECTION

PATENT NO. : 4,711,558

DATED : December 8, 1987

INVENTOR(S) : HIROSHI TANIOKA, ET AL.

It is certified that error appears in the above-identified patent and that said Letters Patent is hereby corrected as shown below:

COLUMN 14

Line 29, "start" should read --starts--.
Line 51, "start" should read --starts--.

COLUMN 15

Line 63, "Neither" should read --If neither--.

COLUMN 17

Line 37, "trasmitted" should read --transmitted--.

COLUMN 18

Line 1, "passibly" should read --possibly--.
Line 36, "occured" should read --occurred--.
Line 41, "occured" should read --occurred--.

COLUMN 19

Line 14, "explained is" should read --is explained--.
Line 52, "light" should read --lights--.

COLUMN 20

Line 1, "atuomatic" should read --automatic--.
Line 65, "seccond" should read --second--.

UNITED STATES PATENT AND TRADEMARK OFFICE

CERTIFICATE OF CORRECTION

PATENT NO. : 4,711,558

DATED : December 8, 1987

INVENTOR(S) : HIROSHI TANIOKA, ET AL.

It is certified that error appears in the above-identified patent and that said Letters Patent is hereby corrected as shown below:

COLUMN 21

Line 10, "light" should read --lights--.

COLUMN 22

Line 62, "operation instructed" should read --operation is instructed--.

COLUMN 24

Line 28, "red" should read --read--.

COLUMN 25

Line 16, "for" (second occurrence) should read --or--.
Line 48, "elmination" should read --elimination--.
Line 58, "without" should read --within--.

UNITED STATES PATENT AND TRADEMARK OFFICE

CERTIFICATE OF CORRECTION

PATENT NO. : 4,711,558

DATED : December 8, 1987

INVENTOR(S) : HIROSHI TANIOKA, ET AL.

It is certified that error appears in the above-identified patent and that said Letters Patent is hereby corrected as shown below:

COLUMN 26

Line 8, "intitiated" should read --initiated--.

Signed and Sealed this

Seventh Day of February, 1989

*Attest:*

DONALD J. QUIGG

*Attesting Officer*

*Commissioner of Patents and Trademarks*